US007143700B2

(12) United States Patent
Forbes et al.

(10) Patent No.: US 7,143,700 B2
(45) Date of Patent: Dec. 5, 2006

(54) RAIL ROAD CAR TRUCK AND FITTINGS THEREFOR

(75) Inventors: James W. Forbes, Campbellville (CA); Jamal Hematian, Burlington (CA)

(73) Assignee: National Steel Car Limited (CA)

( * ) Notice: Subject to any disclaimer, the term of this patent is extended or adjusted under 35 U.S.C. 154(b) by 56 days.

(21) Appl. No.: 10/888,788

(22) Filed: Jul. 8, 2004

(65) Prior Publication Data

US 2005/0022689 A1 Feb. 3, 2005

(30) Foreign Application Priority Data

Jul. 8, 2003 (CA) ..... 2434603
Jul. 31, 2003 (CA) ..... 2436327
Dec. 24, 2003 (CA) ..... 2454472

(51) Int. Cl.
*B61F 5/00* (2006.01)

(52) U.S. Cl. ..... 105/223; 105/218.1

(58) Field of Classification Search ..... 105/218.1, 105/219, 220, 223, 224.1, 225; 384/158, 384/158.1, 183, 184, 185, 186, 191.1, 191.2, 384/191.3, 191.4

See application file for complete search history.

(56) References Cited

U.S. PATENT DOCUMENTS 895,157 A 8/1908 Buxh
1,316,553 A 9/1919 Barber
1,695,085 A 12/1928 Cardwell
1,745,322 A 1/1930 Brittain, Jr.
1,855,903 A 4/1932 Brittain, Jr.
1,902,823 A 3/1933 Bender
1,953,103 A 4/1934 Buckwalter
2,009,771 A 7/1935 Goodwin
2,053,990 A 9/1936 Goodwin
2,129,408 A 9/1938 Davidson (Continued)

FOREIGN PATENT DOCUMENTS

CA 714822 8/1965

(Continued)

OTHER PUBLICATIONS

1937 *Car and Locomotive Cyclopedia*, (New York: Simmons-Boardman Publishing Corporation) pp. 892 & 893.

(Continued)

*Primary Examiner*—Mark T. Le
(74) *Attorney, Agent, or Firm*—McCarthy, Tétrault, LLP

(57) ABSTRACT

A rail road freight car truck has a truck bolster and a pair of side frames, the truck bolster being mounted transversely relative to the side frames. The mounting interface between the ends of the axles and the sideframe pedestals allows lateral rocking motion of the sideframes in the manner of a swing motion truck. The lateral swinging motion is combined with a longitudinal self steering capability. The self steering capability may be obtained by use of a longitudinally oriented rocker that may tend to permit resistance to deflection that is proportional to the weight carried across the interface. The truck may have auxiliary centering elements mounted in the pedestal seats, and those auxiliary centering elements may be made of resilient elastomeric material. The truck may also have friction dampers that have a disinclination to stick-slip behaviour. The friction dampers may be provided with brake linings, or similar features, on the face engaging the sideframe columns, on the slope face, or both. The friction dampers may operate to yield upward and downward friction forces that are not overly unequal. The friction dampers may be mounted in a four-cornered arrangement at each end of the truck bolster. The spring groups may include sub-groups of springs of different heights.

50 Claims, 15 Drawing Sheets

U.S. PATENT DOCUMENTS

| | | | |
|---|---|---|---|
| 2,155,615 | A | 4/1939 | Rice |
| 2,257,109 | A | 9/1941 | Davidson |
| 2,324,267 | A | 7/1943 | Oelkers |
| 2,333,921 | A | 11/1943 | Flesch |
| 2,352,693 | A | 7/1944 | Davidson |
| 2,367,510 | A | 1/1945 | Light |
| 2,404,278 | A | 7/1946 | Dath |
| 2,408,866 | A | 10/1946 | Marquardt |
| 2,424,936 | A | 7/1947 | Light |
| 2,434,583 | A | 1/1948 | Pierce |
| 2,434,838 | A | 1/1948 | Cottrell |
| 2,446,506 | A | 7/1948 | Barrett |
| 2,456,635 | A | 12/1948 | Heater |
| 2,458,210 | A | 1/1949 | Schlegel |
| 2,497,460 | A | 2/1950 | Leese |
| 2,528,473 | A | 10/1950 | Kowalik |
| 2,551,064 | A | 5/1951 | Spenner |
| 2,570,159 | A | 10/1951 | Schlegel |
| 2,613,075 | A | 10/1952 | Barrett |
| 2,650,550 | A | 9/1953 | Pierce |
| 2,661,702 | A | 12/1953 | Kowalik |
| 2,669,943 | A | 2/1954 | Spenner |
| 2,687,100 | A | 8/1954 | Dath |
| 2,688,938 | A | 9/1954 | Kowalik |
| 2,693,152 | A | 11/1954 | Bachman |
| 2,697,989 | A | 12/1954 | Shafer |
| 2,717,558 | A | 9/1955 | Shafer |
| 2,727,472 | A | 12/1955 | Forssell |
| 2,751,856 | A | 6/1956 | Maatman |
| 2,762,317 | A | 9/1956 | Palmgren |
| 2,777,400 | A | 1/1957 | Forssell |
| 2,827,987 | A | 3/1958 | Williams |
| 2,853,958 | A | 9/1958 | Neumann |
| 2,883,944 | A | 4/1959 | Couch |
| 2,911,923 | A | 11/1959 | Bachman et al. |
| 3,024,743 | A | 3/1962 | Williams et al. |
| 3,026,819 | A | 3/1962 | Cope |
| 3,218,990 | A | 11/1965 | Weber |
| 3,274,955 | A | 9/1966 | Thomas |
| 3,285,197 | A | 11/1966 | Tack |
| 3,302,589 | A | 2/1967 | Williams |
| 3,381,629 | A | 5/1968 | Jones |
| 3,461,814 | A | 8/1969 | Weber et al. |
| 3,461,815 | A | 8/1969 | Gedris et al. |
| 3,559,589 | A | 2/1971 | Williams |
| 3,575,117 | A | 4/1971 | Tack |
| 3,670,660 | A | 6/1972 | Weber et al. |
| 3,687,086 | A | 8/1972 | Barber |
| 3,699,897 | A | 10/1972 | Sherrick |
| 3,714,905 | A | 2/1973 | Barber |
| 3,802,353 | A | 4/1974 | Korpies |
| 3,834,320 | A | 9/1974 | Tack |
| 3,844,226 | A | 10/1974 | Brodeur et al. |
| 3,855,942 | A | 12/1974 | Mulcahy |
| 3,857,341 | A | 12/1974 | Neumann |
| 3,880,089 | A | 4/1975 | Wallace |
| 3,897,736 | A | 8/1975 | Tack |
| 3,901,163 | A | 8/1975 | Neumann |
| 3,905,305 | A | 9/1975 | Cope |
| 3,920,231 | A | 11/1975 | Harrison |
| 3,965,825 | A | 6/1976 | Sherrick |
| 3,977,332 | A | 8/1976 | Bullock |
| 3,995,720 | A | 12/1976 | Wiebe |
| 4,003,318 | A | 1/1977 | Bullock et al. |
| 4,034,681 | A | 7/1977 | Neumann et al. |
| 4,067,262 | A | 1/1978 | Scheffel |
| 4,072,112 | A | 2/1978 | Wiebe |
| 4,078,501 | A | 3/1978 | Neumann |
| 4,084,514 | A | 4/1978 | Bullock |
| 4,103,623 | A | 8/1978 | Radwill |
| 4,109,585 | A | 8/1978 | Brose |
| 4,109,586 | A | 8/1978 | Briggs et al. |
| 4,109,934 | A | 8/1978 | Paton et al. |
| 4,111,131 | A | 9/1978 | Bullock |
| 4,148,469 | A | 4/1979 | Geyer |
| 4,151,801 | A | 5/1979 | Scheffel et al. |
| 4,167,907 | A | 9/1979 | Mulcahy et al. |
| 4,179,995 | A | 12/1979 | Day |
| 4,186,914 | A | 2/1980 | Radwill et al. |
| 4,192,240 | A | 3/1980 | Korpics |
| 4,196,672 | A | 4/1980 | Bullock |
| 4,230,047 | A | 10/1980 | Wiebe |
| 4,236,457 | A | 12/1980 | Cope |
| 4,237,793 | A | 12/1980 | Holden et al. |
| 4,239,007 | A | 12/1980 | Kleykamp et al. |
| 4,242,966 | A | 1/1981 | Holt et al. |
| 4,244,297 | A | 1/1981 | Monselle |
| 4,254,712 | A | 3/1981 | O'Neill |
| 4,254,713 | A | 3/1981 | Clafford |
| 4,256,041 | A | 3/1981 | Kemper et al. |
| 4,265,182 | A | 5/1981 | Neff et al. |
| 4,274,339 | A | 6/1981 | Cope |
| 4,274,340 | A | 6/1981 | Neumann et al. |
| 4,276,833 | A | 7/1981 | Bullock |
| 4,295,429 | A | 10/1981 | Wiebe |
| 4,311,098 | A | 1/1982 | Irwin |
| 4,316,417 | A | 2/1982 | Martin |
| 4,332,201 | A | 6/1982 | Pollard et al. |
| 4,333,403 | A | 6/1982 | Tack et al. |
| RE31,008 | E | 8/1982 | Barber |
| 4,342,266 | A | 8/1982 | Cooley |
| 4,351,242 | A | 9/1982 | Irwin |
| 4,356,775 | A | 11/1982 | Paton et al. |
| 4,357,880 | A | 11/1982 | Weber |
| 4,363,276 | A | 12/1982 | Neumann |
| 4,363,278 | A | 12/1982 | Mulcahy |
| 4,370,933 | A | 2/1983 | Mulcahy |
| 4,373,446 | A | 2/1983 | Cope |
| 4,413,569 | A | 11/1983 | Mulcahy |
| 4,416,203 | A | 11/1983 | Sherrick |
| 4,426,934 | A | 1/1984 | Geyer |
| 4,434,720 | A | 3/1984 | Mulcahy et al. |
| 4,483,253 | A | 11/1984 | List |
| RE31,784 | E | 1/1985 | Wiebe |
| 4,491,075 | A | 1/1985 | Neumann |
| 4,512,261 | A | 4/1985 | Horger |
| 4,526,109 | A | 7/1985 | Dickhart et al. |
| 4,537,138 | A | 8/1985 | Bullock |
| RE31,988 | E | 9/1985 | Wiebe |
| 4,552,074 | A | 11/1985 | Mulcahy et al. |
| 4,554,875 | A | 11/1985 | Schmitt et al. |
| 4,574,708 | A | 3/1986 | Solomon |
| 4,590,864 | A | 5/1986 | Przybylinski |
| 4,637,319 | A | 1/1987 | Moehling et al. |
| 4,660,476 | A | 4/1987 | Franz |
| 4,674,411 | A | 6/1987 | Schindehutte |
| 4,674,412 | A | 6/1987 | Mulcahy et al. |
| 4,676,172 | A | 6/1987 | Bullock |
| 4,765,251 | A | 8/1988 | Guins |
| 4,785,740 | A | 11/1988 | Grandy |
| 4,813,359 | A | 3/1989 | Marulic et al. |
| 4,825,775 | A | 5/1989 | Stein et al. |
| 4,825,776 | A | 5/1989 | Spencer |
| 4,870,914 | A | 10/1989 | Radwill |
| 4,915,031 | A | 4/1990 | Wiebe |
| 4,936,226 | A | 6/1990 | Wiebe |
| 4,938,152 | A | 7/1990 | List |
| 4,953,471 | A | 9/1990 | Wronkiewicz et al. |
| 4,974,521 | A | 12/1990 | Eungard |
| 4,986,192 | A | 1/1991 | Wiebe |
| 5,000,097 | A | 3/1991 | List |
| 5,001,989 | A | 3/1991 | Mulcahy et al. |
| 5,009,521 | A | 4/1991 | Wiebe |
| 5,027,716 | A | 7/1991 | Weber et al. |

| | | | | |
|---|---|---|---|---|
| 5,046,431 | A | | 9/1991 | Wagner |
| 5,081,935 | A | | 1/1992 | Pavlick |
| 5,086,708 | A | | 2/1992 | McKeown, Jr. et al. |
| 5,095,823 | A | | 3/1992 | McKeown, Jr. |
| 5,107,773 | A | | 4/1992 | Daley et al. |
| 5,111,753 | A | | 5/1992 | Zigler et al. |
| 5,138,954 | A | | 8/1992 | Mulcahy |
| 5,174,218 | A | | 12/1992 | List |
| 5,176,083 | A | | 1/1993 | Bullock |
| 5,226,369 | A | | 7/1993 | Weber |
| 5,235,918 | A | | 8/1993 | Durand et al. |
| 5,237,933 | A | | 8/1993 | Bucksbee |
| 5,239,932 | A | | 8/1993 | Weber |
| 5,241,913 | A | | 9/1993 | Weber |
| 5,327,837 | A | | 7/1994 | Weber |
| 5,331,902 | A | | 7/1994 | Hawthorne et al. |
| 5,404,826 | A | | 4/1995 | Rudibaugh et al. |
| 5,410,968 | A | | 5/1995 | Hawthorne et al. |
| 5,417,163 | A | | 5/1995 | Lienard |
| RE34,963 | E | | 6/1995 | Eungard |
| 5,450,799 | A | | 9/1995 | Goding |
| 5,452,665 | A | | 9/1995 | Wronkiewicz et al. |
| 5,463,964 | A | | 11/1995 | Long et al. |
| 5,481,986 | A | | 1/1996 | Spencer et al. |
| 5,503,084 | A | | 4/1996 | Goding et al. |
| 5,509,358 | A | | 4/1996 | Hawthorne et al. |
| 5,511,489 | A | | 4/1996 | Bullock |
| 5,524,551 | A | | 6/1996 | Hawthorne et al. |
| 5,544,591 | A | | 8/1996 | Taillon |
| 5,555,817 | A | | 9/1996 | Taillon |
| 5,555,818 | A | | 9/1996 | Bullock |
| 5,562,045 | A | * | 10/1996 | Rudibaugh et al. ..... 105/224.1 |
| 5,572,931 | A | | 11/1996 | Lazar |
| 5,613,445 | A | | 3/1997 | Rismiller |
| 5,632,208 | A | | 5/1997 | Weber |
| 5,647,283 | A | | 7/1997 | McKisic |
| 5,666,885 | A | | 9/1997 | Wike |
| 5,722,327 | A | | 3/1998 | Hawthorne et al. |
| 5,735,216 | A | | 4/1998 | Bullock et al. |
| 5,746,137 | A | | 5/1998 | Hawthorne et al. |
| 5,749,301 | A | | 5/1998 | Wronkiewicz et al. |
| 5,794,538 | A | | 8/1998 | Pitchford |
| 5,799,582 | A | | 9/1998 | Rudibaugh et al. |
| 5,802,982 | A | | 9/1998 | Weber |
| 5,850,795 | A | | 12/1998 | Taillon |
| 5,875,721 | A | | 3/1999 | Wright et al. |
| 5,918,547 | A | | 7/1999 | Bullock |
| 5,921,186 | A | | 7/1999 | Hawthorne et al. |
| 5,924,366 | A | | 7/1999 | Trainer et al. |
| 5,943,961 | A | | 8/1999 | Rudibaugh et al. |
| 5,967,053 | A | | 10/1999 | Toussaint et al. |
| 5,992,330 | A | | 11/1999 | Gilbert et al. |
| 6,125,767 | A | | 10/2000 | Hawthorne et al. |
| 6,142,081 | A | * | 11/2000 | Long et al. ..... 105/218.1 |
| 6,173,655 | B1 | | 1/2001 | Hawthorne |
| 6,178,894 | B1 | | 1/2001 | Leingang |
| 6,186,075 | B1 | | 2/2001 | Spencer |
| 6,227,122 | B1 | | 5/2001 | Spencer |
| 6,269,752 | B1 | | 8/2001 | Taillon |
| 6,276,283 | B1 | | 8/2001 | Weber |
| 6,338,300 | B1 | | 1/2002 | Landrot |
| 6,347,588 | B1 | | 2/2002 | Leingang |
| 6,371,033 | B1 | | 4/2002 | Smith |
| 6,374,749 | B1 | | 4/2002 | Duncan et al. |
| 6,422,155 | B1 | | 7/2002 | Heyden |
| 6,425,334 | B1 | | 7/2002 | Wronkiewicz et al. |
| 6,591,759 | B1 | | 7/2003 | Bullock |
| 6,631,685 | B1 | | 10/2003 | Hewitt |
| 6,672,224 | B1 | | 1/2004 | Weber et al. |
| 6,688,236 | B1 | | 2/2004 | Taillon |
| 6,691,625 | B1 | | 2/2004 | Duncan |
| 6,701,850 | B1 | | 3/2004 | McCabe et al. |
| 2003/0024429 | A1 | | 2/2003 | Forbes |
| 2003/0041772 | A1 | | 3/2003 | Forbes |
| 2003/0097955 | A1 | | 5/2003 | Bullock |
| 2003/0129037 | A1 | | 7/2003 | Forbes |

FOREIGN PATENT DOCUMENTS

| | | |
|---|---|---|
| CA | 2090031 | 6/1991 |
| CA | 2153137 | 6/1995 |
| EP | 1053925 A1 | 11/2000 |

OTHER PUBLICATIONS

1961 *Car Builders Cyclopedia*, 21st ed. (New York: Simmons-Boardman Publishing Corporation, 1961) at pp. 846, 847.

1966 *Car and Locomotive Cyclopedia*, (New York: Simmons-Boardman Publishing Corporation pp. 818 & 819.

1974 *Car and Locomotive Cyclopedia, 3rd* ed. (New York: Simmons-Boardman Publishing Corporation, 1974) pp. S13-36, S13-37.

1980 *Car and Locomotive Cyclopedia*, pp. 669-750. Section 13.

1984 *Car and Locomotive Cyclopedia*, 5th ed. (Omaha: Simmons-Boardman Books, Inc. 1984) at pp. 512-513.

1997 *Car and Locomotive Cyclopedia*, 6th ed. (Omaha: Simmons-Boardman Books, Inc. 1997) at pp. 705-770. Section 7: Trucks Wheels Axles & Bearings.

1997 *Car and Locomotive Cyclopedia*, 6th ed. (Omaha: Simmons-Boardman Books, Inc. 1997) at pp. 811-822. Section 7 Bearings.

1966 *Car and Locomotive Cyclopedia*, 1st ed. (New York: Simmons-Boardman Publishing Corporation, 1966) at p. 827.

1970 *Car and Locomotive Cyclopedia*, 2nd ed. (New York: Simmons-Boardman Publishing Corporation, 1970) at p. 816.

1984 *Car and Locomotive Cyclopedia*, 5th ed. (Omaha: Simmons-Boardmand Books, Inc. 1984) at pp. 488, 489, 496, 500 and 526.

1997 *Car and Locomotive Cyclopedia*, 6th ed. (Omaha: Simmons-Boardman Books, Inc. 1997) at p. 747.

Nov. 1998 *Railway Age*, pp. 47, 51, 53, 62.

Jul. 2003, "A Dynamic Relationship", *Railway Age*, at pp. 37-38.

*Railway Age*, Comprehensive Railroad Dictionary (Simmons-Boardman Books, Inc.) p. 142, no date.

Sep. 1996, Rownd, K. et al., "Improved Ride Quality of Finished Automobiles by Rail", *Technology Digest* TD 96-021, Association of American Railroads.

Sep. 1996, Rownd, K. et al., "Over-the-Road Tests Demonstrated Improved Ride Quality for Transportation of Finished Automobiles", *Technology Digest* TD 96-022, Association of American Railroads.

Sep. 1997, Burnett, S. et al., "Improved Vehicle Dynamics Model for Tri-Level Auto-Rack Railcars", *Technology Digest* TD 97-038, Assoication of American Railroads.

Sep. 1997, Rownd, K. eet al., "Improved Ride Quality for Rail Transport of Finished Automobiles", *Technology Digest* TD 97-039, Association of American Railroads.

Jun. 1998, Rownd, K. et al., "Use of Modified Suspensions to Improve Ride Quality in Bi-Level Auto-Racks", *Technology Digest* 98-014, Association of American Railroads.

Oct. 1998, Rownd, K. et al., "Improved Ride-Quality for Transportation of Finished Auto by Tri-Level Autorack", *Technology Digest* 98-025, Association of American Railroads.

Dec. 1998, Rownd, K. et al., "Advanced Suspensions Meet Performance Standards for Bi-Level Auto-Rack Cars", *Technology Digest* 98-032, Association of American Railroads.

Jun. 1999, Rownd, K. et al., "Advanced Suspensions Meet Ride-Quality Performance Standards for Tri-Level Auto-Rack Cars,", *Technology Digest* 99-020, Association of American Railroads.

Jun. 1999, Rownd, K. et al., "Evaluation of End-of-Car Cushioning Designs Using the TOES Model", *Technology Digest* 99-019, Association of American Railroads.

Aug. 1999, Rownd, K. et al., "Improving the Economy of Bulk-Commodity Service Through Improved Suspensions", *Technology Digest* 99-027, Association of American Railroads.

Jul. 2000, Rownd, K. et al., "Improving the Economics of Bulk-Commodity Service: ASF Bulk Truck", *Technology Digest* 00-011, Association of American Railroads.

Jul. 2000, Rownd, K. et al., "Improving the Economics of Bulk-Commodity Service—S3E Standard Car Truck", *Technology Digest* 00-012, Association of American Railroads.
ASF Trucks "Good for the Long Run," American Steel Foundries, date unknown.
ASF User's Guide, "Freight Car Truck Design," American Steel Foundries, ASF652, date unknown.
ADAPTERPlus, Pennsy Corporation, Internet—PENNSY.com, Ver. 9807, date unknown.
*User's Manual for NUCARS*, Version 2.0, SD-o43, at pp. 5-39, 5-40, no date.
Barber S-2-D Product Bulletin, no date.
Association of American Railroads Mechanical Division Manual of Standards and Recommended Practices Journal "Roller Bearing Adapters for Freight Cars", date unknown, pp. H-35-H-42.
Narrow Pedestal Side Frame Trucks, Timken Roller Bearing Company, date unknown.
Timken "AP" Bearing Assembly, Timken Roller Bearing Company, date unknown.
Buckeye XC-R VII, Buckeye Steel Castings, date unknown.
Buckeye XC-R, Buckeye Steel Castings, date unknown.
Standard Car Truck Company, Truck Information Package 2000: ● Iron Friction Wedge Replacement Guide, Standard Car Truck Company, 2000. ● Lifeguard Friction Wedge Replacement Guide, Standard Car Truck Company, 2000. ● TwinGuard Friction Wedge Replacement Guide, Standard Car Truck Company, 2000. ● Product Bulletin, Barber TwinGuard, Standard Car Truck Company, date unknown. ● Barber Split Wedge, Standard Car Truck Company, date unknown. Barber Split Wedge Replacement Guide, Standard Car Truck Company, 2000. ● Barber 905-SW Split Wedge Friction Casting, Standard Car Truck Company, 2000. ● Barber 905-SW Split Wedge Pocket Insert, Standard Car Truck Company, 2000. ● Barber 905-SW Split Wedge Insert Application Guide, Standard Car Truck Company, 2000.
Standard Car Truck Company Barber Stabilized Trucks presentation Oct. 10, 2000.
Standard Car Truck Company "Barber Change Brings Choices", date unknown.
Standard Car Truck Company Barger Friction Wedge Matrix, date unknown.
Standard Car Truck Company Barber Stabilized Truck—Suspension Performance Properties, Mar. 14, 2000.

* cited by examiner $L_{Pendulum}$ 450
450
446
450
448
450
444
444

444

450
446
'10e'
'10e'
444
450
448
'10f
450
'10f
450
Bottom View 444
448

26
410
156
444
156

RAIL ROAD CAR TRUCK AND FITTINGS THEREFOR

FIELD OF THE INVENTION

This invention relates to the field of rail road cars, and, more particularly, to the field of three piece rail road car trucks for rail road cars.

BACKGROUND OF THE INVENTION

Rail road cars in North America commonly employ double axle swivelling trucks known as "three piece trucks" to permit them to roll along a set of rails. The three piece terminology refers to a truck bolster and pair of first and second sideframes. In a three piece truck, the truck bolster extends cross-wise relative to the sideframes, with the ends of the truck bolster protruding through the sideframe windows. Forces are transmitted between the truck bolster and the sideframes by spring groups mounted in spring seats in the sideframes. The sideframes carry forces to the sideframe pedestals. The pedestals seat on bearing adapters, whence forces are carried in turn into the bearings, the axle, the wheels, and finally into the tracks. The 1980 *Car & Locomotive Cyclopedia* states at page 669 that the three piece truck offers "interchangeability, structural reliability and low first cost but does so at the price of mediocre ride quality and high cost in terms of car and track maintenance."

Ride quality can be judged on a number of different criteria. There is longitudinal ride quality, where, often, the limiting condition is the maximum expected longitudinal acceleration experienced during humping or flat switching, or slack run-in and run-out. There is vertical ride quality, for which vertical force transmission through the suspension is the key determinant. There is lateral ride quality, which relates to the lateral response of the suspension. There are also other phenomena to be considered, such as truck hunting, the ability of the truck to self steer, and, whatever the input perturbation may be, the ability of the truck to damp out undesirable motion. These phenomena tend to be inter-related, and the optimization of a suspension to deal with one phenomenon may yield a system that may not necessarily provide optimal performance in dealing with other phenomena.

In terms of optimizing truck performance, it may be advantageous to be able to obtain a relatively soft dynamic response to lateral and vertical perturbations, to obtain a measure of self steering, and yet to maintain resistance to lozenging (or parallelogramming). Lozenging, or parallelogramming, is non-square deformation of the truck bolster relative to the side frames of the truck as seen from above. Self steering may tend to be desirable since it may reduce drag and may tend to reduce wear to both the wheels and the track, and may give a smoother overall ride.

Among the types of truck discussed in this application are swing motion trucks. An earlier patent for a swing motion truck is U.S. Pat. No. 3,670,660 of Weber et al., issued Jun. 20, 1972. This truck has unsprung lateral cross bracing, in the nature of a transom that links the sideframes together. By contrast, the description that follows describes several embodiments of truck that do not employ lateral unsprung cross-members, but that may use of damper elements mounted in a four-cornered arrangement at each end of the truck bolster. An earlier patent for dampers is U.S. Pat. No. 3,714,905 of Barber, issued Feb. 6, 1973.

SUMMARY OF THE INVENTION

In an aspect of the invention, there is a wheelset-to-sideframe interface assembly for a railroad car truck. The interface assembly has a bearing adapter and a mating pedestal seat. The bearing adapter has first and second ends that form an interlocking insertion between a pair of pedestal jaws of a railroad car sideframe. The bearing adapter has a first rocking member. The pedestal seat has a second rocking member. The first and second rocking members are matingly engageable to permit lateral and longitudinal rocking between them. There is a resilient member mounted between the bearing adapter and pedestal seat. The resilient member has a portion formed that engages the first end of the bearing adapter. The resilient member has an accommodation formed to permit the mating engagement of the first and second rocking members.

In a feature of that aspect of the invention, the resilient member has the first and second ends formed for interposition between the bearing adapter and the pedestal jaws of the sideframe. In another feature, the resilient member has the form of a Pennsy Pad with a relief formed to define the accommodation. In a further feature, the resilient member is an elastomeric member. In yet another feature, the elastomeric member is made of rubber material. In still another feature, the elastomeric member is made of a polyurethane material. In yet a further feature, the accommodation is formed through the elastomeric material and the first rocking member protrudes at least part way through the accommodation to meet the second rocking member. In an additional feature, the bearing adapter is a bearing adapter assembly which includes a bearing adapter body surmounted by the first rocker member. In another additional feature, the first rocker member is formed of a different material from the bearing body. In a further additional feature, the first rocker member is an insert.

In yet another additional feature, the first rocker member has a footprint with a profile conforming to the accommodation. In still another additional feature, the profile and the accommodation are mutually indexed to discourage mis-orientation of the first rocker member relative to the bearing adapter. In yet a further additional feature, the body and the first rocker member are keyed to discourage mis-orientation between them. In a further feature, the accommodation is formed through the resilient member and the second rocking member protrudes at least part way through said accommodation to meet the first rocking member. In another further feature, the pedestal seat includes an insert with the second rocking member formed in it. In yet another further feature, the second rocker member has a footprint with a profile conforming to the accommodation.

In still a further feature, the portion of the resilient member that is formed to engage the first end of the bearing adapter, when installed, includes elements that are interposed between the first end of the bearing adapter and the pedestal jaw to inhibit lateral and longitudinal movement of the bearing adapter relative to the jaw.

In another aspect of the invention the ends of the bearing adapter includes an end wall bracketed by a pair of corner abutments. The end wall and corner abutments define a channel to permit the sliding insertion of the bearing adapter between the pedestal jaw of the sideframe. The portion of the resilient member that is formed to engage the first end of the bearing adapter is the first end portion. The resilient member has a second end portion that is formed to engage the second end of the bearing adapter. The resilient member has a middle portion that extends between the first and second end portions. The accommodation is formed in the middle portion of the resilient member. In another feature, the resilient member has the form of a Pennsy Pad with a central opening formed to define the accommodation.

In another aspect of the invention, a wheelset-to-sideframe interface assembly for a rail road car truck has an interface assembly that has a bearing adapter, a pedestal seat and a resilient member. The bearing adapter has a first end and a second end that each have a end wall bracketed by a pair of corner abutments. The end wall and corner abutments co-operate to define a channel that permits insertion of the bearing adapter between a pair of thrust lugs of a sidewall pedestal. The bearing adapter has a first rocking member. The pedestal seat has a second rocking member to make engagement with the first rocking member. The first and second rocking members, when engaged, are operable to rock longitudinally relative to the sideframe to permit the rail road car truck to steer. The resilient member has a first end portion that is engageable with the first end of the bearing adapter for interposition between the first end of the bearing adapter and the first pedestal jaw thrust lug. The resilient member has a second end portion that is engageable with the second end of the bearing adapter for interposition between the second end of the bearing adapter and the second pedestal jaw thrust lug. The resilient member has a medial portion lying between the first and second end portions. The medial portion is formed to accommodate mating rocking engagement of the first and second rocking members.

In another feature, there is a resilient pad that is used with the bearing adapter which has a rocker member for mating and the rocking engagement with the rocker member of the pedestal seat. The resilient pad has a first portion for engaging the first end of the bearing adapter, a second portion for engaging a second end of the bearing adapter and a medial portion between the first and second end portions. The medial portion is formed to accommodate mating engagement of the rocker members.

In a feature of the aspect of the invention there is a wheelset-to-sideframe assembly kit that has a pedestal seat for mounting in the roof of a rail road car truck sideframe pedestal. There is a bearing adapter for mounting to a bearing of a wheelset of a rail road car truck and a resilient member for mounting to the bearing adapter. The bearing adapter has a first rocker element for engaging the seat in rocking relationship. The bearing adapter has a first end and a second end, both ends having an endwall and a pair of abutments bracketing the end wall to define a channel, that permits sliding insertion of the bearing adapter between a pair of sideframe pedestal jaw thrust lugs. The resilient member has a first portion that conforms to the first end of the bearing adapter for interpositioning between the bearing adapter and a thrust lug. The resilient member has a second portion connected to the first portion that, as installed, at least partially overlies the bearing adapter.

In another feature, the wheelset-to-sideframe assembly kit has a second portion of the resilient member with a margin that has a profile facing toward the first rocker element. The first rocker element is shaped to nest adjacent to the profile. In a further feature, wheelset-to-sideframe assembly kit has a bearing adapter that includes a body and the first rocker element is separable from that body. In still another feature, the wheelset-to-sideframe assembly kit has a second portion of the resilient member with a margin that has a profile facing toward the first rocker element which is shaped to nest adjacent the profile. In yet still another feature, the wheelset-to-sideframe assembly kit has a profile and first rocker element shaped to discourage mis-orientation of the first rocker element when installed. In another feature, the wheelset-to-sideframe assembly kit has a first rocker element with a body that is mutually keyed to facilitate the location of the first rocker element when installed. In still another feature, the wheelset-to-sideframe assembly kit has a first rocker element and body that are mutually keyed to discourage mis-orientation of the rocker element when installed. In yet still another feature, the wheelset-to-sideframe assembly kit has a first rocker element and a body with mutual engagement features. The features are mutually keyed to discourage mis-orientation of the rocker element when installed.

In a further feature, the kit has a second resilient member that conforms to the second end of the bearing adapter. In another feature, the wheelset-to-sideframe assembly kit includes a pedestal seat engagement fitting for locating the resilient feature relative to the pedestal seat on the assembly. In yet still another feature, the resilient member includes a second end portion that conforms to the second end of the bearing adapter.

In an additional feature, there is a bearing adapter for transmitting load between the wheelset bearing and a sideframe pedestal of a railroad car truck. It has at least a first and second land for engaging the bearing and a relief formed between the first and second land. The relief extends predominantly axially relative to the bearing. In another additional feature, the lands are arranged in an array that conforms to the bearing and the relief is formed at the apex of the array. In still another additional feature, the bearing adapter includes a second relief that extends circumferentially relative to the bearing. In yet still another additional feature, the axially extending relief and the circumferentially extending relief extends along a second axis of symmetry of the bearing adapter.

In a further feature, the radially extending relief extends along a first axis of symmetry of the bearing adapter and the circumferentially extending relief extends along a second axis of symmetry of the bearing adapter. In still a further feature, the bearing adapter has lands that are formed on a circumferential arc. In yet still another feature, the bearing adapter has a rocker element that has an upwardly facing rocker surface. In yet still a further feature, the bearing adapter has a body with a rocker element that is separable from the body.

In another aspect of the invention, there is a bearing adapter for installation in a rail road car truck sideframe pedestal. The bearing adapter has an upper portion engageable with a pedestal seat, and a lower portion engageable with a bearing casing. The lower portion has an apex. The lower portion includes a first land for engaging a first portion of the bearing casing, and a second land region for engaging a second portion of the bearing casing. The first land lies to one side of the apex. The second land lies to the other side of the apex. At least one relief located between the first and second lands.

In an additional feature, the relief has a major dimension oriented to extend along the apex in a direction that runs axially relative to the bearing when installed. In another feature, the relief is located at the apex. In another feature there are at least two the reliefs, the two reliefs lying to either side of a bridging member, the bridging member running between the first and second lands.

In another aspect of the invention there is a kit for retro-fitting a railroad car truck having elastomeric members mounted over bearing adapters. The kit includes a mating bearing adapter and a pedestal seat pair. The bearing adapter and the pedestal seat have co-operable bi-directional rocker elements. The seat has a depth of section of greater than ½ inches.

These and other aspects and features of the invention may be understood with reference to the detailed descriptions of the invention and the accompanying illustrations as set forth below.

BRIEF DESCRIPTION OF THE FIGURES

The principles of the invention may better be understood with reference to the accompanying figures provided by way of illustration of an exemplary embodiment, or embodiments, incorporating principles and aspects of the present invention, and in which.

DETAILED DESCRIPTION OF THE INVENTION

Figures 1A, 1B, 1C:
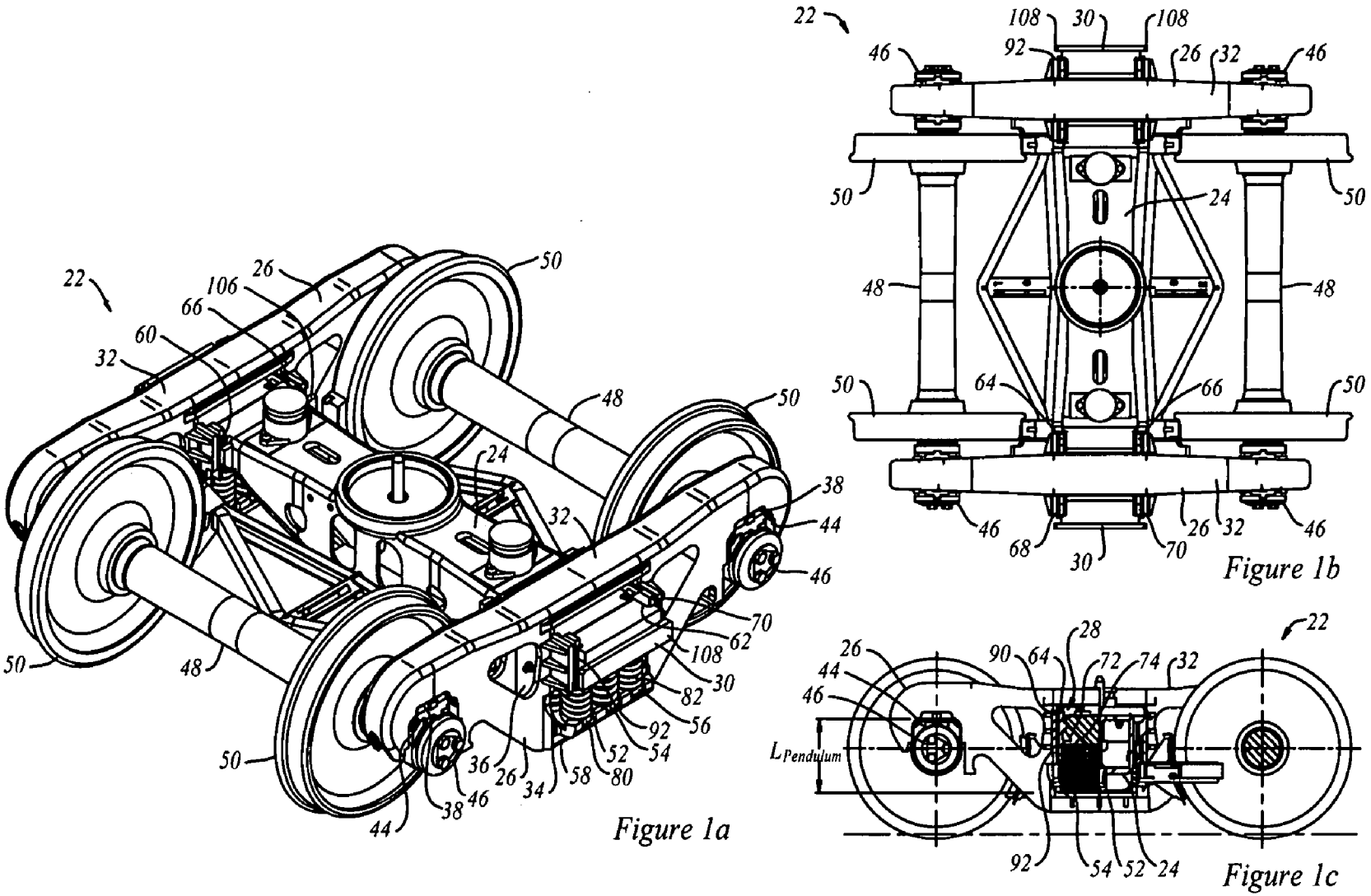
FIG. 1*a* shows an isometric view of an example of an embodiment of a railroad car truck according to an aspect of the present invention.
FIG. 1*b* shows a top view of the railroad car truck of FIG. 1*a;*
FIG. 1*c* shows a side view of the railroad car truck of FIG. 1*a;*

The description that follows, and the embodiments described therein, are provided by way of illustration of an example, or examples, of particular embodiments of the principles of the present invention. These examples are provided for the purposes of explanation, and not of limitation, of those principles and of the invention. In the description, like parts are marked throughout the specification and the drawings with the same respective reference numerals. The drawings are not necessarily to scale and in some instances proportions may have been exaggerated in order more clearly to depict certain features of the invention.

In terms of general orientation and directional nomenclature, for each of the rail road car trucks described herein, the longitudinal direction is defined as being coincident with the rolling direction of the rail road car, or rail road car unit, when located on tangent (that is, straight) track. In the case of a rail road car having a center sill, the longitudinal direction is parallel to the center sill, and parallel to the side sills, if any. Unless otherwise noted, vertical, or upward and downward, are terms that use top of rail, TOR, as a datum. The term lateral, or laterally outboard, refers to a distance or orientation relative to the longitudinal centerline of the railroad car, or car unit. The term "longitudinally inboard", or "longitudinally outboard" is a distance taken relative to a mid-span lateral section of the car, or car unit. Pitching motion is angular motion of a railcar unit about a horizontal axis perpendicular to the longitudinal direction. Yawing is angular motion about a vertical axis. Roll is angular motion about the longitudinal axis.

This description relates to rail car trucks and truck components. Several AAR standard truck sizes are listed at page 711 in the 1997 *Car & Locomotive Cyclopedia*. As indicated, for a single unit rail car having two trucks, a "40 Ton" truck rating corresponds to a maximum gross car weight on rail (GWR) of 142,000 lbs. Similarly, "50 Ton" corresponds to 177,000 lbs., "70 Ton" corresponds to 220,000 lbs., "100 Ton" corresponds to 263,000 lbs., and "125 Ton" corresponds to 315,000 lbs. In each case the load limit per truck is then half the maximum gross car weight on rail. Two other types of truck are the "110 Ton" truck for railcars having a 286,000 lbs. GWR and the "70 Ton Special" low profile truck sometimes used for auto rack cars. Given that the rail road car trucks described herein tend to have both longitudinal and transverse axes of symmetry, a description of one half of an assembly may generally also be intended to describe the other half as well, allowing for differences between right hand and left hand parts.

This application refers to friction dampers for rail road car trucks, and multiple friction damper systems. There are several types of damper arrangements, some being shown at pp. 715–716 of the 1997 *Car and Locomotive Cyclopedia*, those pages being incorporated herein by reference. Double damper arrangements are shown and described U.S. Patent Application Publication No. US 2003/0041772 A1, Mar. 6, 2003, entitled "Rail Road Freight Car With Damped Suspension", and also incorporated herein by reference. Each of the arrangements of dampers shown at pp. 715 to 716 of the 1997 *Car and Locomotive Cyclopedia* can be modified to employ a four cornered, double damper arrangement of inner and outer dampers in conformity with the principles of aspects of the present invention.

Damper wedges are discussed herein. In terms of general nomenclature, the wedges tend to be mounted within an angled "bolster pocket" formed in an end of the truck bolster. In cross-section, each wedge may then have a generally triangular shape, one side of the triangle being, or having, a bearing face, a second side which might be termed the bottom, or base, forming a spring seat, and the third side being a sloped side or hypotenuse between the other two sides. The first side may tend to have a substantially planar bearing face for vertical sliding engagement against an opposed bearing face of one of the sideframe columns. The second face may not be a face, as such, but rather may have the form of a socket for receiving the upper end of one of the springs of a spring group. Although the third face, or hypotenuse, may appear to be generally planar, it may tend to have a slight crown, having a radius of curvature of perhaps 60". The crown may extend along the slope and may also extend across the slope. The end faces of the wedges may be generally flat, and may have a coating, surface treatment, shim, or low friction pad to give a smooth sliding engagement with the sides of the bolster pocket, or with the adjacent side of another independently slidable damper wedge, as may be.

During railcar operation, the sideframe may tend to rotate, or pivot, through a small range of angular deflection about the end of the truck bolster to yield wheel load equalisation. The slight crown on the slope face of the damper may tend to accommodate this pivoting motion by allowing the damper to rock somewhat relative to the generally inclined face of the bolster pocket while the planar bearing face remains in planar contact with the wear plate of the sideframe column. Although the slope face may have a slight crown, for the purposes of this description it will be described as the slope face or as the hypotenuse, and will be considered to be a substantially flat face as a general approximation.

In the terminology herein, wedges have a primary angle $\alpha$ being the included angle between (a) the sloped damper pocket face mounted to the truck bolster, and (b) the side frame column face, as seen looking from the end of the bolster toward the truck center. In some embodiments, a secondary angle may be defined in the plane of angle $\alpha$, namely a plane perpendicular to the vertical longitudinal plane of the (undeflected) side frame, tilted from the vertical at the primary angle. That is, this plane is parallel to the (undeflected) long axis of the truck bolster, and taken as if sighting along the back side (hypotenuse) of the damper. The secondary angle $\beta$ is defined as the lateral rake angle seen when looking at the damper parallel to the plane of angle $\alpha$. As the suspension works in response to track perturbations, the wedge forces acting on the secondary angle $\beta$ may tend to urge the damper either inboard or outboard according to the angle chosen.

General Description of Truck Features

FIGS. 1*a* to 1*d* show a truck 22 that is symmetrical about both the longitudinal and the transverse. or lateral, centreline axes. In each case, where reference is made to a sideframe, it will be understood that the truck has first and second sideframes, first and second spring groups, and so on. Truck 22 has a truck bolster 24 and sideframes 26. Each sideframe 26 has a generally rectangular window 28 that accommodates one of the ends 30 of the bolster 24. The upper boundary of window 28 is defined by the sideframe arch, or compression member identified as top chord member 32, and the bottom of window 28 is defined by a tension member identified as bottom chord 34. The fore and aft vertical sides of window 28 are defined by sideframe columns 36. The ends of the tension member sweep up to meet the compression member. At each of the swept-up ends of sideframe 26 there are sideframe pedestal fittings, or pedestal seats 38. Each fitting 38 accommodates an upper fitting, which may be a rocker or a seat, as described and discussed below. This upper fitting, whichever it may be, is indicated generically as 40. Fitting 40 engages a mating fitting 42 of the upper surface of a bearing adapter 44. Bearing adapter 44 engages a bearing 46 mounted on one of the ends of one of the axles 48 of the truck adjacent one of the wheels 50. A fitting 40 is located in each of the fore and aft pedestal fittings 38, the fittings 40 being longitudinally aligned so the sideframe can swing sideways relative to the truck's rolling direction.

The relationship of the mating fittings 40 and 42 is described at greater length below. The relationship of these fittings determines part of the overall relationship between an end of one of the axles of one of the wheelsets and the sideframe pedestal. That is, in determining the overall response, the degrees of freedom of the mounting of the axle end in the sideframe pedestal involve a dynamic interface across an assembly of parts, such as may be termed a wheelset to sideframe interface assembly, that may include the bearing, the bearing adapter, an elastomeric pad, if used, a rocker if used, and the pedestal seat mounted in the roof of the sideframe pedestal. Several different embodiments of this wheelset to sideframe interface assembly are described below. To the extent that bearing 46 has a single degree of freedom, namely rotation about the wheelshaft axis, analysis of the assembly can be focused on the bearing to pedestal seat interface assembly, or on the bearing adapter to pedestal seat interface assembly. For the purposes of this description, items 40 and 42 are intended generically to represent the combination of features of a bearing adapter and pedestal seat assembly defining the interface between the roof of the sideframe pedestal and the bearing adapter, and the six degrees of freedom of motion at that interface, namely vertical, longitudinal and transverse translation (i.e., translation in the z, x, and y directions) and pitching, rolling, and yawing (i.e., rotational motion about the y, x, and z axes respectively) in response to dynamic inputs.

The bottom chord or tension member of sideframe 26 may have a basket plate, or lower spring seat 52 rigidly mounted thereto. Although trucks 22 may be free of unsprung lateral cross-bracing, whether in the nature of a transom or lateral rods, in the event that truck 22 is taken to represent a "swing motion" truck with a transom or other cross bracing, the lower rocker platform of spring seat 52 may be mounted on a rocker, to permit lateral rocking relative to sideframe 26. Spring seat 52 may have retainers for engaging the springs 54 of a spring set, or spring group, 56, whether internal bosses, or a peripheral lip for discouraging the escape of the bottom ends of the springs. The spring group, or spring set 56, is captured between the distal end 30 of bolster 24 and spring seat 52, being placed under compression by the weight of the rail car body and lading that bears upon bolster 24 from above.

Bolster 24 has double, inboard and outboard, bolster pockets 60, 62 on each face of the bolster at the outboard end (i.e., for a total of 8 bolster pockets per bolster, 4 at each end). Bolster pockets 60, 62 accommodate fore and aft pairs of first and second, laterally inboard and laterally outboard friction damper wedges 64, 66 and 68, 70, respectively. Each bolster pocket 60, 62 has an inclined face, or damper seat 72, that mates with a similarly inclined hypotenuse face 74 of the damper wedge, 64, 66, 68 and 70. Wedges 64, 66 each sit over a first, inboard corner spring 76, 78, and wedges 68, 70 each sit over a second, outboard corner spring 80, 82. Angled faces 74 of wedges 64, 66 and 68, 70 ride against the angled faces of respective seats 72.

A middle end spring 96 bears on the underside of a land 98 located intermediate bolster pockets 60 and 62. The top ends of the central row of springs, 100, seat under the main central portion 102 of the end of bolster 24. In this four corner arrangement, each damper is individually sprung by one or another of the springs in the spring group. The static compression of the springs under the weight of the car body and lading tends to act as a spring loading to bias the damper to act along the slope of the bolster pocket to force the friction surface against the sideframe. Friction damping is provided when the vertical sliding faces 90 of the friction damper wedges 64, 66 and 68, 70 ride up and down on friction wear plates 92 mounted to the inwardly facing surfaces of sideframe columns 36. In this way the kinetic energy of the motion is, in some measure, converted through friction to heat. This friction may tend to damp out the motion of the bolster relative to the sideframes. When a lateral perturbation is passed to wheels 50 by the rails, rigid axles 48 may tend to cause both sideframes 26 to deflect in the same direction. The reaction of sideframes 26 is to swing, like pendula, on the upper rockers. The weight of the pendulum and the reactive force arising from the twisting of the springs may then tend to urge the sideframes back to their initial position. The tendency to oscillate harmonically due to track perturbations may tend to be damped out by the friction of the dampers on the wear plates 92.

Figure 1E:
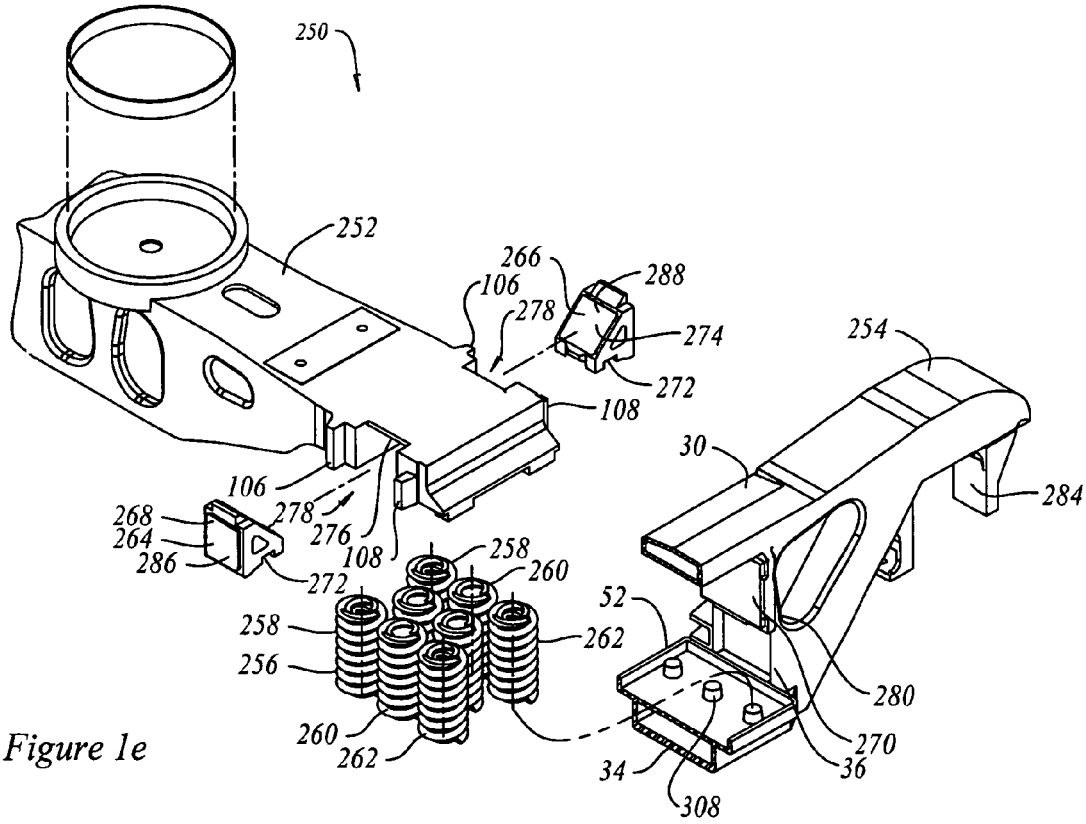
FIG. 1*e* is an exploded, sectioned view of an example of an alternate three piece truck to that of FIG. 1*a*, having dampers mounted along the spring group centerlines.
Figure 1D:
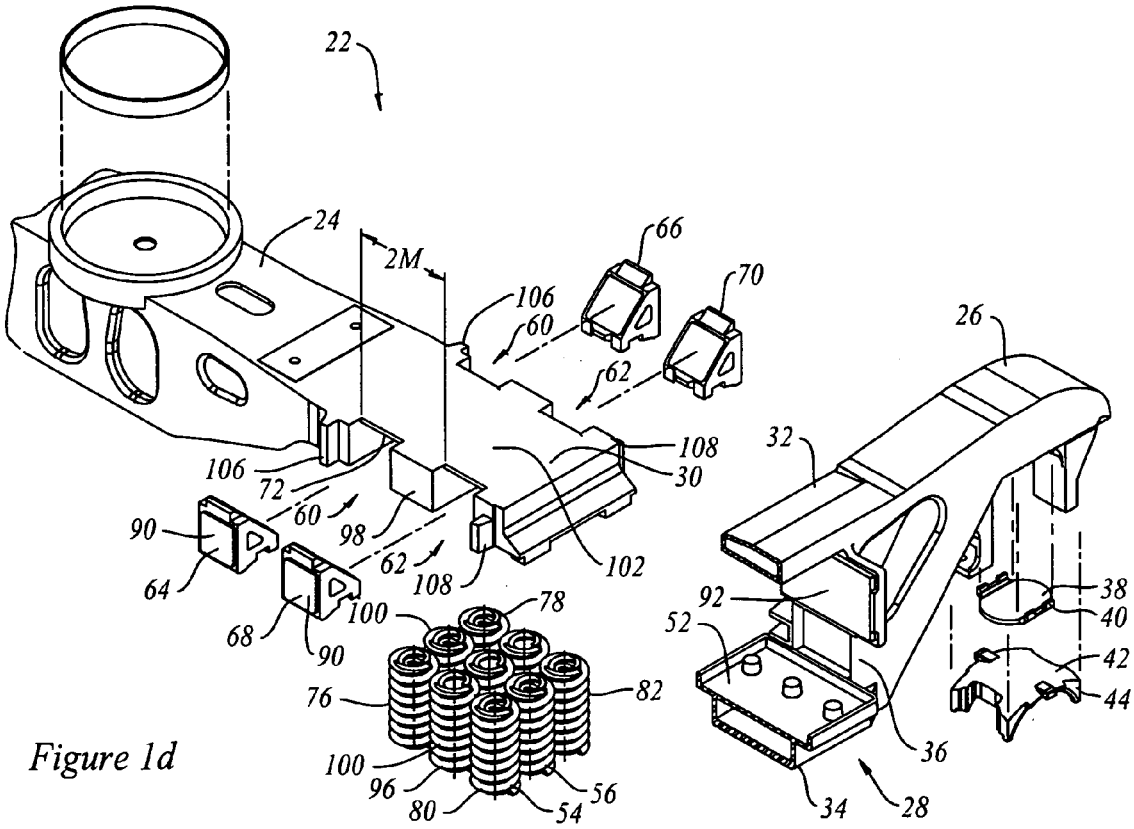
FIG. 1*d* shows an exploded view of a portion of a truck similar to that of FIG. 1*a;*

As compared to a bolster with single dampers, such as may be mounted on the sideframe centerline as shown in FIG. 1*e*, for example, the use of doubled dampers such as spaced apart pairs of dampers 64, 68 may tend to give a larger moment arm, as indicated by dimension "2M" in FIG. 1*d*, for resisting parallelogram deformation of truck 22 more generally. Use of doubled dampers may yield a greater restorative "squaring" force to return the truck to a square orientation than for a single damper alone with the restorative bias, namely the squaring force, increasing with increasing deflection. That is, in parallelogram deformation, or lozenging, the differential compression of one diagonal pair of springs (e.g., inboard spring 76 and outboard spring 82 may be more pronouncedly compressed) relative to the other diagonal pair of springs (e.g., inboard spring 78 and outboard spring 80 may be less pronouncedly compressed than springs 76 and 82) tends to yield a restorative moment couple acting on the sideframe wear plates. This moment couple tends to rotate the sideframe in a direction to square the truck, (that is, in a position in which the bolster is perpendicular, or "square", to the sideframes). As such, the truck is able to flex, and when it flexes the dampers co-operate in acting as biased members working between the bolster and the side frames to resist parallelogram, or lozenging, deformation of the side frame relative to the truck bolster and to urge the truck back to the non-deflected position.

The bearing plate, namely wear plate 92 (FIG. 1*a*) is significantly wider than the through thickness of the sideframes more generally, as measured, for example, at the pedestals, and may tend to be wider than has been conventionally common. This additional width corresponds to the additional overall damper span width measured fully across the damper pairs, plus lateral travel as noted above, typically allowing 1½ (+/−) inches of lateral travel of the bolster relative to the sideframe to either side of the undeflected central position. That is, rather than having the width of one coil, plus allowance for travel, plate 92 may have the width of three coils, plus allowance to accommodate 1½ (+/−) inches of travel to either side for a total, double amplitude travel of 3" (+/−). Bolster 24 has inboard and outboard gibs 106, 108 respectively, that bound the lateral motion of bolster 24 relative to sideframe columns 36. This motion allowance may be in the range of +/−1⅛ to 1¾ in., and may be in the range of 1³⁄₁₆ to 1⁹⁄₁₆ in., and can be set, for example, at 1½ in. or 1¼ in. of lateral travel to either side of a neutral, or centered, position when the sideframe is undeflected.

The lower ends of the springs of the entire spring group, identified generally as 58, seat in lower spring seat 52. Lower spring seat 52 may be laid out as a tray with an upturned rectangular peripheral lip. Although truck 22 employs a spring group in a 3×3 arrangement, this is intended to be generic, and to represent a range of variations. They may represent 3×5, 2×4, 3:2:3 or 2:3:2 arrangement, or some other, and may include a hydraulic snubber, or such other arrangement of springs may be appropriate for the given service for the railcar for which the truck is intended.

Rocker Description

The rocking interface surface of the bearing adapter may have a crown, or a concave curvature, by which a rolling contact on the rocker permits lateral swinging of the side frame. The present inventors have also noted, as shown and described herein, that the bearing adapter to pedestal seat interface might also have a fore-and-aft curvature, whether a crown or a depression, and that, if used as described by the inventors hereinbelow, this crown or depression might tend to present a more or less linear resistance to deflection in the longitudinal direction, much as a spring or elastomeric pad might do. It may be advantageous for the rockers to be self centering.

For surfaces in rolling contact on a compound curved surface (i.e., having curvatures in two directions) as shown and described by the present inventors hereinbelow, the vertical stiffness may be approximated as infinite (i.e. very large as compared to other stiffnesses); the longitudinal stiffness in translation at the point of contact can also be taken as infinite, the assumption being that the surfaces do not slip; the lateral stiffness in translation at the point of contact can be taken as infinite, again, provided the surfaces do not slip. The rotational stiffness about the vertical axis may be taken as zero or approximately zero. By contrast, the angular stiffnesses about the longitudinal and transverse axes are non-trivial. The lateral angular stiffnesses may tend to determine the equivalent pendulum stiffnesses for the sideframe more generally.

The stiffness of a pendulum is directly proportional to the weight on the pendulum. Similarly, the drag on a rail car wheel, and the wear to the underlying track structure, is a function of the weight borne by the wheel. For this reason, the desirability of self steering may be greatest for a fully laden car, and a pendulum may tend to maintain a general proportionality between the weight borne by the wheel and the stiffness of the self-steering mechanism as the lading increases.

Truck performance may vary with the friction characteristics of the bearing surfaces of the dampers used in the truck suspension. Conventional dampers have tended to employ dampers in which the dynamic and static coefficients of friction may have been significantly different, yielding a stick-slip phenomenon that may not have been entirely advantageous. In the view of the present inventors it may be advantageous to combine the feature of a self-steering capability with dampers that have a reduced tendency to stick-slip operation.

Furthermore, while bearing adapters may be formed of relatively low cost materials, such as cast iron, in some embodiments an insert of a different material may be used for the rocker. Further it may be advantageous to employ a member that may tend to center the rocker on installation, and that may tend to perform an auxiliary centering function to tend to urge the rocker to operate from a desired minimum energy position.

An embodiment of bearing adapter and pedestal seat assembly is illustrated in FIGS. 2*a*–2*g*. Bearing adapter 44 has a lower portion 112 that is formed to accommodate, and to seat upon, bearing 46, that is itself mounted on the end of a shaft, namely an end of axle 48. Bearing adapter 44 has an upper portion 114 that has a centrally located, upwardly protruding fitting in the nature of a male bearing adapter interface portion 116. A mating fitting, in the nature of a female rocker seat interface portion 118 is rigidly mounted within the roof 120 of the sideframe pedestal. To that end, laterally extending lugs 122 are mounted centrally with respect to pedestal roof 120. The upper fitting 40, whichever type it may be, has a body that may be in the form of a plate 126 having, along its longitudinally extending, lateral margins a set of upwardly extending lugs or ears, or tangs 124 separated by a notch, that bracket, and tightly engage lugs 122, thereby locating upper fitting 40 in position, with the back of the plate 126 of fitting 40 abutting the flat, load transfer face of roof 120. Upper fitting 40 may be a pedestal seat fitting with a hollowed out female bearing surface, namely portion 118.

Figure 2C:
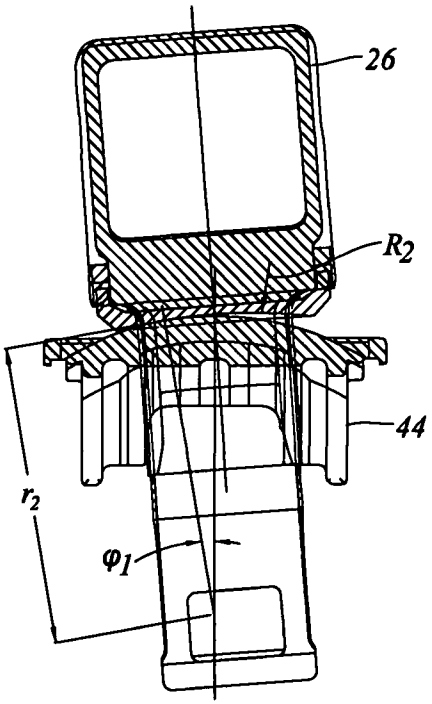
FIG. 2*c* shows the cross-section of FIG. 2*b* in a laterally deflected condition.
Figure 2B:
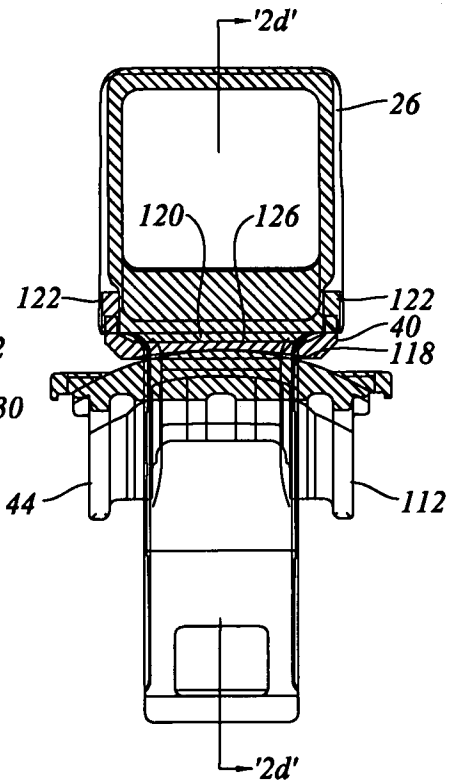
FIG. 2*b* shows a lateral cross-section through the sideframe pedestal to bearing adapter interface of FIG. 2*a*, taken at the wheelset axle centerline.
Figure 2A:
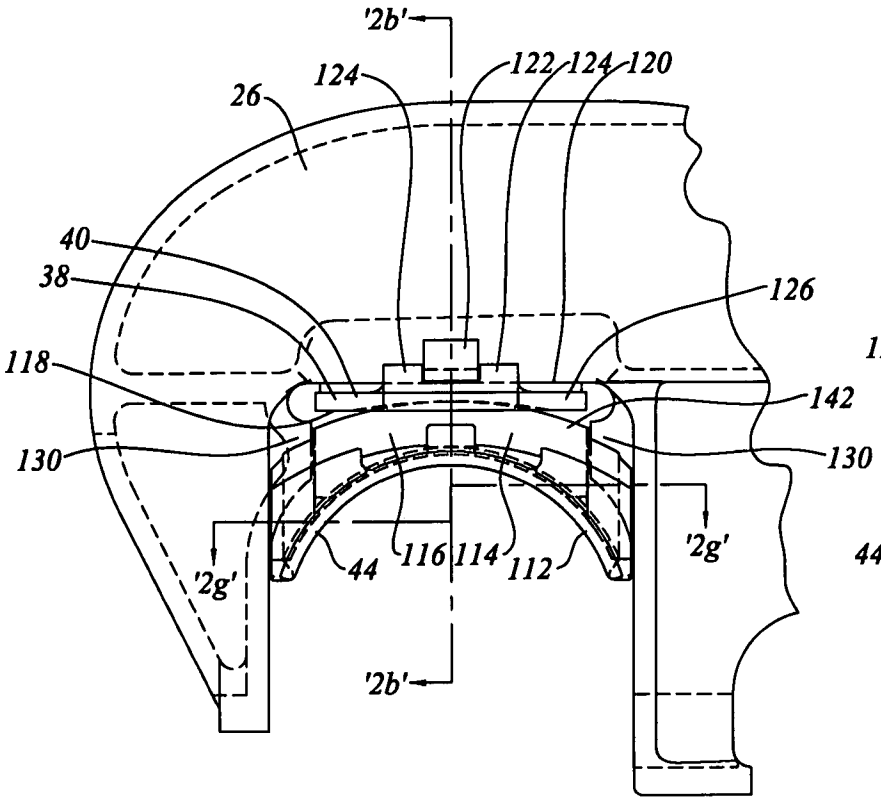
FIG. 2*a* is an enlarged detail of a side view of a truck such as the truck of FIG. 1*a*, 1*b*, 1*c* or 1*e* taken at the sideframe pedestal to bearing adapter interface.
Figure 2F:
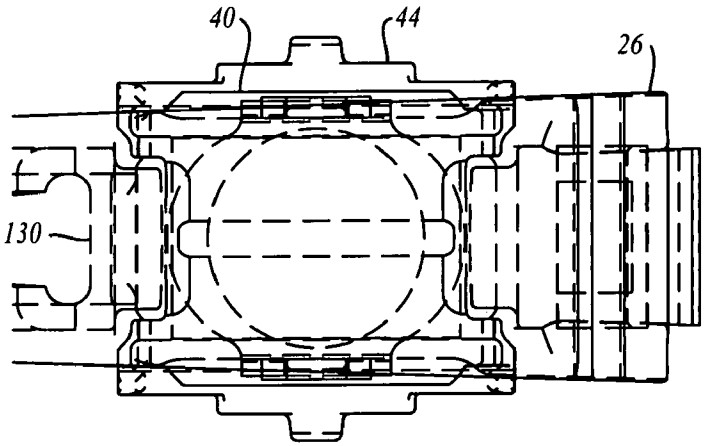
FIG. 2*f* shows a top view of the detail of FIG. 2*a;*
Figure 2G:
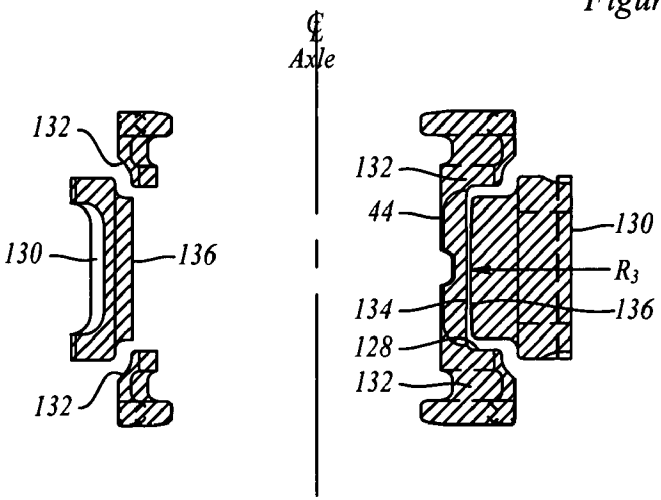
FIG. 2*g* shows a staggered section of the bearing adapter of FIG. 2*a*, on section lines '2*g*—2*g*' of FIG. 2*a;*

As shown in FIG. 2*g*, when the sideframes are lowered over the wheel sets, the end reliefs, or channels 128 lying between the bearing adapter corner abutments 132 seat between the respective side frame pedestal jaws 130. With the sideframes in place, bearing adapter 44 is thus captured in position with the male and female portions (116 and 118) of the adapter interface in mating engagement.

Figure 2D:
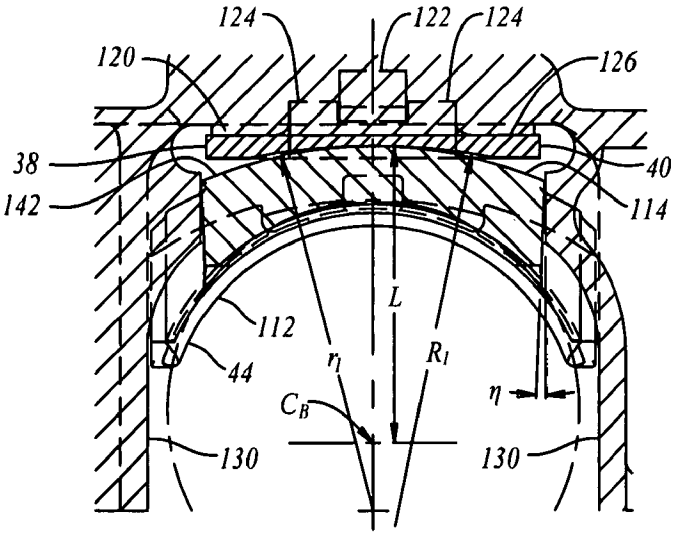
FIG. 2*d* is a longitudinal section of the pedestal seat to bearing adapter interface of FIG. 2*a*, on the longitudinal plane of symmetry of the bearing adapter.
Figure 2E:
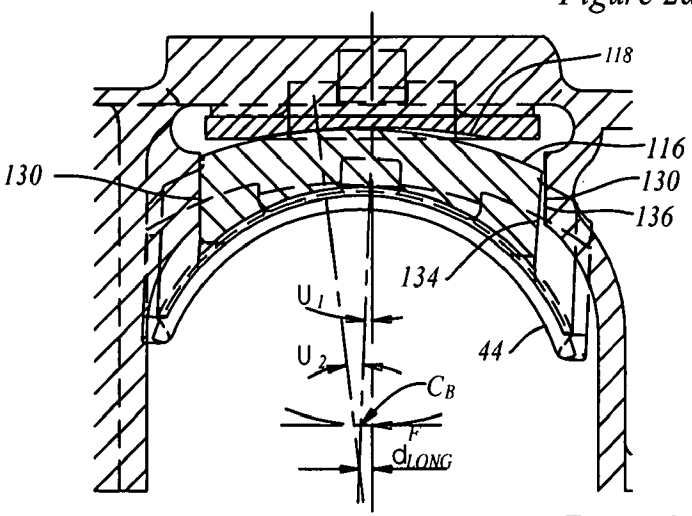
FIG. 2*e* shows the longitudinal section of FIG. 2*d* as longitudinally deflected.

Male portion 116 (FIG. 2*d*) has been formed to have a generally upwardly facing surface 142 that has both a first curvature $r_1$ to permit rocking in the longitudinal direction, and a second curvature $r_2$ (FIG. 2*c*) to permit rocking (i.e., swing motion of the sideframe) in the transverse direction. Similarly, in the general case, female portion 118 has a surface having a first radius of curvature $R_1$ in the longitudinal direction, and a second radius of curvature $R_2$ in the transverse direction. The engagement of $r_1$ with $R_1$ may tend to permit a rocking motion in the longitudinal direction, with resistance to rocking displacement being proportional to the weight on the wheel. That is to say, the resistance to angular deflection is proportional to weight rather than being a fixed spring constant. This may tend to yield passive self-steering in both the light car and fully laden conditions. This relationship is shown in FIGS. 2*d* and 2*e*. FIG. 2*d* shows the centered, or at rest, non-deflected position of the longitudinal rocking elements. FIG. 2*e* shows the rocking elements at their condition of maximum longitudinal deflection. FIG. 2*d* represents a local, minimum potential energy condition for the system. FIG. 2*e* represents a system in which the potential energy has been increased by virtue of the work done by force F acting longitudinally in the horizontal plane through the center of the axle and bearing, $C_B$., which will tend to yield an incremental increase in the height of the pedestal. Put differently, as the axle is urged to deflect by the force, the rocking motion may tend to raise the car, and thereby to increase its potential energy.

The limit of travel in the longitudinal direction is reached when the end face 134 of bearing adapter 44 extending between corner abutments 132, contacts one or another of travel limiting abutment faces 136 of the thrust blocks of jaws 130. In general, the deflection may be measured either by the angular displacement of the axle centreline, $\theta_1$, or by the angular displacement of the rocker contact point on radius $r_1$, shown as $\theta_2$. End face 134 of bearing adapter 44 is planar, and is relieved, or inclined, at an angle $\eta$ from the vertical. As shown in FIG. 2*g*, abutment face 136 may have a round, cylindrical arc, with the major axis of the cylinder extending vertically. A typical maximum radius $R_3$ for this surface is 34 inches. When bearing adapter 44 is fully deflected through angle $\eta$, end face 134 is intended to meet abutment face 136 in line contact. When this occurs, further longitudinal rocking motion of the male surface (of portion 116 ) against the female surface (of portion 118 ) is inhibited. Thus jaws 130 constrain the arcuate deflection of bearing adapter 44 to a limited range. A typical range for $\eta$ might be about 3 degrees of arc. A typical maximum value of $\delta_{long}$ may be about +/−3/16" to either side of the vertical, at rest, center line.

Similarly, as shown in FIGS. 2*b* and 2*c*, in the transverse direction, the engagement of $r_2$ with $R_2$ may tend to permit lateral rocking motion, as may be in the manner of a swing motion truck. FIG. 2*b* shows a centered, at rest, minimum potential energy position of the lateral rocking system. FIG. 2*c* shows the same system in a laterally deflected condition. In this instance $\delta_2$ is roughly $(L_{pendulum}-r_2)\text{Sin}\ \phi$, where, for small angles Sin$\phi$ is approximately equal to $\phi$. $L_{pendulum}$ may be taken as the at rest difference in height between the center of the bottom spring seat, 52, and the contact interface between the male and female portions 116 and 118.

When a lateral force is applied at the centerplate of the truck bolster, a reaction force is, ultimately, provided at the meeting of the wheels with the rail. The lateral force is transmitted from the bolster into the main spring groups, and then into a lateral force in the spring seats to deflect the bottom of the pendulum. The reaction is carried to the bearing adapter, and hence into the top of the pendulum. The pendulum will then deflect until the weight on the pendulum, multiplied by the moment arm of the deflected pendulum is sufficient to balance the moment of the lateral moment couple acting on the pendulum.

This bearing adapter to pedestal seat interface assembly is biased by gravity acting on the pendulum toward a central, or "at rest" position, where there is a local minimum of the potential energy in the system. The fully deflected position shown in FIG. 2*c* may correspond to a deflection from vertical of the order of less than 10 degrees (and preferably less than 5 degrees) to either side of center, the actual maximum being determined by the spacing of gibbs 106 and 108 relative to plate 104. Although in general $R_1$ and $R_2$ may differ, so the female surface is an outside section of a torus, it may be desirable, for $R_1$ and $R_2$ to be the same, i.e., so that the bearing surface of the female fitting is formed as a portion of a spherical surface, having neither a major nor a minor axis, but merely being formed on a spherical radius. $R_1$ and $R_2$ give a self-centering tendency. That tendency may be quite gentle. Further, and again in the general condition, the smallest of $R_1$ and $R_2$ may be equal to or larger than the largest of $r_1$ and $r_2$. If so, then the contact point may have little, if any, ability to transmit torsion acting about an axis normal to the rocking surfaces at the point of contact, so the lateral and longitudinal rocking motions may tend to be torsionally de-coupled, and hence it may be said that relative to this degree of freedom (rotation about the vertical, or substantially vertical axis normal to the rocking contact interface surfaces) the interface is torsionally compliant (that is, the resistance to torsional deflection about the axis through the surfaces at the point of contact may tend to be much smaller than, for example, resistance to lateral angular deflection). For small angular deflections, the torsional stiffness about the normal axis at the contact point, this condition may sometimes be satisfied even where the smaller of the female radii is less than the largest male radius. Although it is possible for $r_1$ and $r_2$ to be the same, such that the crowned surface of the bearing adapter (or the pedestal seat, if the relationship is inverted) is a portion of a spherical surface, in the general case $r_1$ and $r_2$ may be different, with $r_1$ perhaps tending to be larger, possibly significantly larger, than $r_2$. In general, whether or not $r_1$ and $r_2$ are equal, $R_1$ and $R_2$ may be the same or different. Where $r_1$ and $r_2$ are different, the male fitting engagement surface may be a section of the surface of a torus. It may also be noted that, provided the system may tend to return to a local minimum energy state (i.e., that is self-restorative in normal operation) in the limit either or both of $R_1$ and $R_2$ may be infinitely large such that either a cylindrical section is formed or, when both are infinitely large, a planar surface may be formed. In the further alternative, it may be that $r_1=r_2$, and $R_1=R_2$. In one embodiment $r_1$ may be the same as $r_2$, and may be about 40 inches (+/−5") and $R_1$ may the same as $R_2$, and both may be infinite such that the female surface is planar.

The rocker surfaces herein may tend to be formed of a relatively hard material, which may be a metal or metal alloy material, such as a steel. Such materials may have elastic deformation at the location of rocking contact in a manner analogous to that of journal or ball bearings. Nonetheless, the rockers may be taken as approximating the ideal rolling point or line contact (as may be) of infinitely stiff members. This is to be distinguished from materials in which deflection of an elastomeric element be it a pad, or block, of whatever shape, may be intended to determine a characteristic of the dynamic or static response of the element.

In one embodiment the lateral rocking constant for a light car may be in the range of about 48,000 to 130,000 in-lbs per radian of angular deflection of the side frame pendulum, or, 260,000 to 700,000 in-lbs per radian for a fully laded car, or more generically, about 0.95 to 2.6 in-lbs per radian per pound of weight borne by the pendulum. Alternatively, for a light (i.e., empty) car the stiffness of the pendulum may be in the range 3,200 to 15,000 lbs per inch, and 22,000 to 61,000 lbs per inch for a fully laden 110 ton truck, or, more generically, in the range of 0.06 to 0.160 lbs per inch of lateral deflection per pound weight borne by the pendulum, as measured at the bottom spring seat.

The male and female surfaces may be inverted, such that the female engagement surface is formed on the bearing adapter, and the male engagement surface is formed on the pedestal seat. It is a matter of terminology which part is actually the "seat", and which is the "rocker". Sometimes the seat may be assumed to be the part that has the larger radius, and which is usually thought of as being the stationary reference, while the rocker is taken to be the part with the smaller radius, that "rocks" on the stationary seat. However, this is not always so. At root, the relationship is of mating parts, whether male or female, and there is relative motion between the parts, or fittings, whether the fittings are called a "seat" or a "rocker". The fittings mate at a force transfer interface. The force transfer interface moves as the parts that co-operate to define the rocking interface rock on each other, whichever part may be, nominally, the male part or the female part. One of the mating parts or surfaces is part of the bearing adapter, and another is part of the pedestal. There may be only two mating surfaces, or there may be more than two mating surfaces in the overall assembly defining the dynamic interface between the bearing adapter and the pedestal fitting, or pedestal seat, however it may be called.

Both female radii $R_1$ and $R_2$ may not be on the same fitting, and both male radii $r_1$ and $r_2$ may not be on the same fitting. That is, they may be combined to form saddle shaped fittings in which the bearing adapter has an upper surface that has a male fitting in the nature of a longitudinally extending crown with a laterally extending axis of rotation, having the radius of curvature is $r_1$, and a female fitting in the nature of a longitudinally extending trough having a lateral radius of curvature $R_2$. Similarly, the pedestal seat fitting may have a downwardly facing surface that has a transversely extending trough having a longitudinally oriented radius of curvature $R_1$, for engagement with $r_1$ of the crown of the bearing adapter, and a longitudinally running, downwardly protruding crown having a transverse radius of curvature $r_2$ for engagement with $R_2$ of the trough of the bearing adapter.

In a sense, a saddle shaped surface is both a seat and a rocker, being a seat in one direction, and a rocker in the other. As noted above, the essence is that there are two small radii, and two large (or possibly even infinite) radii, and the surfaces form a mating pair that engage in rolling contact in both the lateral and longitudinal directions, with a central local minimum potential energy position to which the assembly is biased to return. It may also be noted that the saddle surfaces can be inverted such that the bearing adapter has $r_2$ and $R_1$, and the pedestal seat fitting has $r_1$ and $R_2$. In either case, the smallest of $R_1$ and $R_2$ may be larger than, or equal to, the largest of $r_1$ and $r_2$, and the mating saddle surfaces may tend to be torsionally uncoupled as noted above.

FIG. 3*a*

Figure 3A:
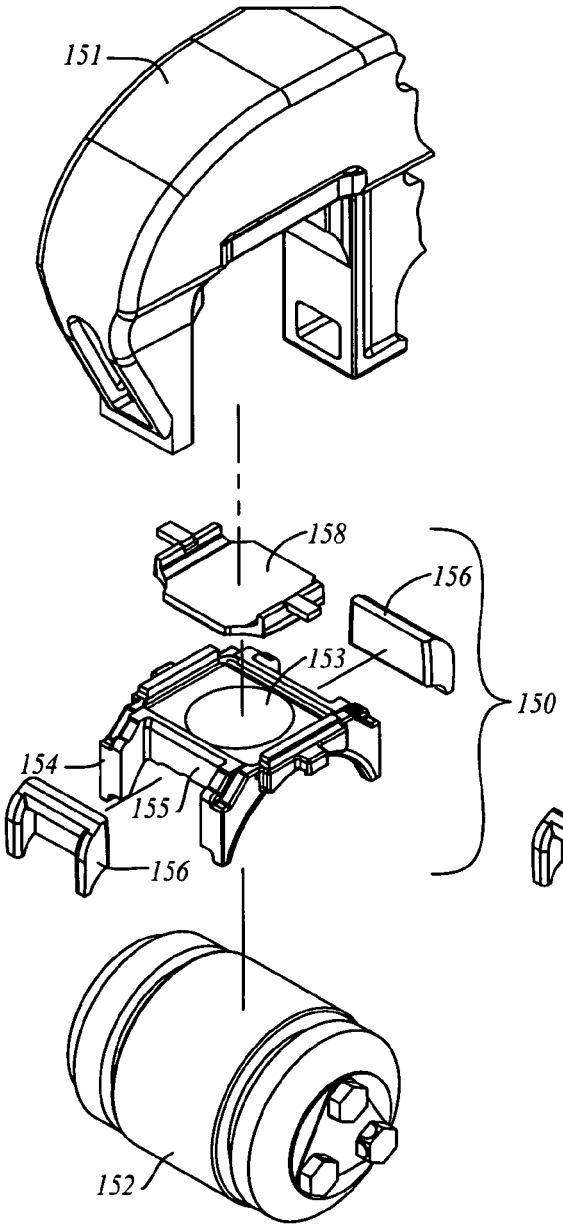
FIG. 3*a* shows an exploded isometric view of an alternate sideframe pedestal to bearing adapter interface to that of FIG. 2*a;*

FIG. 3*a* shows an alternate embodiment of wheelset to sideframe interface assembly, indicated most generally as 150. In this example it may be understood that the pedestal region of sideframe 151, as shown in FIG. 3*a*, is substantially similar to those shown in the previous examples, and may be taken as being the same except insofar as may be noted. Similarly, bearing 152 may be taken as representing the location of the end of a wheelset more generally, with the wheelset to sideframe interface assembly including those items, members or elements that are mounted between bearing 152 and sideframe 151. Bearing adapter 154 may be generally similar to bearing adapter 44 in terms of its lower structure for seating on bearing 152. As with the bodies of the other bearing adapters described herein, the body of bearing adapter 154 may be a casting or a forging, or a machined part, and may be made of a material that may be a relatively low cost material, such as cast iron or steel, and may be made in generally the same manner as bearing adapters have been made heretofore. Bearing adapter 154 may have a bi-directional rocker 153 employing a compound curvature of first and second radii of curvature according to one or another of the possible combinations of male and female radii of curvature discussed herein. Bearing adapter 154 may differ from those described above in that the central body portion 155 of the adapter has been trimmed to be shorter longitudinally, and the inside spacing between the corner abutment portions has been widened somewhat, to accommodate the installation of an auxiliary centering device, or centering member, or centrally biased restoring member in the nature of, for example, elastomeric bumper pads, such as those identified as resilient pads, or members 156. Members 156 may be considered a form of restorative centering element, and may also be termed "snubbers" or "bumper" pads. A pedestal seat fitting having a mating rocking surface for permitting lateral and longitudinal rocking, is identified as 158. As with the other pedestal seat fittings shown and described herein, fitting 158 may be made of a hard metal material, which may be a grade of steel. The engagement of the rocking surfaces may, again, tend to have low resistance to torsion about predominantly vertical axis through the point of contact.

FIG. 3*b*

Figure 3B:
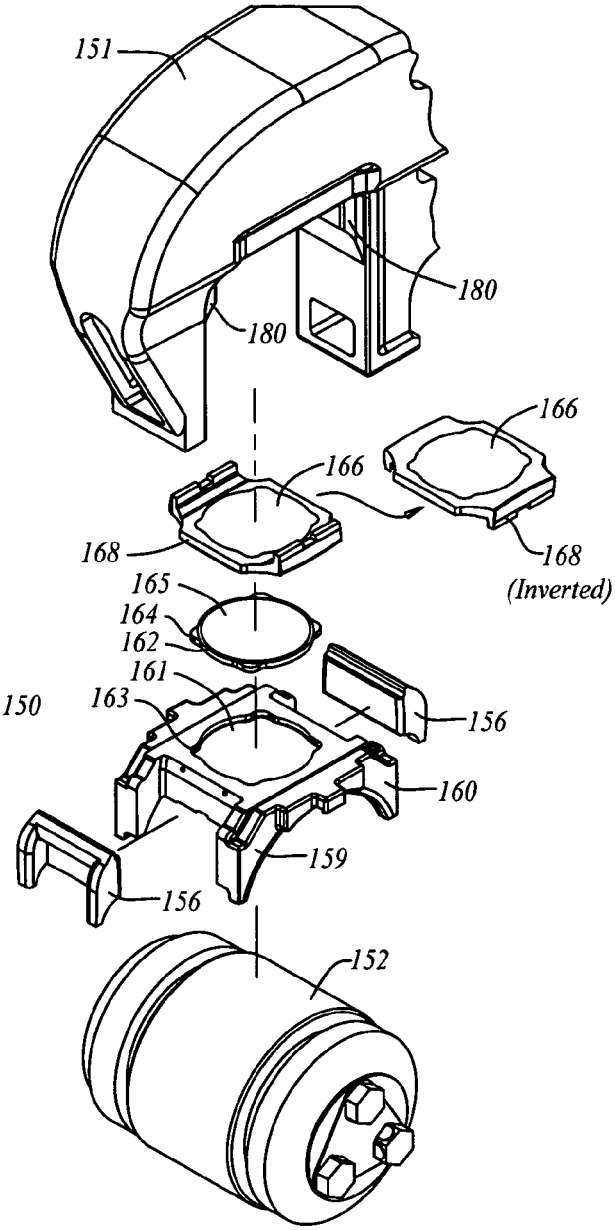
FIG. 3*b* shows an alternate bearing adapter to pedestal seat interface to that of FIG. 3*a;*

In FIG. 3*b*, a bearing adapter 160 is substantially similar to bearing adapter 154, but differs in having a central recess, socket, cavity or accommodation, indicated generally as 161 for receiving an insert identified as a first, or lower, rocker member 162. As with bearing adapter 154, the main, or central portion of the body 159 of bearing adapter 160 may be of shorter longitudinal extent than might otherwise be the case, being truncated, or relieved, to accommodate resilient members 156.

Accommodation 161 may have a plan view form whose periphery may include one or more keying, or indexing, features or fittings, of which cusps 163 may be representative. Cusps 163 may receive mating keying, or indexing, features or fittings of rocker member 162, of which lobes 164 may be taken as representative examples. Cusps 163 and lobes 164 may fix the angular orientation of the lower, or first, rocker member 162 such that the appropriate radii of curvature may be presented in each of the lateral and longitudinal directions. For example, cusps 163 may be spaced unequally about the periphery of accommodation 161 (with lobes 164 being correspondingly spaced about the periphery of the insert member 162) in a specific spacing arrangement to prevent installation in an incorrect orientation, (such as 90 degrees out of phase). For example, one cusp may be spaced 80 degrees of arc about the periphery from one neighbouring cusp, and 100 degrees of arc from another neighbouring cusp, and so on to form a rectangular pattern. Many variations are possible.

While body 159 of bearing adapter 160 may be made of cast iron or steel, the insert, namely first rocker member 162, may be made of a different material. That different material may present a hardened metal rocker surface such as may have been manufactured by a different process. For example, the insert, member 162, may be made of a tool steel, or of a steel such as may be used in the manufacture of ball bearings. Furthermore, upper surface 165 of insert member 162, which includes that portion that is in rocking engagement with the mating pedestal seat 168, may be machined or otherwise formed to a high degree of smoothness, akin to a ball bearing surface, and may be heat treated, to give a finished bearing part.

Similarly, pedestal seat 168 may be made of a hardened material, such as a tool steel or a steel from which bearings are made, formed to a high level of smoothness, and heat treated as may be appropriate, having a surface formed to mate with surface 165 of rocker member 162. Alternatively, pedestal seat 168 may have an accommodation indicated as 167, and an insert member, identified as upper or second rocker member 166, analogous to accommodation 161 and insert member 162, with keying or indexing such as may tend to cause the parts to seat in the correct orientation. Member 166 may be formed of a hard material in a manner similar to member 162, and may have a downward facing rocking surface 157, which may be machined or otherwise formed to a high degree of smoothness, akin to a ball or roller bearing surface, and may be heat treated, to give a finished bearing part surface for mating, rocking engagement with surface 165. Where rocker member 162 has both male radii, and the female radii of curvature are both infinite such that the female surface is planar, a wear member having a planar surface such as a spring clip may be mounted in a sprung interference fit in the pedestal roof in lieu of pedestal seat 168. In one embodiment, the spring clip may be a clip on "Dyna-Clip" (t.m.) pedestal roof wear plate such as supplied by TransDyne Inc. Such a clip is shown in an isometric view in FIG. 8*a* as item 354.

FIG. 3*e*

Figure 3C:
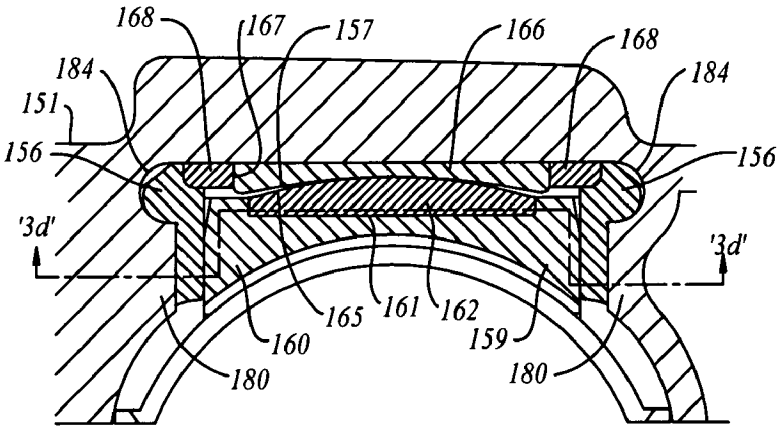
FIG. 3*c* shows a sectional view of the assembly of FIG. 3*b*; taken on a longitudinal-vertical plane of symmetry thereof.
Figure 3D:
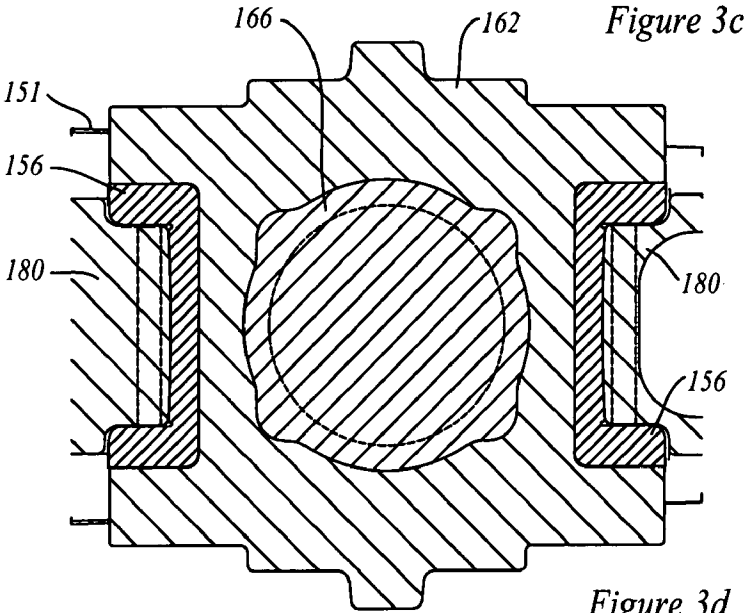
FIG. 3*d* shows a stepped sectional view of a detail of the assembly of FIG. 3*b* taken on 3*d*–3*d*' of FIG. 3*c;*
Figure 3E:
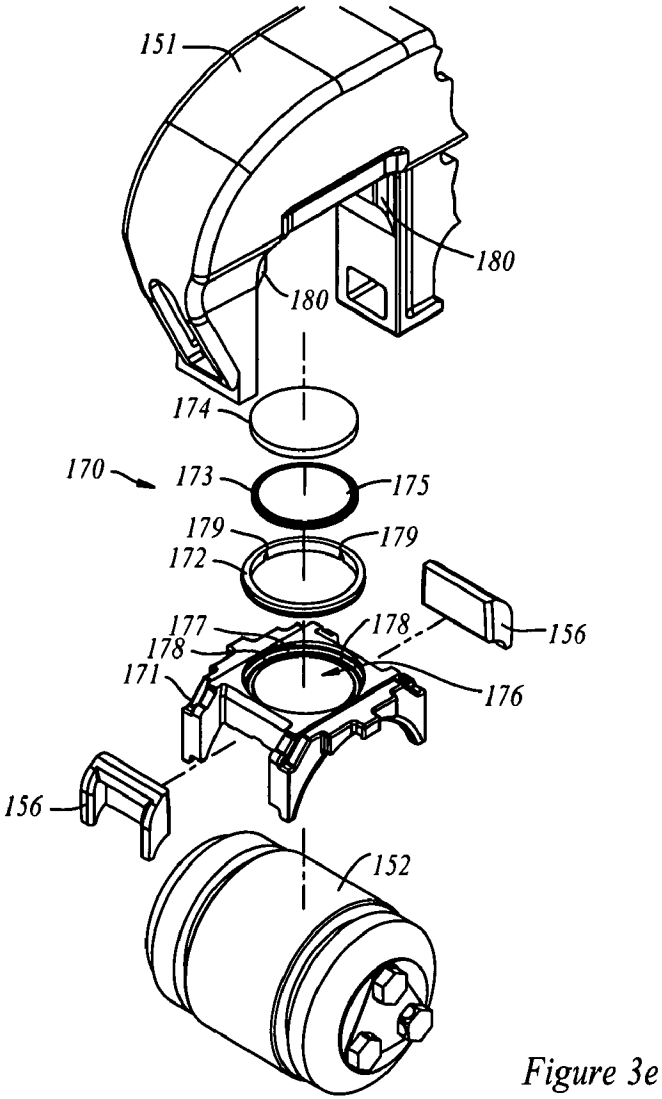
FIG. 3*e* shows an exploded view of another alternative embodiment of bearing adapter to pedestal seat interface to that of FIG. 3*a;*

FIG. 3*e* shows an alternate embodiment of wheelset to sideframe interface assembly, indicated generally as 170. Assembly 170 may include a bearing adapter 171, a pair of resilient members 156, a rocking assembly that may include a boot, resilient ring or retainer, 172, a first rocker member 173, and a second rocker member 174. A pedestal seat may be provided to mount in the roof of the pedestal as described above, or second rocker member 174 may mount directly in the pedestal roof.

Bearing adapter 171 is generally similar to bearing adapter 44, or 154, in terms of its lower structure for seating on bearing 152. The body of bearing adapter 171 may be a casting or a forging, or a machined part, and may be made of a material that may be a relatively low cost material, such as cast iron or steel. Bearing adapter 171 may be provided with a central recess, socket, cavity or accommodation, indicated generally as 176, for receiving rocker member 173 and rocker member 174, and retainer 172. The ends of the main portion of the body of bearing adapter 171 may be of relatively short extent to accommodate resilient members 156. Accommodation 176 may have the form of a circular opening, that may have a radially inwardly extending flange 177, whose upwardly facing surface 178 defines a circumferential land upon which to seat first rocker member 173. Flange 177 may also include drain holes 178, such as may be 4 holes formed on 90 degree centers, for example. Rocker member 173 has a spherical engagement surface. First rocker member 173 may include a thickened central portion, and a thinner radially distant peripheral portion, having a lower radial edge, or margin, or land, for seating upon, and for transferring vertical loads into, flange 177. In an alternate embodiment, a non-galling, relatively soft annular gasket, or shim, whether made of a suitable brass, bronze, copper, or other material may be employed on flange 177 under the land. First rocker member 173 may be made of a different material from the material from which the body of bearing adapter 156 is made more generally. That is to say, rocker member 173 may be made of a hard, or hardened material, such as a tool steel or a steel such as might be used in a bearing, that may be finished to a generally higher level of precision, and to a finer degree of surface roughness than the body of bearing adapter 156 more generally. Such a material may be suitable for rolling contact operation under high contact pressures.

Second rocker member 174 may be a disc of circular shape (when viewed in plan view) or other suitable shape having an upper surface for seating in pedestal seat 168, or, in the event that a pedestal seat member is not used, then formed directly to mate with the pedestal roof having an integrally formed seat. First rocker member 173 may have an upper, or rocker surface 175, having a profile such as may give bi-directional lateral and longitudinal rocking motion when used in conjunction with the mating second, or upper rocker member, 174. Second rocker member 174 may be made of a different material from the material from which the body of bearing adapter 171, or the pedestal seat, is made more generally. Second rocker member 174 may be made of a hard, or hardened material, such as a tool steel or a steel such as might be used in a bearing, that may be finished to a generally higher level of precision, and to a finer degree of surface roughness than the body of sideframe 151 more generally. Such a material may be suitable for rolling contact operation under high contact pressures, particularly as when operated in conjunction with first rocker member 173. Where an insert of dissimilar material is used, that material may tend to be rather more costly than the cast iron or relatively mild steel from which bearing adapters may otherwise tend to be made. Further still, an insert of this nature may possibly be removed and replaced when worn, either on the basis of a scheduled rotation, or as the need may arise.

Resilient member 172 may be made of a composite or polymeric material, such as a polyurethane. Resilient member 172 may also have apertures, or reliefs 179 such as may be placed in a position for co-operation with corresponding drain holes 178. The wall height of resilient member 172 may be sufficiently tall to engage the periphery of first rocker member 173. Further, a portion of the radially outwardly facing peripheral edge of the second, upper, rocking member 174, may also lie within, or may be partially overlapped by, and may possibly slightly stretchingly engage, the upper margin of resilient member 172 in a close, or interference, fit manner, such that a seal may tend to be formed to exclude dirt or moisture. In this way the assembly may tend to form a closed unit. In that regard, such space as may be formed between the first and second rockers 173, 174 inside the dirt exclusion member may be packed with a lubricant, such as a lithium or other suitable grease.

FIGS. 4*a*–4*e*

As shown in FIGS. 4*a*–4*e*, resilient members 156 may have the general shape of a channel, having a central, or back, or transverse, or web portion 181, and a pair of left and right hand, flanking wing portions 182, 183. Wing portions 182 and 183 may tend to have downwardly and outwardly tending extremities that may tend to have an arcuate lower edge such as may seat over the bearing casing. The inside width of wing portions 182 and 183 may be such as to seat snugly about the sides of thrust blocks 180. A transversely extending lobate portion 185, running along the upper margin of web portion 181, may seat in a radiused rebate 184 between the upper margin of thrust blocks 180 and the end of pedestal seat 168. The inner lateral edge 186 of lobate portion 185 may tend to be chamfered, or relieved, to accommodate, and to seat next to, the end of pedestal seat 168.

It may be desirable for the rocking assembly at the wheelset to sideframe interface to tend to maintain itself in a centered condition. As noted, the torsionally de-coupled bi-directional rocker arrangements disclosed herein may tend to have rocking stiffnesses that are proportional to the weight placed upon the rocker. Where a longitudinal rocking surface is used to permit self-steering, and the truck is experiencing reduced wheel load, (such as may approach wheel lift), or where the car is operating in the light car condition, it may be helpful to employ an auxiliary restorative centering element that may include a biasing element tending to urge the bearing adapter to a longitudinally centered position relative to the pedestal roof, and whose restorative tendency may be independent of the gravitational force experienced at the wheel. That is, when the bearing adapter is under less than full load, or is unloaded, it may be desirable to maintain a bias to a central position. Resilient members 156 described above may operate to urge such centering.

FIGS. 3*c* and 3*d* illustrate the spatial relationship of the sandwich formed by (a) the bearing adapter, for example, bearing adapter 154; (b) the centering member, such as, for example, resilient members 156; and (c) the pedestal jaw thrust blocks, 180. Ancillary details such as, for example, drain holes or phantom lines to show hidden features have been omitted from FIGS. 3*c* and 3*d* for clarity. When resilient member 156 is in place, bearing adapter 154 (or 171, as may be); may tend to be centered relative to jaws 180. As installed, the snubber (member 156) may seat closely about the pedestal jaw thrust lug, and may seat next to the bearing adapter end wall and between the bearing adapter corner abutments in a slight interference fit. The snubber may be sandwiched between, and may establish the spaced relative position of, the thrust lug and the bearing adapter and may provide an initial central positioning of the mating rocker elements as well as providing a restorative bias. Although bearing adapter 154 may still rock relative to the sideframe, such rocking may tend to deform (typically, locally to compress) a portion of member 156, and, being elastic, member 156 may tend to urge bearing adapter 154 toward a central position, whether there is much weight on the rocking elements or not. Resilient member 156 may have a restorative force-deflection characteristic in the longitudinal direction that is substantially less stiff than the force deflection characteristic of the fully loaded longitudinal rocker (perhaps one to two orders of magnitude less), such that, in a fully loaded car condition, member 156 may tend not significantly to alter the rocking behaviour. In one embodiment member 156 may be made of a polyurethane having a Young's modulus of some 6,500 p.s.i. In another embodiment the Young's modulus may be about 13,000 p.s.i. The Young's modulus of the elastomeric material may be in the range of 4 to 20 k.p.s.i. The placement of resilient members 156 may tend to center the rocking elements during installation. In one embodiment, the force to deflect one of the snubbers may be less than 20% of the force to deflect the rocker a corresponding amount under the light car (i.e., unloaded) condition, and may, for small deflections, have an equivalent force/deflection curve slope that may be less than 10% of the force deflection characteristic of the longitudinal rocker.

FIG. 5

Figure 5:
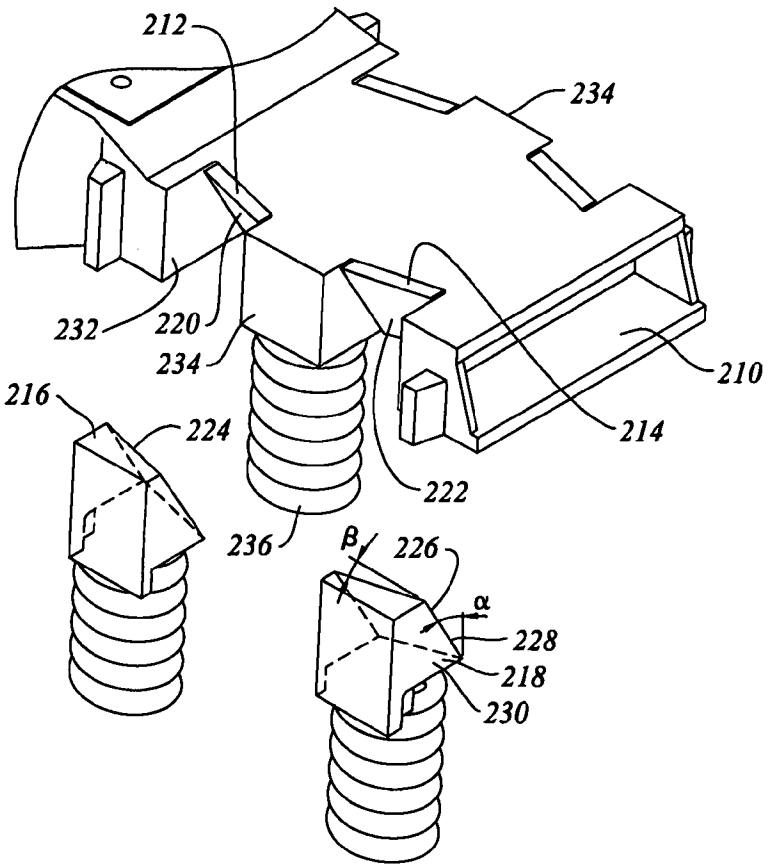
FIG. 5 shows an alternate bolster, similar to that of FIG. 1*d*, with a pair of spaced apart bolster pockets, and inserts with primary and secondary wedge angles.
Figure 4E:
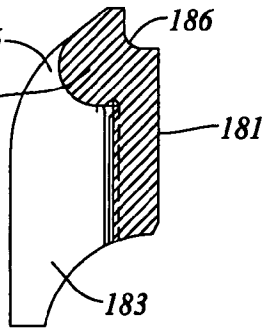
FIG. 4*e* is a section on '4*e*—4*e*' of FIG. 4*d* of the retainer pad of FIG. 4*a;*
Figure 4D:
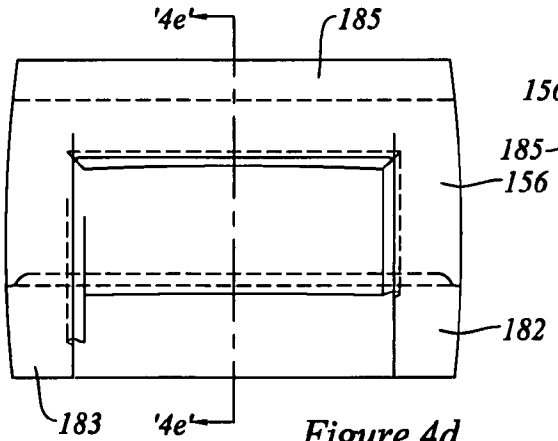
FIG. 4*d* is a front view of the retainer pad of FIG. 4*a;*
Figure 4C:
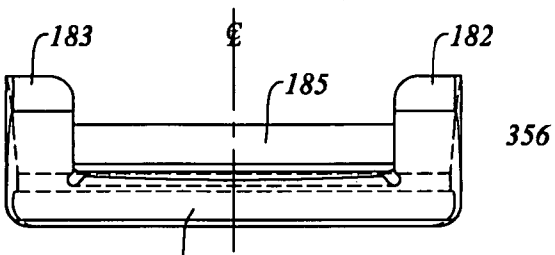
FIG. 4*c* is a bottom view of the retainer pad of FIG. 4*a;*
Figure 4A:
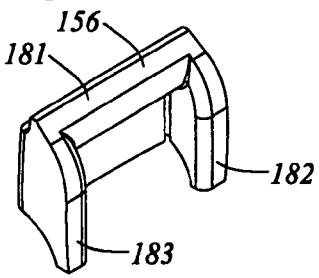
FIG. 4*a* shows an isometric view of a retainer pad of the assembly of FIG. 3*a*, taken from above, and in front of one corner.
Figure 4B:
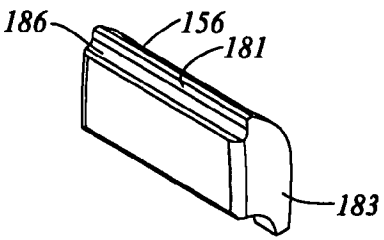
FIG. 4*b* is an isometric view from above and behind the retainer pad of FIG. 4*a;*

Thus far only primary wedge angles have been discussed. FIG. 5 shows an isometric view of an end portion of a truck bolster 210. As with all of the truck bolsters shown and discussed herein, bolster 210 is symmetrical about the central longitudinal vertical plane of the bolster (i.e., crosswise relative to the truck generally) and symmetrical about the vertical mid-span section of the bolster (i.e., the longitudinal plane of symmetry of the truck generally, coinciding with the railcar longitudinal center line). Bolster 210 has a pair of spaced apart bolster pockets 212, 214 for receiving damper wedges 216, 218. Pocket 212 is laterally inboard of pocket 214 relative to the side frame of the truck more generally. Wear plate inserts 220, 222 are mounted in pockets 212, 214 along the angled wedge face.

As can be seen, wedges 216, 218 have a primary angle, β as measured between vertical and the angled trailing vertex 228 of outboard face 230. For the embodiments discussed herein, primary angle a may tend to lie in the range of 35–55 degrees, possibly about 40–50 degrees. This same angle α is matched by the facing surface of the bolster pocket, be it 212 or 214. A secondary angle β gives the inboard, (or outboard), rake of the sloped surface 224, (or 226) of wedge 216 (or 218). The true rake angle can be seen by sighting along plane of the sloped face and measuring the angle between the sloped face and the planar outboard face 230. The rake angle is the complement of the angle so measured. The rake angle may tend to be greater than 5 degrees, may lie in the range of 5 to 20 degrees, and is preferably about 10 to 15 degrees. A modest rake angle may be desirable.

When the truck suspension works in response to track perturbations, the damper wedges may tend to work in their pockets. The rake angles yield a component of force tending to bias the outboard face 230 of outboard wedge 218 outboard against the opposing outboard face of bolster pocket 214. Similarly, the inboard face of wedge 216 may tend to be biased toward the inboard planar face of inboard bolster pocket 212. These inboard and outboard faces of the bolster pockets may be lined with a low friction surface pad, indicated generally as 232. The left hand and right hand biases of the wedges may tend to keep them apart to yield the full moment arm distance intended, and, by keeping them against the planar facing walls, may tend to discourage twisting of the dampers in the respective pockets.

Bolster 210 includes a middle land 234 between pockets 212, 214, against which another spring 236 may work. Middle land 234 is such as might be found in a spring group that is three (or more) coils wide. However, whether two, three, or more coils wide, and whether employing a central land or no central land, bolster pockets can have both primary and secondary angles as illustrated in the example embodiment of FIG. 5*a*, with or without wear inserts.

Where a central land, e.g., land 234, separates two damper pockets, the opposing side frame column wear plates need not be monolithic. That is, two wear plate regions could be provided, one opposite each of the inboard and outboard dampers, presenting planar surfaces against which the dampers can bear. The normal vectors of those regions may be parallel, the surfaces may be co-planar and perpendicular to the long axis of the side frame, and may present a clear, un-interrupted surface to the friction faces of the dampers.

FIG. 1*e*

FIG. 1*e* shows an example of a three piece railroad car truck, shown generally as 250. Truck 250 has a truck bolster 252, and a pair of sideframes 254. The spring groups of truck 250 are indicated as 256. Spring groups 256 are spring groups having three springs 258 (inboard corner), 260 (center) and 262 (outboard corner) most closely adjacent to the sideframe columns 254. A motion calming, kinematic energy dissipating element, in the nature of a friction damper 264, 266 is mounted over each of central springs 260.

Friction damper 264, 266 has a substantially planar friction face 268 mounted in facing, planar opposition to, and for engagement with, a side frame wear member in the nature of a wear plate 270 mounted to sideframe column 254. The base of damper 264, 266 defines a spring seat, or socket 272 into which the upper end of central spring 260 seats. Damper 264, 266 has a third face, being an inclined slope or hypotenuse face 274 for mating engagement with a sloped face 276 inside sloped bolster pocket 278. Compression of spring 260 under an end of the truck bolster may tend to load damper 264 or 266, as may be, such that friction face 268 is biased against the opposing bearing face of the sideframe column, 280. Truck 250 also has wheelsets whose bearings are mounted in the pedestal 284 at either ends of the side frames 254. Each of these pedestals may accommodate one or another of the sideframe to bearing adapter interface assemblies described above and may thereby have a measure of self steering.

In this embodiment, vertical face 268 of friction damper 264, 266 may have a bearing surface having a co-efficient of static friction, $\mu_s$, and a co-efficient of dynamic or kinetic friction, $\mu_k$, that may tend to exhibit little or no "stick-slip" behaviour when operating against the wear surface of wear plate 270. In one embodiment, the coefficients of friction are within 10% of each other. In another embodiment the coefficients of friction are substantially equal and may be substantially free of stick-slip behaviour. In one embodiment, when dry, the coefficients of friction may be in the range of 0.10 to 0.45, may be in the narrower range of 0.15 to 0.35, and may be about 0.30. Friction damper 264, 266 may have a friction face coating, or bonded pad 286 having these friction properties, and corresponding to those inserts or pads described in the context of FIGS. 6*a*–6*c*, and FIGS. 7*a*–7*h*. Bonded pad 286 may be a polymeric pad or coating. A low friction, or controlled friction pad or coating 288 may also be employed on the sloped surface of the damper. In one embodiment that coating or pad 288 may have coefficients of static and dynamic friction that are within 20%, or, more narrowly, 10% of each other. In another embodiment, the coefficients of static and dynamic friction are substantially equal. The co-efficient of dynamic friction may be in the range of 0.10 to 0.30, and may be about 0.20.

Figure 6A:
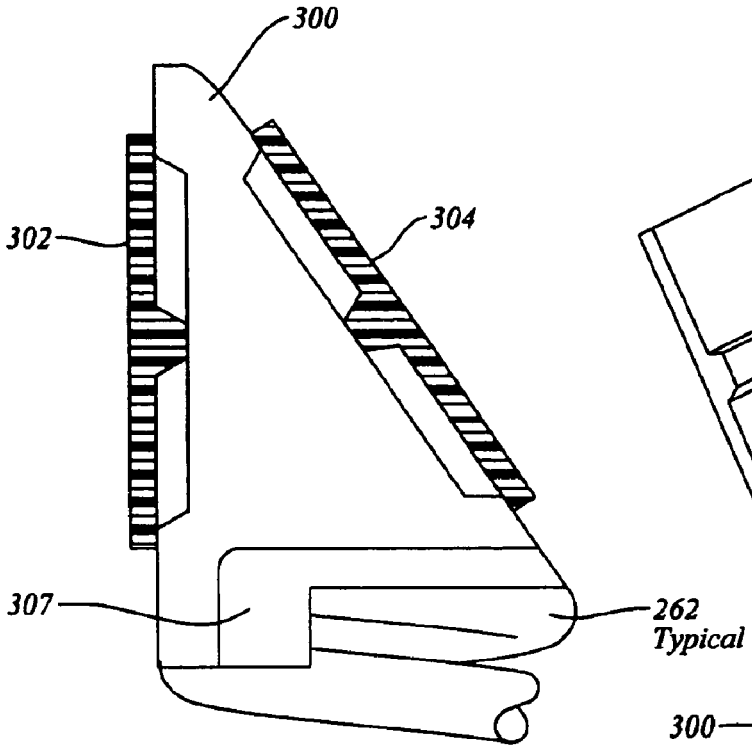
FIG. 6*a* is a cross-section of an alternate damper such as may be used, for example, in the bolster of the trucks of FIGS. 1*a*, 1*b*, 1*c*, 1*d* and 1*f;*
Figure 6C:
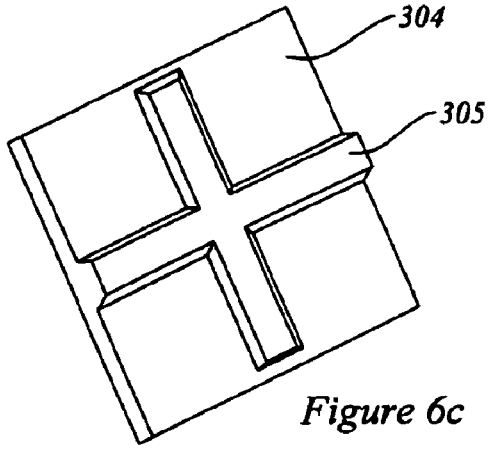
FIG. 6*c* is a reverse view of a friction modifying pad of the damper of FIG. 6*a;*
Figure 6B:
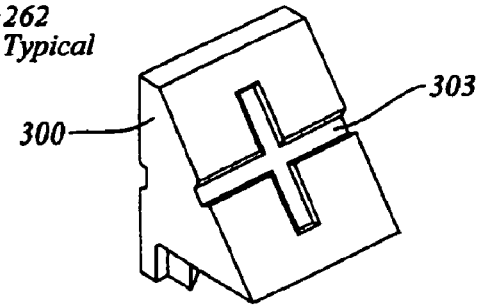
FIG. 6*b* shows the damper of FIG. 6*a* with friction modifying pads removed.

FIGS. 6*a* to 6*c*

The bodies of the damper wedges themselves may be made from a relatively common material, such as a mild steel or cast iron. The wedges may then be given wear face members in the nature of shoes, wear inserts or other wear members, which may be intended to be consumable items. In FIG. 6*a*, a damper wedge is shown generically as 300. The replaceable, friction modification consumable wear members are indicated as 302, 304. The wedges and wear members may have mating male and female mechanical interlink features, such as the cross-shaped relief 303 relationship, and when so engaged, said first rocker element receives vertical loads from. formed in the primary angled and vertical faces of wedge 300 for mating with the corresponding raised cross shaped features 305 of wear members 302, 304. Sliding wear member 302 may be made of a material having specified friction properties, and may be obtained from a supplier of such materials as, for example, brake and clutch linings and the like, such as Railway Friction Products. The materials may include materials that are referred to as being non-metallic, low friction materials, and may include UHMW polymers. Although FIGS. 6*a* and 6*c* show consumable inserts in the nature of wear plates, namely wear members 302, 304 the entire bolster pocket may be made as a replaceable part. It may be a high precision casting, or may include a sintered powder metal assembly having suitable physical properties. The part so formed may then be welded into place in the end of the bolster.

The underside of the wedges described herein, wedge 300 being typical in this regard, may have a seat, or socket 307, for engaging the top end of the spring coil, whichever spring it may be, spring 262 being shown as typically representative. Socket 307 serves to discourage the top end of the spring from wandering away from the intended generally central position under the wedge. A bottom seat, or boss, for discouraging lateral wandering of the bottom end of the spring is shown in FIG. 1*e* as item 308. It may be noted that wedge 300 has a primary angle, but does not have a secondary rake angle. In that regard, wedge 300 may be used as damper 264, 266 of truck 250 of FIG. 1*e*, for example, and may provide friction damping with little or no "stick-slip" behaviour, but rather friction damping for which the coefficients of static and dynamic friction are equal, or only differ by a small (less than about 20%, perhaps less than 10%) difference. Wedge 300 may be used in truck 250 in conjunction with a bidirectional bearing adapter of any of the embodiments described herein. Wedge 300 may also be used in a four cornered damper arrangement, as in truck 22, for example, where wedges may be employed that may lack secondary angles.

FIGS. 7*a*–7*h*

Referring to FIGS. 7*a*–7*e*, a damper 310 is shown such as may be used in truck 22, or any of the other double damper trucks described herein, such as may have appropriately formed, mating bolster pockets. Damper 310 is similar to damper 300, but may include both primary and secondary angles. Damper 310 may, arbitrarily, be termed a right handed damper wedge. FIGS. 7*a*–7*e* are intended to be generic such that it may be understood also to represent the left handed, mirror image of a mating damper with which damper 310 would form a matched pair.

Wedge 310 has a body 312 that may be made by casting or by another suitable process. Body 312 may be made of steel or cast iron, and may be substantially hollow. Body 312 has a first, substantially planar platen portion 314 having a first face for placement in a generally vertical orientation in opposition to a sideframe bearing surface, for example, a wear plate mounted on a sideframe column. Platen portion 314 may have a rebate, or relief, or depression formed therein to receive a bearing surface wear member, indicated as member 316. Member 316 may be a material having specific friction properties when used in conjunction with the sideframe column wear plate material. For example, member 316 may be formed of a brake lining material, and the column wear plate may be formed from a high hardness steel.

Body 312 may include a base portion 318 that may extend rearwardly from and generally perpendicularly to, platen portion 314. Base portion 318 may have a relief 320 formed therein in a manner to form, roughly, the negative impression of an end of a spring coil, such as may receive a top end of a coil of a spring of a spring group, such as spring 262. Base portion 318 may join platen portion 314 at an intermediate height, such that a lower portion 321 of platen portion 314 may depend downwardly therebeyond in the manner of a skirt. That skirt portion may include a corner, or wrap around portion 322 formed to seat around a portion of the spring.

Body 312 may also include a diagonal member in the nature of a sloped member 324. Sloped member 324 may have a first, or lower end extending from the distal end of base 318 and running upwardly and forwardly toward a junction with platen portion 314. An upper region 326 of platen portion 314 may extend upwardly beyond that point of junction, such that damper wedge 310 may have a footprint having a vertical extent somewhat greater than the vertical extent of sloped member 324. Sloped member 324 may also have a socket or seat in the nature of a relief or rebate 328 formed therein for receiving a sliding face member 330 for engagement with the bolster pocket wear plate of the bolster pocket into which wedge 310 may seat. As may be seen, sloped member 324 (and face member 330) are inclined at a primary angle α, and a secondary angle β. Sliding face member 330 may be an element of chosen, possibly relatively low, friction properties (when engaged with the bolster pocket wear plate), such as may include desired values of coefficients of static and dynamic friction. In one embodiment the coefficients of static and dynamic friction may be substantially equal, may be about 0.2 (+/−20%, or, more narrowly +/−10%), and may be substantially free of stick-slip behaviour.

Figure 7H:
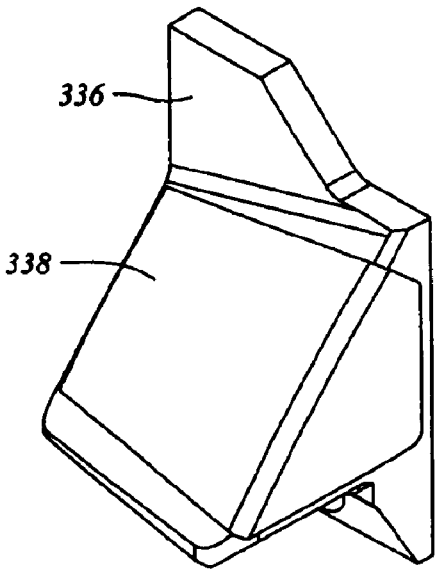
FIG. 7*h* shows an isometric view of a further alternate damper to that of FIG. 7*a*, having a "wrap-around" friction modifying pad.
Figure 7G:
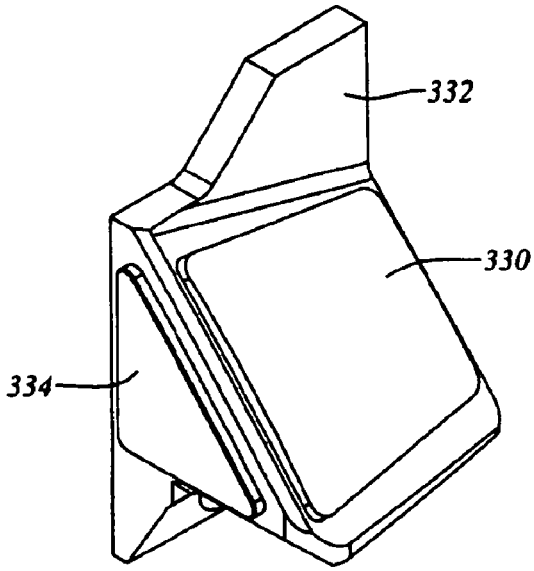
FIG. 7*g* shows an isometric view of an alternate damper to that of FIG. 7*a* having a friction modifying side face pad.
Figure 7A:
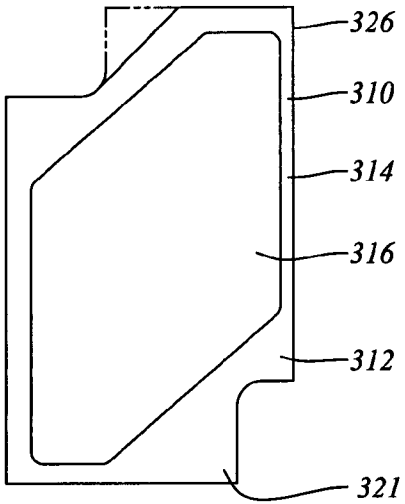
FIG. 7*a* is a front view of a friction damper for a truck such as that of FIG. 1*a;*
Figure 7F:
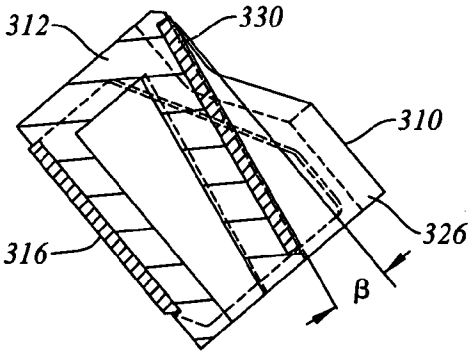
FIG. 7*f* is a cross-section of the damper of FIG. 7*a* taken on section '7*f*—7*f*' of FIG. 7*e;*
Figure 7B:
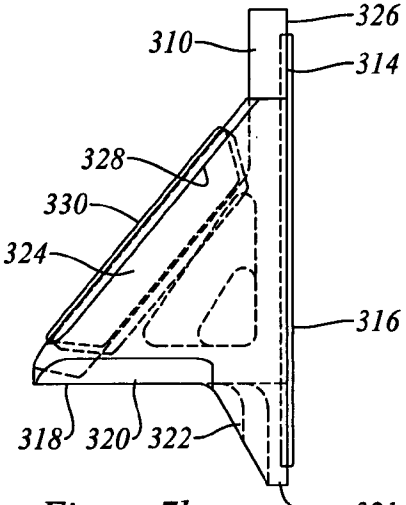
FIG. 7*b* shows a side view of the damper of FIG. 7*a;*
Figure 7E:
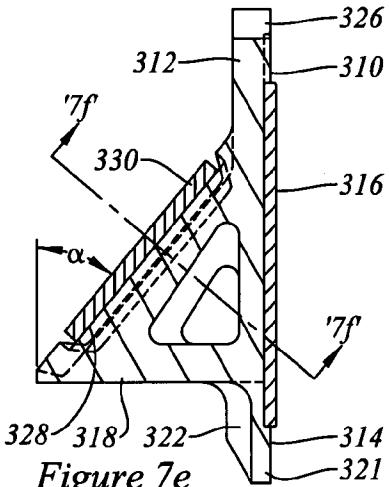
FIG. 7*e* shows a cross-sectional view on the centerline of the damper of FIG. 7*a* taken on section '7*e*—7*e*' of FIG. 7*c;*
Figure 7C:
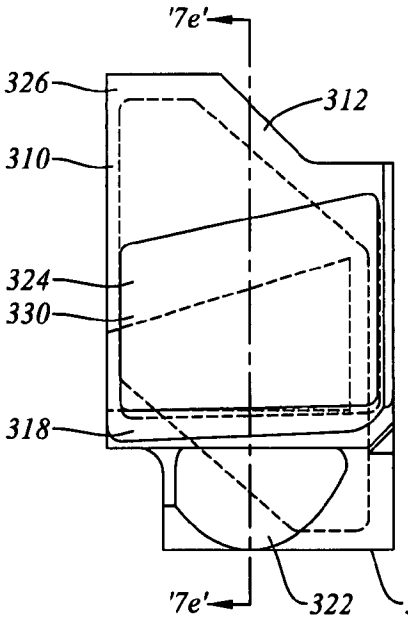
FIG. 7*c* shows a rear view of the damper of FIG. 7*b;*
Figure 7D:
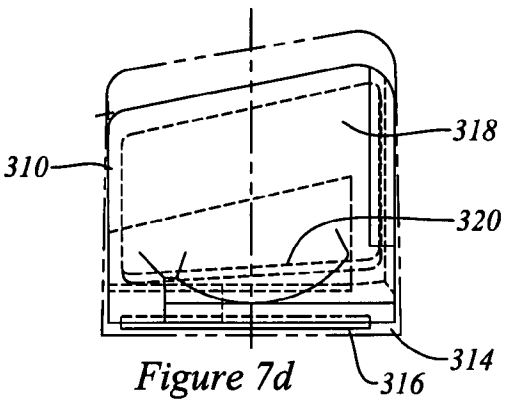
FIG. 7*d* shows a top view of the damper of FIG. 7*a;*

In the alternative embodiment of FIG. 7*g*, a damper wedge 332 is similar to damper wedge 310, but, in addition to pads or inserts for providing modified or controlled friction properties on the friction face for engaging the sideframe column and on the face for engaging the slope of the bolster pocket, damper wedge 332 may have pads or inserts such as pad 334 on the side faces of the wedge for engaging the side faces of the bolster pockets. In this regard, it may be desirable for pad 334 to have low coefficients of friction, and to tend to be free of stick slip behaviour. The friction materials may be cast or bonded in place, and may include mechanical interlocking features, such as shown in FIG. 6*a*, or bosses, grooves, splines, or the like such as may be used for the same purpose. Similarly, in the alternative embodiment of FIG. 7*h*, a damper wedge 336 is provided in which the slope face insert or pad, and the side wall insert or pad form a continuous, or monolithic, element, indicated as 338. The material of the pad or insert may, again, be cast in place, and may include mechanical interlock features.

FIGS. 8*a*–8*f*

FIGS. 8*a*–8*f* show an alternate bearing adapter assembly to that of FIG. 3*a*. The assembly, indicated generally as 350, may differ from that of FIG. 3*a* insofar as bearing adapter 344 may have an upper surface 346 that may be a load bearing interface surface of significant extent, that may be substantially planar and horizontal, such that it may act as a base upon which to seat a rocker element, 348. Rocker element 348 may have an upper, or rocker, surface 352 having a suitable profile, such as a compound curvatures having lateral and longitudinal radii of curvature, for mating with a corresponding rocker engagement surface, of a pedestal seat liner 354. As noted above, in the general case each of the two rocking engagement surface may have both lateral and longitudinal radii of curvature, such that there are mating lateral male and female radii, and mating longitudinal male and female radii. In one embodiment, both the female radii may be infinite, such that the pedestal seat may have a planar engagement surface, and the pedestal seat liner may be a wear liner, or similar device.

Rocker element 348 may also have a lower surface 356 for seating on, mating with, and for transferring loads into, upper surface 346 over a relatively large surface area, and may have a suitable through thickness for diffusing vertical loading from the zone of rolling contact to the larger area of the land (i.e., surface 346, or a portion thereof) upon which rocker element 348 sits. Lower surface 356 may also include a keying, or indexing feature 358 of suitable shape, and may include a centering feature 360, both to aid in installation, and to aid in re-centering rocker element 348 in the event that it should be tempted to migrate away from the central position during operation. Indexing feature 358 may also include an orienting element for discouraging misorientation of rocker element 348. Indexing feature 358 may be a cavity 362 of suitable shape to mate with an opposed button 364 formed on the upper surface 346 of bearing adapter 344. If this shape is non-circular, it may tend to admit of only one permissible orientation. The orienting element may be defined in the plan form shape of cavity 362 and button 364. Where the various radii of curvature of rocker element 348 differ in the lateral and longitudinal directions, it may be that two positions 180 degrees out of phase may be acceptable, whereas another orientation may not. While an ellipse of differing major and minor axes may serve this purpose, the shape of cavity 362 and button 364 may be chosen from a large number of possibilities, and may have a cruciform or triangular shape, or may include more than one raised feature in an asymmetrical pattern, for example. The centering feature may be defined in the tapered, or sloped, flanks 368 and 370 of cavity 362 and 364 respectively, in that, once positioned such that flanks 368 and 370 begin to work against each other, a normal force acting downward on the interface may tend to cause the parts to center themselves.

Rocker element 348 has an external periphery 372, defining a footprint. Resilient members 374 may be taken as being the same as resilient members 156, noted above, except insofar as resilient members 374 may have a depending end portion for nesting about the thrust block of a jaw of the pedestal, and also a predominantly horizontally extending portion 376 for overlying a substantial portion of the generally flat or horizontal upper region of bearing adapter 344. That is, the outlying regions of surface 346 of bearing adapter 344 may tend to be generally flat, and may tend, due to the general thickness of rocker element 348, to be compelled to stand in a spaced apart relationship from the opposed, downwardly facing surface of the pedestal seat, such as may be, for example, the exposed surface of a wear liner such as item 354, or a seat such as item 168, or such other mating part as may be suitable. Portion 376 is of a thickness suitable for lying in the gaps so defined, and may tend to be thinner than the mean gap height so as not to interfere with operation of the rocker elements. Horizontally extending portion 376 may have the form of a skirt such as may include a pair of left and right hand arms or wings 378 and 380 having a profile, when seen in plan view, for embracing a portion of periphery 372. Resilient member 374 has a relief 382 defined in the inwardly facing edge. Where rocker member 348 has outwardly extending blisters, or cusps, akin to item 164, relief 382 may function as an indexing or orientation feature. A relatively coarse engagement of rocker element 348 may tend to result in wings 378 and 380 urging rocker element 348 to a generally centered position relative to bearing adapter 344. This coarse centering may tend to cause cavity 362 to pick up on button 364, such that rocker member 348 is then urged to the desired centered position by a fine centering feature, namely the chamfered flanks 368, 370. The root of portion 376 may be relieved by a radius 384 adjacent the juncture of surface 346 with the end wall 386 of bearing adapter 348 to discourage chaffing of resilient member 372, 374 at that location. Without the addition of a multiplicity of drawings, it may be noted that rocker element 348 could, alternatively, be inverted so as to, seat in an accommodation formed in the pedestal roof, with a land facing toward the roof, and a rocking surface facing toward a mating bearing adapter, be it adapter 44 or some other.

Figure 9A:
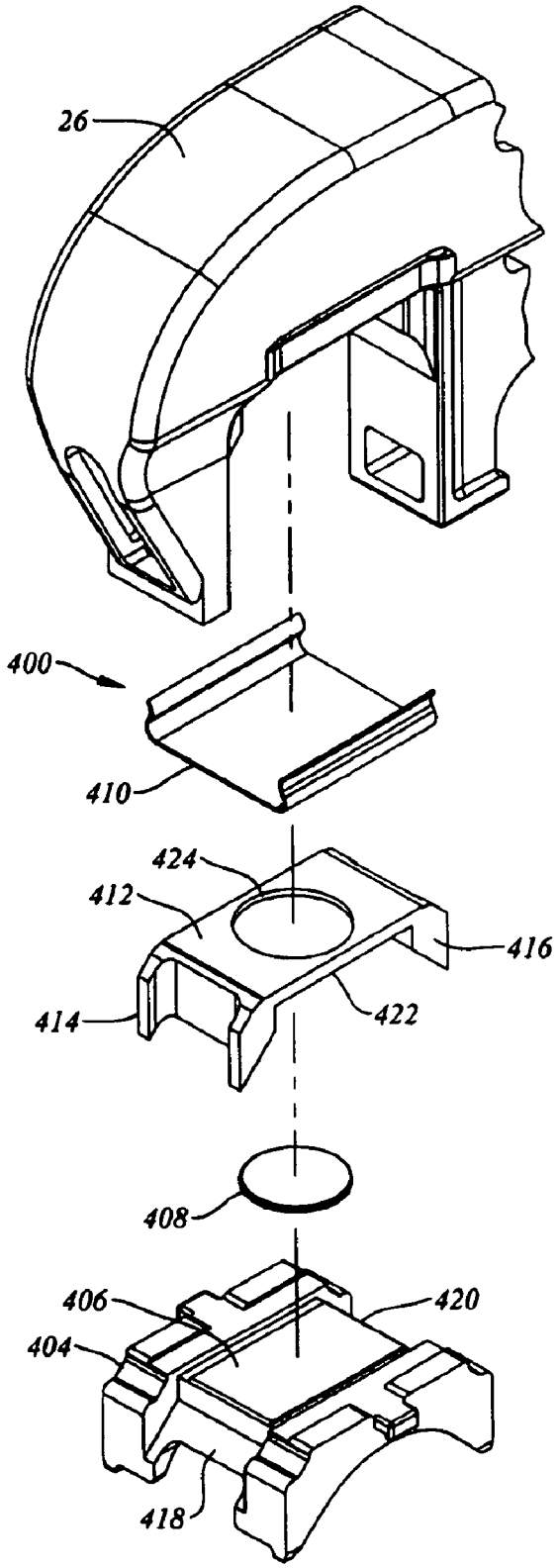
FIG. 9*a* shows an exploded isometric view of an alternate assembly to that of FIG. 3*a;*
Figure 9B:
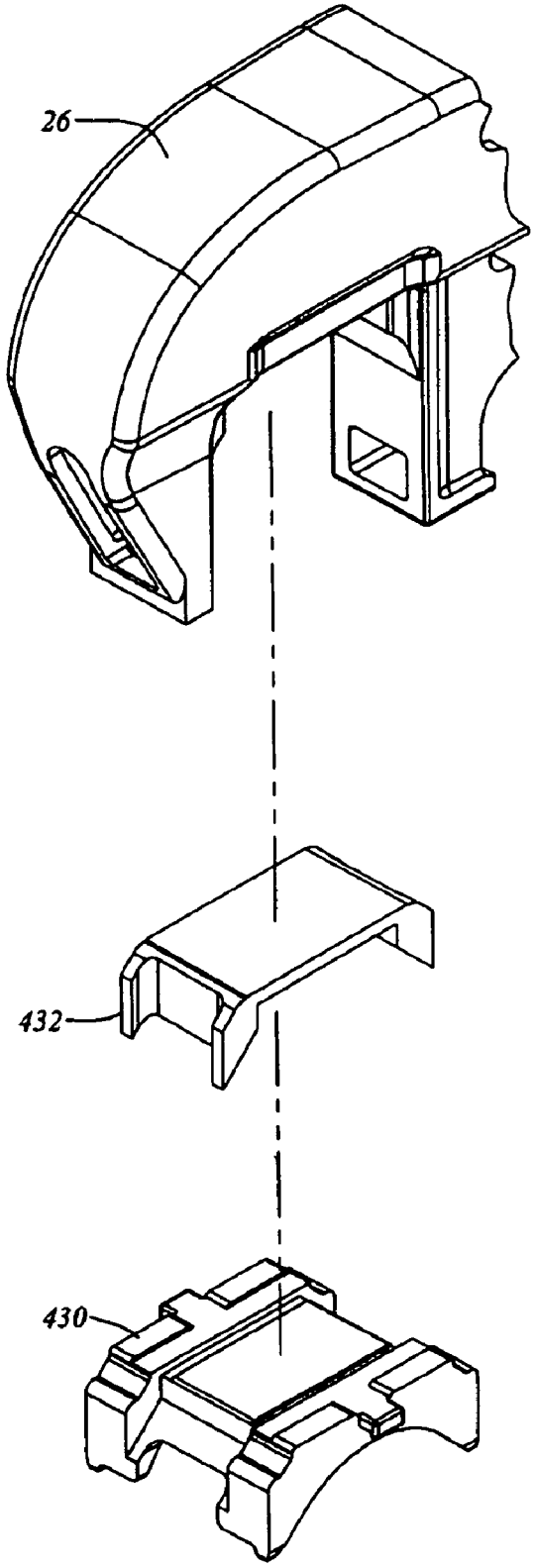
FIG. 9*b* shows an exploded isometric view similar to the view of FIG. 9*a*, showing a bearing adapter assembly incorporating an elastomeric pad.

FIGS. 9*a* and 9*b*

Figure 8B:
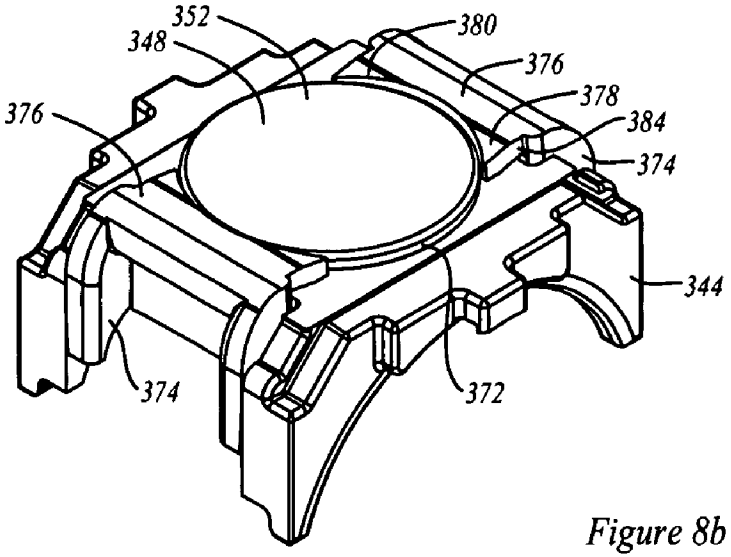
FIG. 8*b* shows an isometric, assembled view of the bearing adapter assembly of FIG. 8*a;*
Figure 8C:
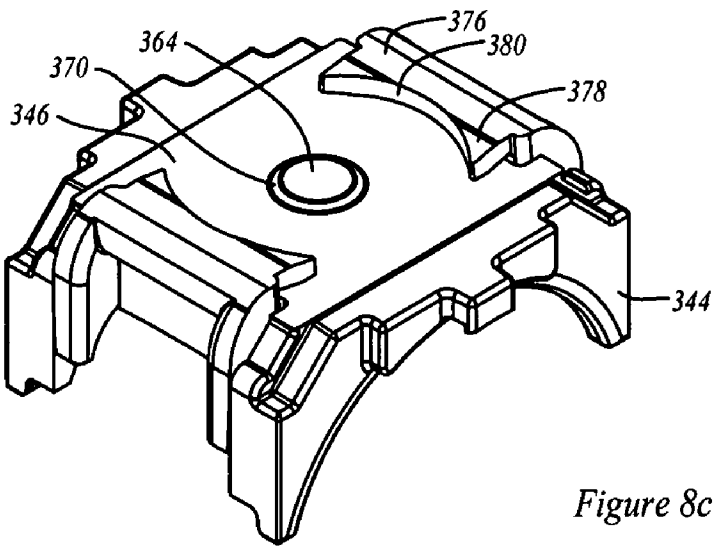
FIG. 8*c* shows the assembly of FIG. 8*b* with a rocker member thereof removed.
Figure 8A:
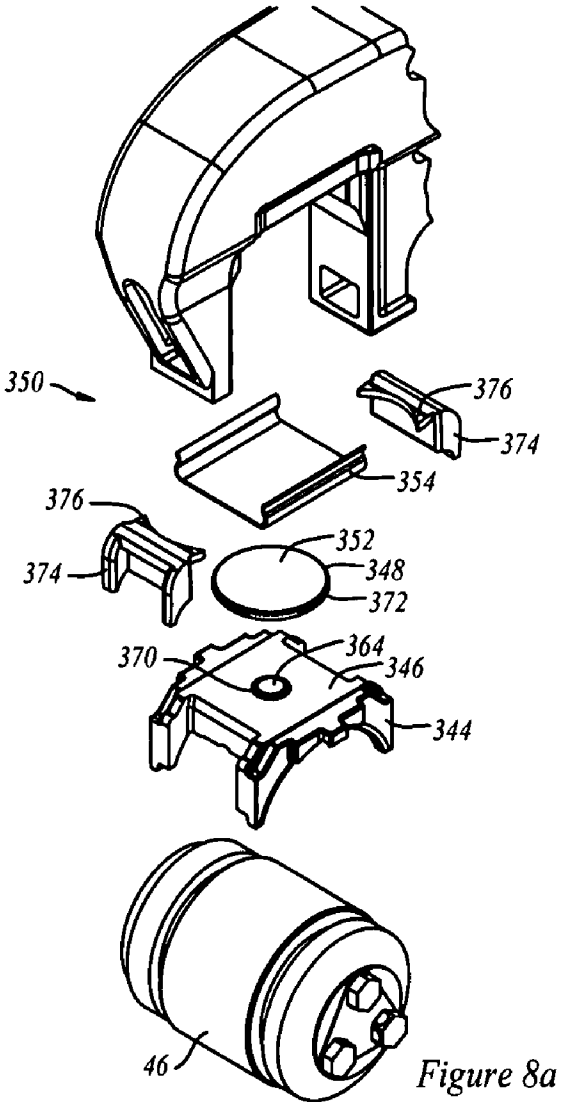
FIG. 8*a* shows an exploded isometric installation view of an alternate bearing adapter assembly to that of FIG. 3*a;*
Figure 8E:
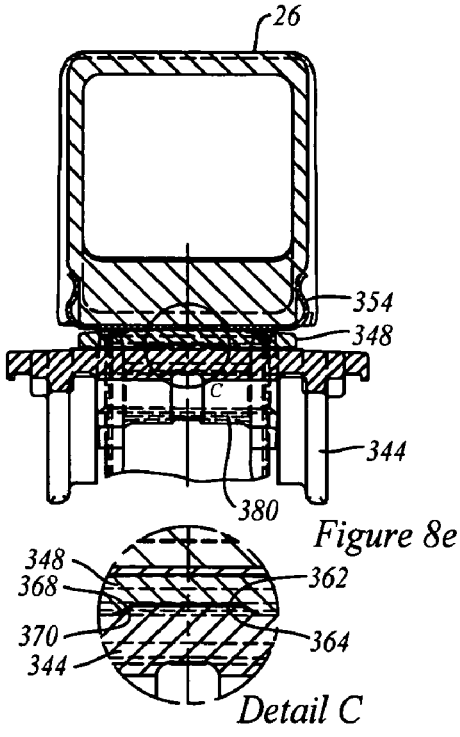
FIG. 8*e* is an installed view of the assembly of FIG. 8*b*, on section '8*e*—8*e*' of FIG. 8*d;*
Figure 8D:
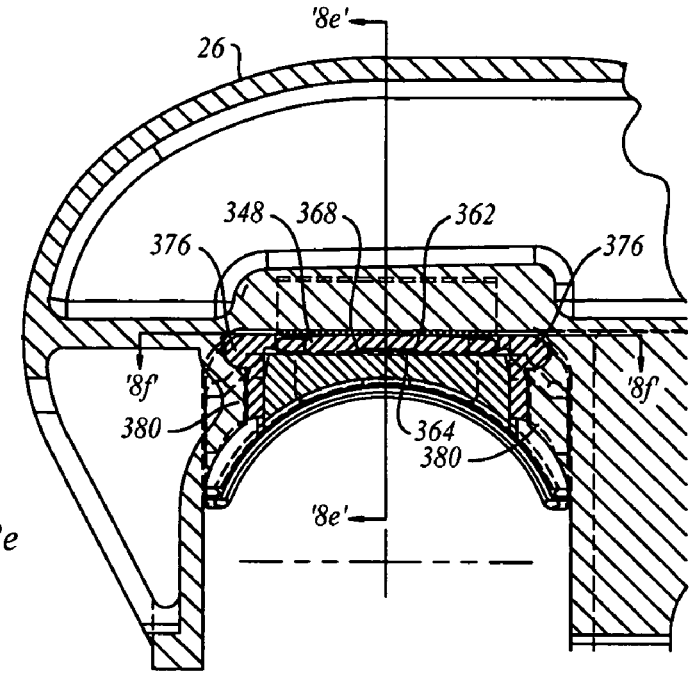
FIG. 8*d* shows the assembly of FIG. 8*b*, as installed, in longitudinal cross-section.
Figure 8F:
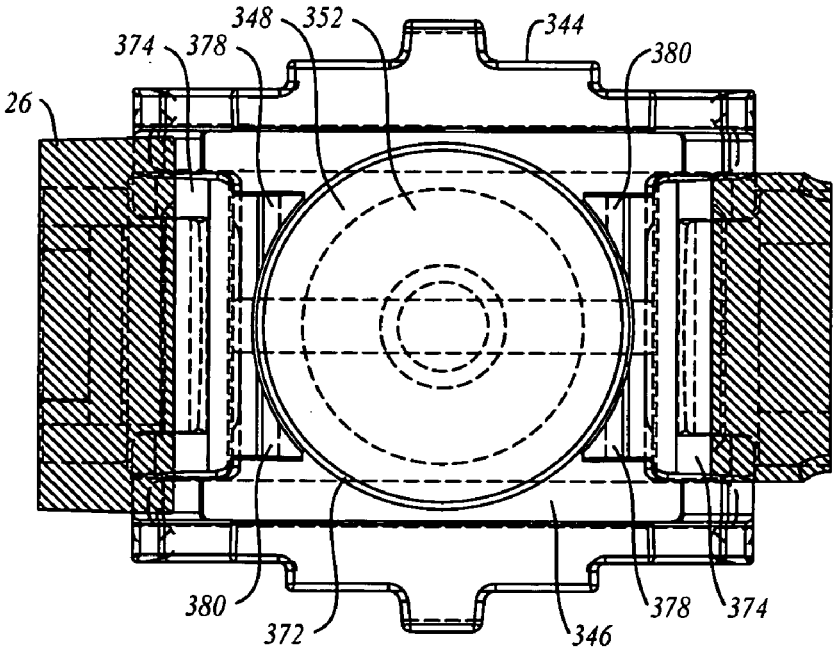
FIG. 8*f* shows the assembly of FIG. 8*b*, as installed, in lateral cross section.

FIG. 9*a* shows an alternative arrangement to that of FIG. 3*a* or FIG. 8*a*. In the wheelset to sideframe interface assembly of FIG. 9*a*, indicated generally as 400, bearing adapter 404 may be substantially similar to bearing adapter 344, and may have an upper surface 406 and a rocker element 408 that interact in the same manner as rocker element 348 interacts with surface 346. (Or, in the inverted case, the rocker element may be seated in the pedestal roof, and the bearing adapter may have a mating upwardly facing rocker surface). The rocker element may interact with a pedestal seat fitting 410 such as may be a wear liner seated in the pedestal roof. Rocker element 408 and the body of bearing adapter 404 may have mating indexing features as described in the context of FIGS. 8*a* to 8*e*.

Rather than two resilient members, such as items 374, however, assembly 400 employs a single resilient member 412, such as may be a monolithic cast material, be it polyurethane or a suitable rubber or rubberlike material such as may be used, for example, in making an LC pad or a Pennsy pad. An LC pad is an elastomeric bearing adapter pad available from Lord Corporation of Erie Pennsylvania. An example of an LC pad may be identified as Standard Car Truck Part Number SCT 5578. In this instance, resilient member 412 has first and second end portions 414, 416 for interposition between the thrust lugs of the jaws of the pedestal and the ends 418 and 420 of the bearing adapter. End portions 414, 416 may tend to be a bit undersize so that, once the roof liner is in place, they may slide vertically into place on the thrust lugs, possibly in a modest interference fit. The bearing adapter may slide into place thereafter, and again, may do so in a slight interference fit, carrying the rocker element 408 with it into place.

Resilient member 412 may also have a central or medial portion 422 extending between end portions 414, 416. Medial portion 422 may extend generally horizontally inward to overlie substantial portions of the upper surface bearing adapter 404. Resilient member 412 may have an accommodation 424 formed therein, be it in the nature of an aperture, or through hole, having a periphery of suitable extent to admit rocker element 408, and so to permit rocker element 408 to extend at least partially through member 412 to engage the mating rocking element of the pedestal seat. It may be that the periphery of accommodation 422 is matched to the shape of the footprint of rocker element 408 in the manner described in the context of FIGS. 8*a* to 8*e* to facilitate installation and to facilitate location of rocker element 408 on bearing adapter 404. In one embodiment resilient member 412 may be formed in the manner of a Pennsy Pad with a suitable central aperture formed therein.

FIG. 9*b* shows a Pennsy pad installation. In this installation, a bearing adapter is indicated as 430, and an elastomeric member, such as may be a Pennsy pad, is indicated as 432. On installation, member 432 seats between the pedestal roof and the bearing adapter. The term "Pennsy pad", or "Pennsy Adapter Plus", refers to a kind of elastomeric pad developed by Pennsy Corporation of Westchester Pa. One example of such a pad is illustrated in U.S. Pat. No. 5,562,045 of Rudibaugh et al., issued Oct. 6, 1996 (and which is incorporated herein by reference). FIG. 9*b*may include a pad 432 and bearing adapter of 430 the same, or similar, nature to those shown and described in the 5,562,045 patent. The Pennsy pad may tend to permit a measure of passive steering. The Pennsy pad installation of FIG. 9*b* can be installed in the sideframe of FIG. 1*a*, in combination with a four cornered damper arrangement, as indicated in FIGS. 1*a*–1*d*. In this embodiment the truck may be a Barber S2HD truck, modified to carry a damper arrangement, such as a four-cornered damper arrangement, such as may have an enhanced restorative tendency in the face of non-square deformation of the truck, having dampers that may include friction surfaces as described herein.

FIGS. 10*a*–10*e*

Figures 10A, 10B, 10C, 10D, 10E, 10F:
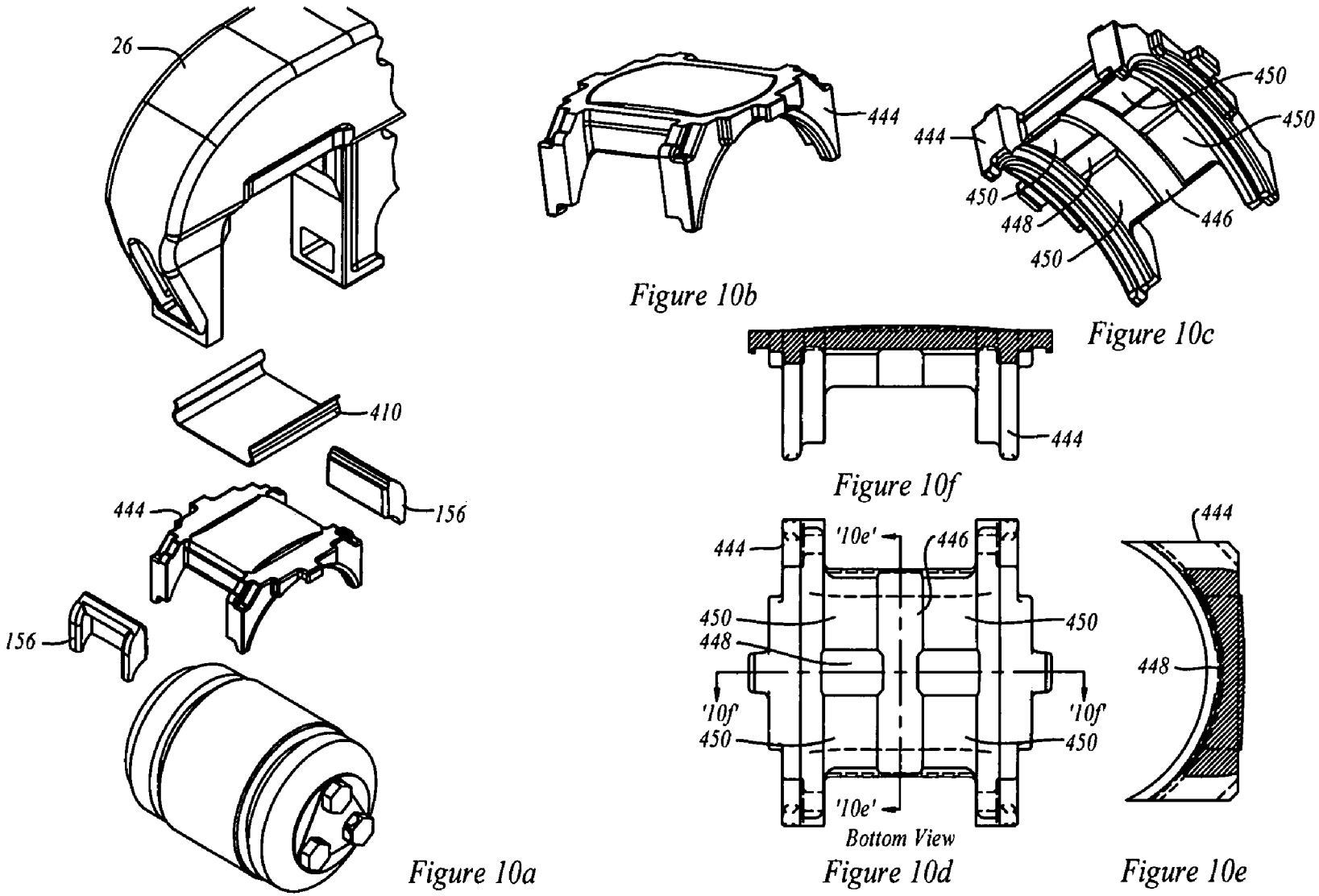
FIG. 10*a* shows an exploded isometric view of an alternate assembly to that of FIG. 3*a;*
FIG. 10*b* shows a perspective view of a bearing adapter of the assembly of FIG. 10*a* from above and to one corner.
FIG. 10*c* shows a perspective of the bearing adapter of FIG. 10*b* from below.
FIG. 10*d* shows a bottom view of the bearing adapter of FIG. 10*b;*
FIG. 10*e* shows a longitudinal section of the bearing adapter of FIG. 10*b* taken on section '10*e*—10*e*' of FIG. 10*d*.
FIG. 10*f* shows a transverse section of the bearing adapter of FIG. 10*b* taken on section '10*f*—10*f*' of FIG. 10*d;*

FIG. 10*a* shows a further alternate embodiment of wheelset to sideframe interface assembly to that of FIG. 3*a* or FIG. 8*a*. In this instance, bearing adapter 444 may have an upper rocker surface of any of the configurations discussed above, or may have a rocker element in the manner of bearing adapter 344.

The underside of bearing adapter 444 may have not only a circumferentially extending medial groove, channel or rebate 446, having an apex lying on the transverse plane of symmetry of bearing adapter 444, but also a laterally extending underside rebate 448 such as may tend to lie parallel to the underlying longitudinal axis of the wheelset shaft and bearing centreline (i.e., the axial direction) such that the underside of bearing adapter 444 has four corner lands or pads 450 arranged in an array for seating on the casing of the bearing. In this instance, each of the pads, or lands, may be formed on a curved surface having a radius conforming to a body of revolution such as the outer shell of the bearing. Rebate 448 may tend to lie along the apex of the arch of the underside of bearing adapter 444, with the intersection of rebates 446 and 448. Rebate 448 may be relatively shallow, and may be gently radiused into the surrounding bearing adapter body. The body of bearing adapter 444 is more or less symmetrical about both its longitudinal central vertical plane (i.e., on installation, that plane lying vertical and parallel to, if not coincident with, the longitudinal vertical central plane of the sideframe), and also about its transverse central plane (i.e., on installation, that plane extending vertically radially from the center line of the axis of rotation of the bearing and of the wheelset shaft). It may be noted that axial rebate 448 may tend to lie at the section of minimum cross-sectional area of bearing adapter 444. In the view of the present inventors, rebates 446 and 448 may tend to divide, and spread, the vertical load carried through the rocker element over a larger area of the casing of the bearing, and hence to more evenly distribute the load into the elements of the bearing than might otherwise be the case. It is thought that this may tend to encourage longer bearing life.

In the general case, bearing adapter 444 may have an upper surface having a crown to permit self-steering, or may be formed to accommodate a self-steering apparatus such as an elastomeric pad, such as a Pennsy Pad or other pad. In the event that a rocker surface is employed, whether by way of a separable insert, or a disc, or is integrally formed in the body of the bearing adapter, the location of the contact of the rocker in the resting position may tend to lie directly above the center of the bearing adapter, and hence above the intersection of the axial and circumferential rebates in the underside of bearing adapter 444.

FIGS. 11*a*–11*f*

FIGS. 11*a*–11*f* show views of a bearing adapter 452, a pedestal seat insert 454 and elastomeric bumper pad members 456, as an assembly for insertion between bearing 46 and sideframe 26. Bearing adapter 452 and pad members 456 are generally similar to bearing adapter 171 and members 156, respectively. They differ, however, insofar as bearing adapter 452 has thrust block standoff elements 460, 462 located at either end thereof, and the lower corners of bumpers 456 have been truncated accordingly. It may be that for a certain range of deflection, an elastomeric response is desired, and may be sufficient to accommodate a high percentage of in-service performance. However, excursion beyond that range of deflection might tend to cause damage, or reduction in life, to pad members 456. Standoff elements 460, 462 may act as limiting stops to bound that range of motion. Standoff elements 460, 462 may have the form of shelves, or abutments, or stops 466, 468 mounted to, and standing proud of, the laterally inwardly facing faces of the corner abutment portions 470, 472 of bearing adapter 452 more generally. As installed, stops 466, 468 underlie toes 474, 476 of members 456. As may be noted, toes 474, 476 have a truncated appearance as compared to the toes of member 356 in order to stand clear of stops 466, 468 on installation. In the at rest, centered condition, stops 466, 468 may tend to stand clear of the pedestal jaw thrust blocks by some gap distance. When the lateral deflection of the elastomer in member 456 reaches the gap distance, the thrust lug may tend to bottom against stop 466 or 468, as the case may be. The sheltering width of stops 466, 468 (i.e., the distance by which they stand proud of the inner face of corner abutment portions 470, 472 ) may tend to provide a reserve compression zone for wings 475, 477 and may thereby tend to prevent them from being unduly squeezed or pinched. Pedestal seat insert 454 may be generally similar to liner 354, but may include radiused bulges 480, 482, and a thicker central portion 484. Bearing adapter 452 may include a central bi-directional rocker portion 486 for mating rocking engagement with the downwardly facing rocking surface of central portion 484. The mating surfaces may conform to any of the combinations of bi-directional rocking radii discussed herein. Rocker portion 486 may be trimmed laterally as at longitudinally running side shoulders 488, 490 to accommodate bulges 480, 482.

Bearing adapter 452 may also have different underside grooving, 492 in the nature of a pair of laterally extending tapered lobate depressions, cavities, or reliefs 494, 496 separated by a central bridge region 498 having a deeper section and flanks that taper into reliefs 494, 496. Reliefs 494, 496 may have a major axis that runs laterally with respect to the bearing adapter itself, but, as installed, runs axially with respect to the axis of rotation of the underlying bearing. The absence of material at reliefs 494, 496 may tend to leave a generally H-shaped footprint on the circumferential surface 500 that seats upon the outside of bearing 46, in which the two side regions, or legs, of the H form lands or pads 502, 504 joined by a relatively narrow waist, namely bridge region 498. To the extent that the undersurface of the lower portion of bearing adapter 452 conforms to an arcuate profile, such as may accommodate the bearing casing, reliefs 494, 496 may tend to run, or extend, predominantly along the apex of the profile, between the pads, or lands, that lie to either side. This configuration may tend to spread the rocker rolling contact point load into pads 502, 504 and thence into bearing 46. Bearing life may be a function of peak load in the rollers. By leaving a space between the underside of the bearing adapter and the top center of the bearing casing over the bearing races, reliefs 494, 496 may tend to prevent the vertical load being passed in a concentrated manner predominantly into the top rollers in the bearing. Instead, it may be advantageous to spread the load between several rollers in each race. This may tend to be encouraged by employing spaced apart pads or lands, such as pads 502, 504, that seat upon the bearing casing. Central bridge region 498 may seat above a section of the bearing casing under which there is no race, rather than directly over one of the races. Bridge region 498 may act as a central circumferential ligature, or tension member, intermediate bearing adapter end arches 506, 508 such as may tend to discourage splaying or separation of pads 502, 504 away from each other as vertical load is applied.

FIGS. 12*a*–12*d*

Figure 11A:
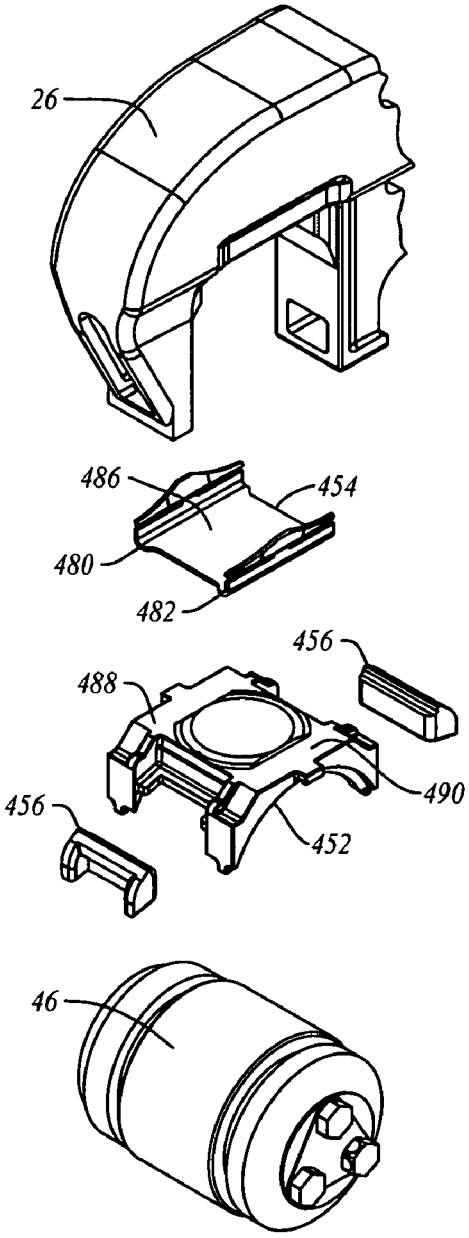
FIG. 11*a* is an exploded view of an alternate bearing adapter assembly to that of FIG. 3*a;*
Figure 11F:
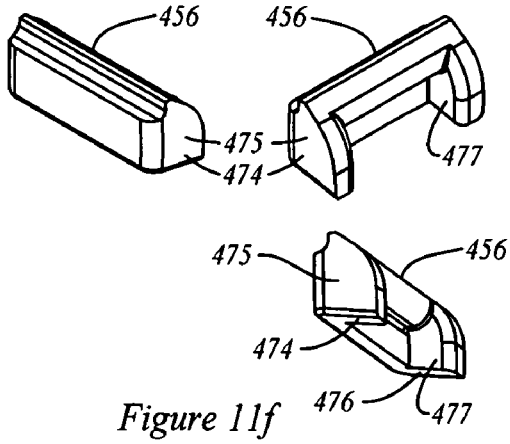
FIG. 11*f* is a set of views of a resilient pad member of the assembly of FIG. 11*a;*
Figure 11B:
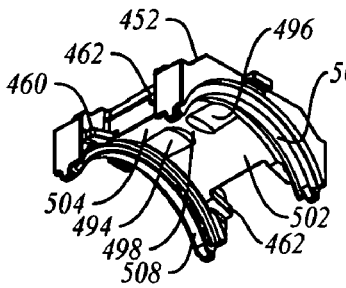
FIG. 11*b* shows a view of the bearing adapter of FIG. 11*a* from below and to one corner.
Figure 11G:
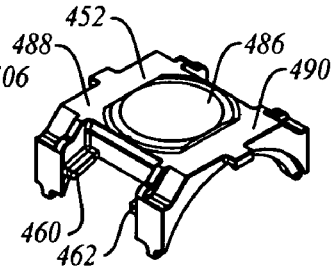
FIG. 11*g* shows a view of the bearing adapter of FIG. 11*a* from above and to one corner.
Figure 11C:
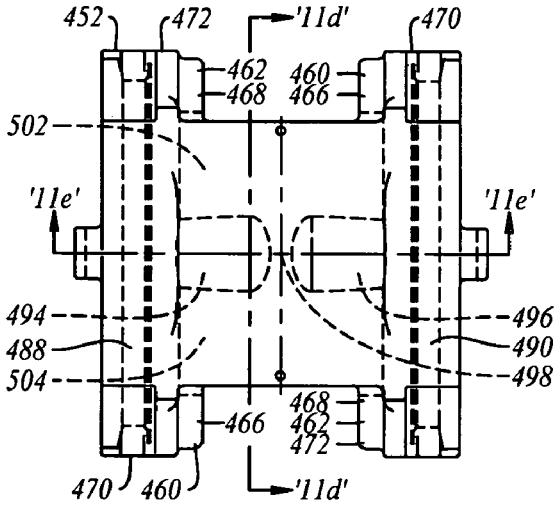
FIG. 11*c* is a top view of the bearing adapter of FIG. 11*b;*
Figure 11D:
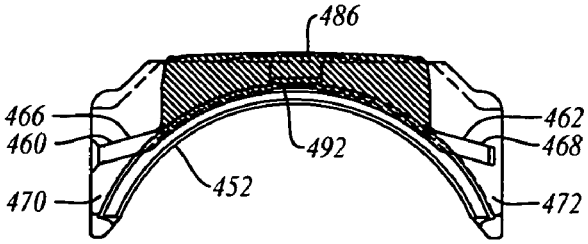
FIG. 11*d* is a lengthwise section of the bearing adapter of FIG. 11*c* on '11*d*—11*d*'.
Figure 11E:
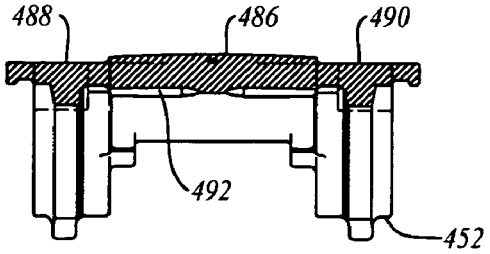
FIG. 11*e* is a cross-wise section of the bearing adapter of FIG. 11*c* on '11*e*—11*e*'.
Figure 12B:
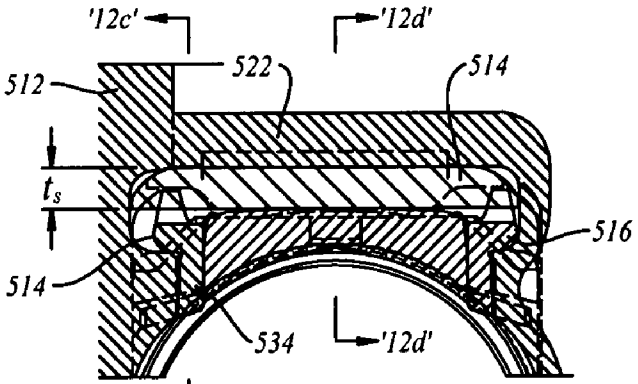
FIG. 12*b* shows a longitudinal central section of the assembly of FIG. 12*a*, as assembled.
Figure 12C:
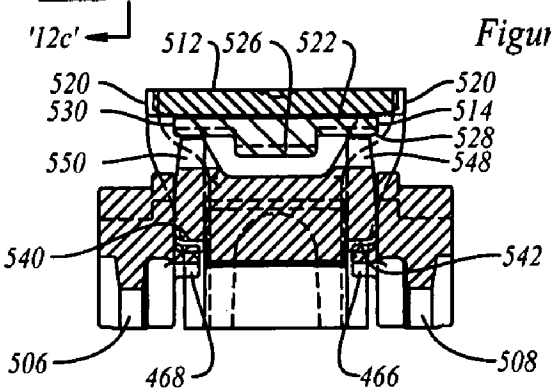
FIG. 12*c* shows a section on '12*c*—12*c*' of FIG. 12*b*.
Figure 12D:
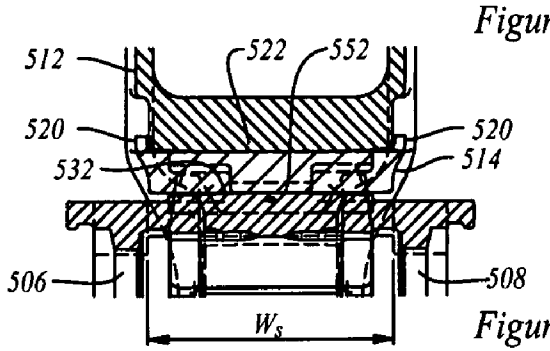
FIG. 12*d* shows a section on '12*d*—12*d*' of FIG. 12*b*.
Figure 12A:
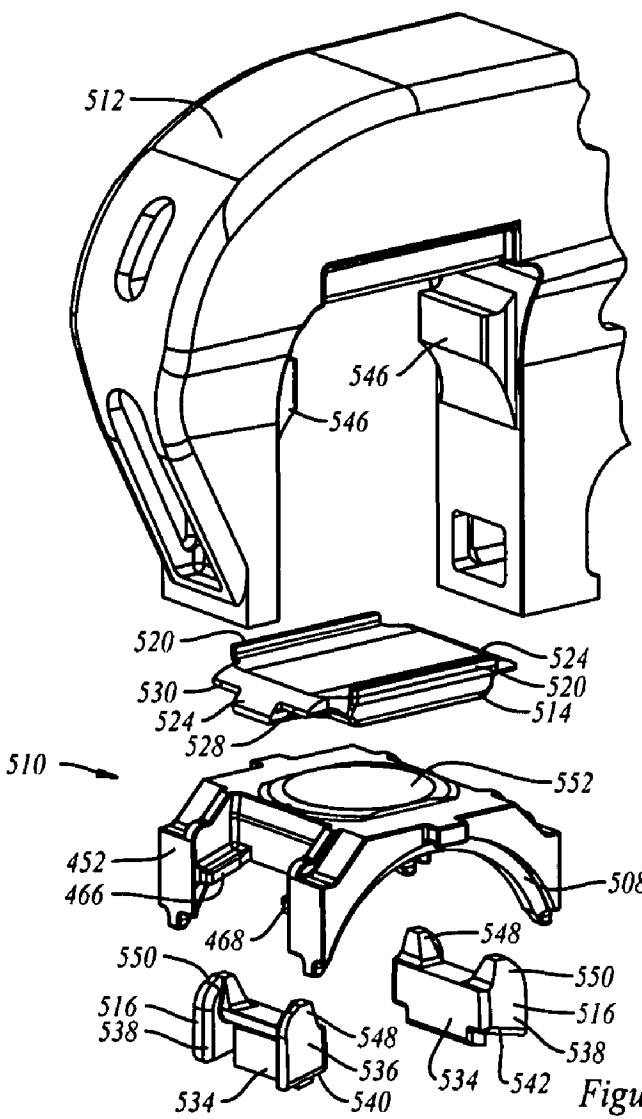
FIG. 12*a* shows an exploded isometric view of an alternate bearing adapter to pedestal seat assembly to that of FIG. 3*a;*

FIGS. 12*a* to 12*d* show an alternate assembly to that of FIG. 11*a*, indicated generally as 510 for seating in a sideframe 512. Bearing 46 and bearing adapter 452 may be as before. Assembly 510 may include an upper rocker fitting identified as pedestal seat member 514, and resilient members 516. Sideframe 512 may be such that the upper rocker fitting, namely pedestal seat member 514 may have a greater through thickness, $t_s$, than otherwise. This thickness, $t_s$ may be greater than 10% of the magnitude of the width $W_s$ of the pedestal seat member, and may be about 20 (+/−5) % of the width. In one embodiment the thickness may be roughly the same as the thickness of and 'LC pad' such as may be obtained from Lord Corporation. Such thickness may be greater than 7/16", and such thickness may be 1 inch (+/−1/8"). Pedestal seat member 514 may tend to have a greater thickness for enhancing the spreading of the rocker contact load into sideframe 512. It may also be used as part of a retro-fit installation in sideframes such as may formerly have been made to accommodate LC pads.

Pedestal seat member 514 may have a generally planar body 518 having upturned lateral margins 520 for bracketing, and seating about, the lower edges of the sideframe pedestal roof member 522. The major portion of the upper surface of body 518 may tend to mate in planar contact with the downwardly facing surface of roof member 522. Seat member 514 may have protruding end potions 524 that extend longitudinally from the main, planar portion of body 518. End portions 524 may include a deeper nose section 526, that may stand downwardly proud of two wings 528, 530. The depth of nose section 526 may correspond to the general through thickness depth of member 514. The lower, downwardly facing surface 532 of member 518 (as installed) may be formed to mate with the upper surface of the bearing adapter, such that a bi-directional rocking interface is achieved, with a combination of male and female rocking radii as described herein. In one embodiment the female rocking surface may be planar.

Resilient members 516 may be formed to engage protruding portions 524. That is, resilient member 516 may have the generally channel shaped for of resilient member 156, having a lateral web 534 standing between a pair of wings 536, 538. However, in this embodiment, web 534 may extend, when installed, to a level below the level of stops 466, 468, and the respective base faces 540, 542 of wings 536, 538 are positioned to sit above stops 466, 468. A superior lateral wall, or bulge, 544 surmounts the upper margin of web 534, and extends longitudinally, such as may permit it to overhang the top of the sideframe jaw thrust lug 546. The upper surface of bulge 544 may be trimmed, or flattened to accommodate nose section 526. The upper extremities of wings 536, 538 terminate in knobs, or prongs, or horns 548, 550 that stand upwardly proud of the flattened surface 552 of bulge 544. As installed, the upper ends of horns 548, 550 underlie the downwardly facing surfaces of wings 536, 538.

In the event that an installer might attempt to install bearing adapter 452 in sideframe 512 without first placing pedestal seat member 512 in position, the height of horns 548, 550 is sufficient to prevent the rocker surface of bearing adapter 452 from engaging sideframe roof member 522. That is, the height of the highest portion of the crown of the rocker surface 552 of the bearing adapter is less than the height of the ends of horns 548, 550 when horns 548, 550 are in contact with stops 466, 468. However, when pedestal seat member 512 is correctly in place, nose section 526 is located between wings 536, 538, and wings 536, 538 are captured above horns 548, 550. In this way, resilient members 514, and in particular horns 548, 550, act as installation error detection elements, or damage prevention elements.

The steps of installation may include the step of removing an existing bearing adapter, removing an existing elastomeric pad, such as an LC pad, installing pedestal seat fitting 514 in engagement with roof 522; seating of resilient members 514 above each of thrust lugs 546; and sliding bearing adapter 452 between resilient pad members 514. Resilient pad members 514 then serve to locate other elements on assembly, to retain those elements in service, and to provide a centering bias to the mating rocker elements, as discussed above.

Compound Pendulum Geometry

The various rockers shown and described herein may employ rocking elements that define compound pendulums—that is, pendulums for which the male rocker radius is non-zero, and there is an assumption of rolling (as opposed to sliding) engagement with the female rocker. The embodiment of FIG. 2*a* (and others) for example, shows a bidirectional compound pendulum. The performance of these pendulums may affect both lateral stiffness and self-steering on the longitudinal rocker.

The lateral stiffness of the suspension may tend to reflect the stiffness of (a) the sideframe between (i) the bearing adapter and (ii) the bottom spring seat (that is, the sideframes swing laterally); (b) the lateral deflection of the springs between (i) the lower spring seat and (ii) the upper spring seat mounting against the truck bolster, and (c) the moment between (i) the spring seat in the sideframe and (ii) the upper spring mounting against the truck bolster. The lateral stiffness of the spring groups may be approximately ½ of the vertical spring stiffness. For a 100 or 110 Ton truck designed for 263,000 or 286,000 lbs GWR, vertical spring group stiffness might be 25–30,000 Lbs./in., assuming two groups per truck, and two trucks per car, giving a lateral spring stiffness of 13–16,000 Lbs./in. The second component of stiffness relates to the lateral rocking deflection of the sideframe. The height between the bottom spring seat and the crown of the bearing adapter might be about 15 inches (+/−). The pedestal seat may have a flat surface in line contact on a 60 inch radius bearing adapter crown. For a loaded 286,000 lbs. car, the apparent stiffness of the sideframe due to this second component may be 18,000–25,000 Lbs./in, measured at the bottom spring seat. Stiffness due to the third component, unequal compression of the springs, is additive to sideframe stiffness. It may be of the order of 3000–3500 Lbs./in per spring group, depending on the stiffness of the springs and the layout of the group. The total lateral stiffness for one sideframe for an S2HD 110 Ton truck may be about 9200 Lbs./inch per side frame.

An alternate truck is the "Swing Motion" truck, such as shown at page 716 in the 1980 *Car and Locomotive Cyclopedia* (1980, Simmons-Boardman, Omaha). In a swing motion truck, the sideframe may act more like a pendulum. The bearing adapter has a female rocker, of perhaps 10 in. radius. A mating male rocker mounted in the pedestal roof may have a radius of perhaps 5 in. Depending on the geometry, this may yield a sideframe resistance to lateral deflection in the order of ¼ (or less) to about ½ of what might otherwise be typical. If combined with the spring group stiffness, the relative softness of the pendulum may be dominant. Lateral stiffness may then be less governed by vertical spring stiffness. Use of a rocking lower spring seat may reduce, or eliminate, lateral stiffness due to unequal spring compression. Swing motion trucks have used transoms to link the side frames, and to lock them against non-square deformation. Other substantially rigid truck stiffening devices such as lateral unsprung rods or a "frame brace" of diagonal unsprung bracing have been used. Lateral unsprung bracing may increase resistance to rotation of the sideframes about the long axis of the truck bolster.

A formula may be used for estimation of truck lateral stiffness:

$$k_{truck}=2\times[(k_{sideframe})^{-1}+(k_{spring\ shear})^{-1}]^{-1}$$

where $k_{sideframe}=[k_{pendulum}+k_{spring\ moment}]$ $k_{spring\ shear}$=The lateral spring constant for the spring group in shear.

$k_{pendulum}$=The force required to deflect the pendulum per unit of deflection, as measured at the center of the bottom spring seat.

$k_{spring\ moment}$=The force required to deflect the bottom spring seat per unit of sideways deflection against the twisting moment caused by the unequal compression of the inboard and outboard springs.

In a pendulum, the relationship of weight and deflection is roughly linear for small angles, analogous to F=kx, in a spring. A lateral constant can be defined as $k_{pendulum}=W/L$, where W is weight, and L is pendulum length. An approximate equivalent pendulum length can be defined as $L_{eq}=W/k_{pendulum}$. W is the sprung weight on the sideframe. For a truck having L=15 and a 60" crown radius, $L_{eq}$ might be about 3 in. For a swing motion truck, $L_{eq}$ may be more than double this.

A formula for a longitudinal (i.e., self-steering) rocker as in FIG. 2*a*, may also be defined:

$$F/\delta_{long}=k_{long}=(W/L)[[(1/L)/(1/r_1-1/R_1)]-1]$$

Where:

$k_{long}$ is the longitudinal constant of proportionality between longitudinal force and longitudinal deflection for the rocker.

F is a unit of longitudinal force, applied at the centerline of the axle $\delta_{long}$ is a unit of longitudinal deflection of the centreline of the axle L is the distance from the centreline of the axle to the apex of male portion 116.

$R_1$ is the longitudinal radius of curvature of the female hollow in the pedestal seat 38.

$r_1$ is the longitudinal radius of curvature of the crown of the male portion 116 on the bearing adapter In this relationship, $R_1$ is greater than $r_1$, and (1/L) is greater than $[(1/r_1)-(1/R_1)]$, and, as shown in the illustrations, L is smaller than either $r_1$ or $R_1$. In some embodiments herein, the length L from the center of the axle to apex of the surface of the bearing adapter, at the central rest position may typically be about 5¾ to 6 inches (+/−), and may be in the range of 5–7 inches. Bearing adapters, pedestals, side frames, and bolsters are typically made from steel. The present inventor is of the view that the rolling contact surface may preferably be made of a tool steel, or a similar material.

In the lateral direction, an approximation for small angular deflections is:

$$k_{pendulum}=(F_2/\delta_2)=(W/L_{pend.})[[(1/L_{pend.})/((1/R_{Rocker})-(1/R_{Seat}))]+1]$$

where:

$k_{pendulum}$=the lateral stiffness of the pendulum $F_2$=the force per unit of lateral deflection applied at the bottom spring seat $\delta_2$=a unit of lateral deflection W=the weight borne by the pendulum $L_{pend.}$=the length of the pendulum, as undeflected, between the contact surface of the bearing adapter to the bottom of the pendulum at the spring seat $R_{Rocker}=r_2$=the lateral radius of curvature of the rocker surface $R_{Seat}=R_2$=the lateral radius of curvature of the rocker seat Where $R_{Seat}$ and $R_{Rocker}$ are of similar magnitude, and are not unduly small relative to L, the pendulum may tend to have a relatively large lateral deflection constant. Where $R_{Seat}$ is large compared to L or $R_{Rocker}$, or both, and can be approximated as infinite (i.e., a flat surface), this formula simplifies to:

$$k_{pendulum}=(F_{lateral}/\delta_{lateral})=(W/L_{pend.})[(R_{Rocker}/L_{pendulum})+1]$$

Using this number in the denominator, and the design weight in the numerator yields an equivalent pendulum length, $L_{eq.}=W/k_{pendulum}$ The sideframe pendulum may have a vertical length measured (when undeflected) from the rolling contact interface at the upper rocker seat to the bottom spring seat of between 12 and 20 inches, perhaps between 14 and 18 inches. The equivalent length $L_{eq}$, may be in the range of greater than 4 inches and less than 15 inches, and, more narrowly, 5 inches and 12 inches, depending on truck size and rocker geometry. Although truck 20 or 22 may be a 70 ton special, a 70 ton, 100 ton, 110 ton, or 125 ton truck, truck 20 or 22 may be a truck size having 33 inch diameter, or 36 or 38 inch diameter wheels. In some embodiments herein, the ratio of male rocker radius $R_{Rocker}$ to pendulum length, $L_{pend.}$, may be 3 or less, in some instances 2 or less. In laterally quite soft trucks this value may be less than 1. The factor $[(1/L_{pend.})/((1/R_{Rocker})-(1/R_{Seat}))]$, may be less than 3, and, in some instances may be less than 2½. In laterally quite soft trucks, this factor may be less than 2. In those various embodiments, the lateral stiffness of the lateral rocker pendulum, calculated at the maximum truck capacity, or the GWR limit for the railcar more generally, may be less than the lateral shear stiffness of the associated spring group. Further, in those various embodiments the truck may be free of lateral unsprung bracing, whether in terms of a transom, laterally extending parallel rods, or diagonally criss-crossing frame bracing or other unsprung stiffeners. In those embodiments the trucks may have four cornered damper groups driven by each spring group.

In the trucks described herein, for their fully laden design condition which may be determined either according to the AAR limit for 70, 100, 110 or 125 ton trucks, or, where a lower intended lading is chosen, then in proportion to the vertical sprung load yielding 2 inches of vertical spring deflection in the spring groups, the equivalent lateral stiffness of the sideframe, being the ratio of force to lateral deflection, measured at the bottom spring seat, may be less than the horizontal shear stiffness of the springs. In some embodiments, particularly for relatively low density fragile, high valued lading such as automobiles, consumer goods, and so on. The equivalent lateral stiffness of the sideframe $k_{sideframe}$ may be less than 6000 lbs./in. and may be between about 3500 and 5500 lbs./in., and perhaps in the range of 3700–4100 lbs./in. For example, in one embodiment a 2×4 spring group has 8 inch diameter springs having a total vertical stiffness of 9600 lbs./ in. per spring group and a corresponding lateral shear stiffness $k_{spring\ shear}$ of 8200 lbs./in. The sideframe has a rigidly mounted lower spring seat. It may be used in a truck with 36 inch wheels. In another embodiment, a 3×5 group of 5½ inch diameter springs is used, also having a vertical stiffness of about 9600 lbs./in., in a truck with 36 inch wheels. It may be that the vertical spring stiffness per spring group lies in the range of less than 30,000 lbs./in., that it may be in the range of less than 20,000 lbs./in and that it may perhaps be in the range of 4,000 to 12000 lbs./in, and may be about 6000 to 10,000 lbs./in. The twisting of the springs may have a stiffness in the range of 750 to 1200 lbs./in. and a vertical shear stiffness in the range of 3500 to 5500 lbs./in. with an overall sideframe stiffness in the range of 2000 to 3500 lbs./in.

In the embodiments of trucks having a fixed bottom spring seat, the truck may have a portion of stiffness, attributable to unequal compression of the springs equivalent to 600 to 1200 lbs./in. of lateral deflection, when the lateral deflection is measured at the bottom of the spring seat on the sideframe. This value may be less than 1000 lbs./in., and may be less than 900 lbs./in. The portion of restoring force attributable to unequal compression of the springs may tend to be greater for a light car as opposed to a fully laden car.

Some embodiments, including those that may be termed swing motion trucks, may have one or more features, namely that, in the lateral swinging direction r/R.<0.7; 3<r<30, or more narrowly, 4<r<20; and 5<R<45, or more narrowly, 8<R<30, and in lateral stiffness, 2,000 lbs/in<$k_{pendulum}$<10,000 lbs/in, or expressed differently, the lateral pendulum stiffness in pounds per inch of lateral deflection at the bottom spring seat where vertical loads are passed into the sideframe, per pound of weight carried by the pendulum, may be in the range of 0.08 and 0.2, or, more narrowly, 0.10 to 0.16.

Friction Surfaces

Dynamic response may be quite subtle. It is advantageous to reduce resistance to curving, and self steering may help in this regard. It is advantageous to reduce the tendency for wheel lift to occur. A reduction in stick-slip behaviour in the dampers may improve performance in this regard. Employment of dampers having roughly equal upward and downward friction forces may discourage wheel lift. Wheel lift may be sensitive to a reduction in torsional linkage between the sideframes, as when a transom or frame brace is removed. While it may be desirable torsionally to decouple the sideframes it may also be desirable to supplant a physically locked relationship with a relationship that allows the truck to flex in a non-square manner, subject to a bias tending to return the truck to its squared position such as may be obtained by employing the larger resistive moment couple of doubled dampers as compared to single dampers. While use of laterally softy rockers, dampers with reduced stick slip behaviour, four-cornered damper arrangements, and self steering may all be helpful in their own right, it appears that they may also be inter-related in a subtle and unexpected manner. Self steering may function better where there is a reduced tendency to stick slip behaviour in the dampers. Lateral rocking in the swing motion manner may also function better where the dampers have a reduced tendency to stick slip behaviour. Lateral rocking in the swing motion manner may tend to work better where the dampers are mounted in a four cornered arrangement. Counter-intuitively, truck hunting may not worsen significantly when the rigidly locked relationship of a transom or frame brace is replaced by four cornered dampers (apparently making the truck softer, rather than stiffer), and where the dampers are less prone to stick slip behaviour. The combined effect of these features may be surprisingly interlinked.

In the various truck embodiments described herein, there is a friction damping interface between the bolster and the sideframes. Either the sideframe columns or the damper (or both) may have a low or controlled friction bearing surface, that may include a hardened wear plate, that may be replaceable if worn or broken, or that may include a consumable coating or shoe, or pad. That bearing face of the motion calming, friction damping element may be obtained by treating the surface to yield desired co-efficients of static and dynamic friction whether by application of a surface coating, and insert, a pad, a brake shoe or brake lining, or other treatment. Shoes and linings may be obtained from clutch and brake lining suppliers, of which one is Railway Friction Products. Such a shoe or lining may have a polymer based or composite matrix, loaded with a mixture of metal or other particles of materials to yield a specified friction performance.

That friction surface may, when employed in combination with the opposed bearing surface, have a co-efficient of static friction, $\mu_s$, and a co-efficient of dynamic or kinetic friction, $\mu_k$. The coefficients may vary with environmental conditions. For the purposes of this description, the friction coefficients will be taken as being considered on a dry day condition at 70 F. In one embodiment, when dry, the coefficients of friction may be in the range of 0.15 to 0.45, may be in the narrower range of 0.20 to 0.35, and, in one embodiment, may be about 0.30. In one embodiment that coating, or pad, may, when employed in combination with the opposed bearing surface of the sideframe column, result in coefficients of static and dynamic friction at the friction interface that are within 20%, or, more narrowly, within 10% of each other. In another embodiment, the coefficients of static and dynamic friction are substantially equal.

coating, or pad, or lining, may be a polymeric element, or an element having a polymeric or composite matrix loaded with suitable friction materials. It may be obtained from a brake or clutch lining manufacturer, or the like. One such firm that may be able to provide such friction materials is Railway Friction Products of 13601 Laurinburg Maxton Ai, Maxton N.C.; another may be Quadrant EPP USA, Inc., of 2120 Fairmont Ave., Reading Pa. In one embodiment, the material may be the same as that employed by the Standard Car Truck Company in the "Barber Twin Guard" (t.m.) damper wedge with polymer covers. In one embodiment the material may be such that a coating, or pad, may, when employed with the opposed bearing surface of the sideframe column, result in coefficients of static and dynamic friction at the friction interface that are within 20%, or more narrowly, within 10% of each other. In another embodiment, the coefficients of static and dynamic friction are substantially equal. The co-efficient of dynamic friction may be in the range of 0.15 to 0.30, and in one embodiment may be about 0.20.

A damper may be provided with a friction specific treatment, whether by coating, pad or lining, on both the vertical friction face and the slope face. The coefficients of friction on the slope face need not be the same as on the friction face, although they may be. In one embodiment it may be that the coefficients of static and dynamic friction on the friction face may be about 0.3, and may be about equal to each other, while the coefficients of static and dynamic friction on the slope face may be about 0.2, and may be about equal to each other. In either case, whether on the vertical bearing face against the sideframe column, or on the sloped face in the bolster pocket, the present inventors consider it to be advantageous to avoid surface pairings that may tend to lead to galling, and stick-slip behaviour.

Spring Groups

The main spring groups may have a variety of spring layouts. Among various double damper embodiments of spring layout are the following:

| | | | | | | | | | | | | | | | | | |
|---|---|---|---|---|---|---|---|---|---|---|---|---|---|---|---|---|---|
| $D_1$ | $X_1$ | $D_3$ | $D_1$ | $X_1$ | $D_3$ | $D_1$ | $X_1$ | $D_3$ | $D_1$ | $X_1$ | $X_2$ | $X_3$ | $D_3$ | $D_1$ | $X_1$ | $X_2$ | $D_3$ |
| $X_2$ | $X_3$ | $X_4$ | $X_2$ | $X_4$ | $X_3$ | $D_2$ | $X_2$ | $D_4$ | $X_4$ | $X_5$ | $X_6$ | $X_7$ | $X_8$ | $D_2$ | $X_3$ | $X_4$ | $D_4$ |
| $D_2$ | $X_5$ | $D_4$ | $D_2$ | | $D_4$ | | $X_3$ | | $D_2$ | $X_9$ | $X_{10}$ | $X_{11}$ | $D_4$ | | | | |
| 3 × 3 | | | 3:2:3 | | | 2:3:2 | | | 3 × 5 | | | | | 2 × 4 | | | |

Sloped Wedge Surface

Where damper wedges are employed, a generally low friction, or controlled friction pad or coating may also be employed on the sloped surface of the damper that engages the wear plate (if such is employed) of the bolster pocket where there may be a partially sliding, partially rocking dynamic interaction. The present inventors consider the use of a controlled friction interface between the slope face of the wedge and the inclined face of the bolster pocket, in which the combination of wear plate and friction member may tend to yield coefficients of friction of known properties, to be advantageous. In some embodiments those coefficients may be the same, or nearly the same, and may have little or no tendency to exhibit stick-slip behaviour, or may have a reduced stick-slip tendency as compared to cast iron on steel. Further, the use of brake linings, or inserts of cast materials having known friction properties may tend to permit the properties to be controlled within a narrower, more predictable and more repeatable range such as may yield a reasonable level of consistency in operation. The In these groups, $D_i$ represents a damper spring, and $X_i$ represents a non-damper spring.

In the context of 100 Ton or 110 Ton trucks, the inventors propose spring and damper combinations lying within 20% (and preferably within 10%) of the following parameter envelopes:

(a) For a four wedge arrangement with all steel or iron damper surfaces, an envelope having an upper boundary according to $k_{damper}=2.41(\theta_{wedge})^{1.76}$, and a lower boundary according to $k_{damper}=1.21(\theta_{wedge})^{1.76}$.

(b) For a four wedge arrangement with all steel or iron damper surfaces, a mid range zone of $k_{damper}=1.81(\theta_{wedge})^{1.76}$(+/−20%).

(c) For a four wedge arrangement with non-metallic damper surfaces, such as may be similar to brake linings, an envelope having an upper boundary according to $k_{damper}=4.84(\theta_{wedge})^{1.64}$, and a lower a lower boundary according to $k_{damper}=2.42(\theta_{wedge})^{1.64}$ where the wedge angle may lie in the range of 30 to 60 degrees.

(d) For a four wedge arrangement with non-metallic damper surfaces, a mid range zone of $k_{damper}=3.63(\theta_{wedge})^{1.64}$ (+/−20%).

Where $k_{damper}$ is the side spring stiffness under each damper in lbs/in/damper $\theta_{wedge}$—is the associated primary wedge angle, in degrees $\theta_{wedge}$ may tend to lie in the range of 30 to 60 degrees. In other embodiments $\theta_{wedge}$ may lie in the range of 35–55 degrees, and in still other embodiments may tend to lie in the narrower range of 40 to 50 degrees.

It may be advantageous to have upward and downward damping forces that are not overly dissimilar, and that may in some cases tend to be roughly equal. Frictional forces at the dampers may differ depending on whether the damper is being loaded or unloaded. The angle of the wedge, the coefficients of friction, and the springing under the wedges can be varied. A damper is being "loaded" when the bolster is moving downward in the sideframe window, since the spring force is increasing, and hence the force on the damper is increasing. Similarly, a damper is being "unloaded" when the bolster is moving upward toward the top of the sideframe window, since the force in the springs is decreasing. The equations can be written as:

$$\text{While loading:}\quad F_d = \mu_c F_s \frac{(\mathrm{Cot}(\Phi) - \mu_s)}{(1 + (\mu_s - \mu_c)\,\mathrm{Cot}(\Phi) + \mu_s\mu_c)}$$

$$\text{While unloading:}\quad F_d = \mu_c F_s \frac{(\mathrm{Cot}(\Phi) + \mu_s)}{(1 + (\mu_c - \mu_s)\,\mathrm{Cot}(\Phi) + \mu_s\mu_c)}$$

Where: $F_d$=friction force on the sideframe column $F_s$=force in the spring $\mu_s$=coefficient of friction on the angled slope face on the bolster $\mu_c$=the coefficient of friction against the sideframe column $\Phi$=the included angle between the angled face on the bolster and the friction face bearing against the column For a given angle, a friction load factor, $C_f$ can be determined as $C_f=F_d/F_s$. This load factor $C_f$ will tend to be different depending on whether the bolster is moving up or down.

It may be advantageous to have different vertical spring rates in the empty and fully loaded conditions. To that end springs of different heights may be employed, for example, to yield two or more vertical spring rates for the entire spring group. In this way, the dynamic response in the light car condition may be different from the dynamic response in a fully loaded car, where two spring rates are used. Alternatively, if three (or more) spring rates are used, there may be an intermediate dynamic response in a semi-loaded condition. In one embodiment, each spring group may have a first combination of springs that have a free length of at least a first height, and a second group of springs of which each spring has a free length that is less than a second height, the second height being less than the first height by a distance $\delta_1$, such that the first group of springs will have a range of compression between the first and second heights in which the spring rate of the group has a first value, namely the sum of the spring rates of the first group of springs, and a second range in which the spring rate of the group is greater, namely that of the first group plus the spring rate of at least one of the springs whose free height is less than the second height. The different spring rate regimes may yield corresponding different damping regimes.

For example, in one embodiment a car having a dead sprung weight (i.e., the weight of the car body with no lading excluding the unsprung weight below the main spring such as the sideframes and wheelsets), of about 35,000 to about 55,000 lbs (+/−5000 lbs) may have spring groups of which a first portion of the springs have a free height in excess of a first height. The first height may, for example be in the range of about 9¾ to 10¼ inches. When the car sits, unladen, on its trucks, the springs compress to that first height. When the car is operated in the light car condition, that first portion of springs may tend to determine the dynamic response of the car in the vertical bounce, pitch-and-bounce, and side-to-side rocking, and may influence truck hunting behaviour. The spring rate in that first regime may be of the order of 12,000 to 22,000 lbs/ in., and may be in the range of 15,000 to 20,000 lbs/in.

When the car is more heavily laden, as for example when the combination of dead and live sprung weight exceeds a threshold amount, which may correspond to a per car amount in the range of perhaps 60,000 to 100,000 lbs, (that is, 15,000 to 25,000 lbs per spring group for symmetrical loading, at rest) the springs may compress to, or past, a second height. That second height may be in the range of perhaps 8½ to 9¾ inches, for example. At this point, the sprung weight is sufficient to begin to deflect another portion of the springs in the overall spring group, which may be some or all of the remaining springs, and the spring rate constant of the combined group of the now compressed springs in this second regime may tend to be different, and larger than, the spring rate in the first regime. For example, this larger spring rate may be in the range of about 20,000–30,000 lbs/in., and may be intended to provide a dynamic response when the sum of the dead and live loads exceed the regime change threshold amount. This second regime may range from the threshold amount to some greater amount, perhaps tending toward an upper limit, in the case of a 110 Ton truck, of as great as about 130,000 or 135,000 lbs per truck. For a 100 Ton truck this amount may be 115,000 or 120,000 lbs per truck.

Table 1 gives a tabulation of a number of spring groups that may be employed in a 100 or 110 Ton truck, in symmetrical 3×3 spring layouts and that have dampers in four-cornered groups. The last entry in Table 1 is a symmetrical 2:3:2 layout of springs. The term "side spring" refers to the spring, or combination of springs, under each of the individually sprung dampers, and the term "main spring" referring to the spring, or combination of springs, of each of the main coil groups:

TABLE 1

| Spring Group Combinations | | | | | | |
|---|---|---|---|---|---|---|
| Group | D7-G1 | D7-G2 | D7-G3 | D7-G4 | D7-G5 | D5-G1 |
| Main Springs | 5 * D7-O | 5 * D7-O | 5 * D7-O | 5 * D7-O | 5 * D7-O | 5 * D5-O |
| | 5 * D6-I | 5 * D6-I | 5 * D8-I | 5 * D8-I | 5 * D7-I | 5 * D6-I |
| | 5 * D6A | 5 * D6A | 5 * D8A | 5 * D8A | 5 * D8A | — |
| Side Springs | 4 * B353 | 4 * B353 | 4 * NSC-1 | 4 * B353 | 4 * B353 | 4 * B432 |
| | — | 4 * B354 | 4 * B354 | 4 * NSC-2 | 4 * NSC-2 | 4 * B433 |
| Group | D5-G2 | D5-G3 | D5-G4 | D5-G5 | D5-G6 | D5-G7 |
| Main Springs | 5 * D5-O | 5 * D5-O | 5 * D5-O | 5 * D5-O | 5 * D5-O | 5 * D5-O |
| | 5 * D6-I | 5 * D6-I | 5 * D8-I | 5 * D8-I | 5 * D6-I | 5 * D6-I |
| | 5 * D6A | — | 5 * D8A | 5 * D6A | 5 * D6A | — |
| Side Springs | 4 * B432 | 4 * B353 | 4 * B353 | 4 * B353 | 4 * B353 | 4 * B353 |
| | 4 * B433 | 4 * B354 | 4 * B354 | 4 * B354 | 4 * B354 | 4 * B354 |
| Group | D5-G8 | D5-G9 | D5-G10 | D5-G11 | D5-G12 | NSC 232-1 |
| Main Springs | 5 * D5-O | 5 * D5-O | 5 * D5-O | 5 * D5-O | 5 * D5-O | 3 * D51-O |
| | 5 * D6-I | 5 * D6-I | 5 * D8-I | 5 * D8-I | 5 * D5-I | 3 * D61-I |
| | 5 * D6B | 5 * D6A | 5 * D8A | 5 * D8A | 5 * D6B | 3 * D61A |
| Side Springs | 4 * NSC-1 | 4 * NSC-1 | 4 * NSC-1 | 4 * NSC-1 | 4 * B353 | 4 * B353-O |
| | 4 * NSC-2 | 4 * B354 | 4 * B354 | 4 * NSC-2 | 4 * NSC-2 | 4 * B354-I |

In this tabulation, the terms NSC-1, NSC-2, D8, D8A and D6B refer to springs of non-standard size proposed by the present inventors. The properties of these springs are given in Table 2a (main springs) and 2b (side springs), along with the properties of the other springs of Table 1.

TABLE 2a

| Main Spring Parameters | | | | | | | |
|---|---|---|---|---|---|---|---|
| Main Springs | Free Height (in) | Rate (lbs/in) | Solid Height (in) | Free to Solid (in) | Solid Capacity (lbs) | Diameter (in) | d - Wire Diameter (in) |
| D5 Outer | 10.2500 | 2241.6 | 6.5625 | 3.6875 | 8266 | 5.500 | 0.9531 |
| D51 Outer | 10.2500 | 2980.6 | 6.5625 | 3.6875 | 10991 | 5.500 | 1.0000 |
| D5 Inner | 10.3125 | 1121.6 | 6.5625 | 3.7500 | 4206 | 3.3750 | 0.6250 |
| D6 Inner | 9.9375 | 1395.2 | 6.5625 | 3.3750 | 4709 | 3.4375 | 0.6563 |
| D61 Inner | 10.1875 | 1835.9 | 6.5625 | 3.6250 | 6655 | 3.4375 | 0.6875 |
| D6A Inner Inner | 9.0000 | 463.7 | 6.5625 | 3.3125 | 1536 | 2.0000 | 0.3750 |
| D61A Inner Inner | 10.0000 | 823.6 | 5.6875 | 3.4375 | 2831 | 2.0000 | 0.3750 |
| D7 Outer | 10.8125 | 2033.6 | 6.5625 | 4.2500 | 8643 | 5.5000 | 0.9375 |
| D7 Inner | 10.7500 | 980.8 | 6.5625 | 4.1875 | 4107 | 3.5000 | 0.6250 |
| D6B Inner Inner | 9.7500 | 575.0 | 6.5625 | 3.1875 | 1833 | 2.0000 | 0.3940 |
| D8 Inner | 9.5500 | 1395.0 | 6.5625 | 2.9875 | 4168 | 3.4375 | 0.6563 |
| D8 Inner Inner | 9.2000 | 575.0 | 6.5625 | 2.6375 | 1517 | 2.0000 | 0.3940 |

TABLE 2b

| Side Spring Parameters | | | | | | | |
|---|---|---|---|---|---|---|---|
| Side Springs | Free Height (in) | Rate (lbs/in) | Solid Height (in) | Free to Solid (in) | Solid Capacity (lbs) | Coil Diameter (in) | d - Wire Diameter (in) |
| B353 Outer | 11.1875 | 1358.4 | 6.5625 | 4.6250 | 6283 | 4.8750 | 0.8125 |
| B354 Inner | 11.5000 | 577.6 | 6.5625 | 49375 | 2852 | 3.1250 | 0.5313 |
| B355 Outer | 10.7500 | 1358.8 | 6.5625 | 4.1875 | 5690 | 4.8750 | 0.8125 |
| B356 Inner | 10.2500 | 913.4 | 6.5625 | 3.6875 | 3368 | 3.1250 | 0.5625 |
| B432 Outer | 11.0625 | 1030.4 | 6.5625 | 4.5000 | 4637 | 3.8750 | 0.6719 |
| B433 Inner | 11.3750 | 459.2 | 6.5625 | 4.8125 | 2210 | 2.4063 | 0.4375 |
| 49427-1 Outer | 11.3125 | 1359.0 | 6.5625 | 4.7500 | 6455 | | |

TABLE 2b-continued

| Side Springs | Free Height (in) | Rate (lbs/in) | Solid Height (in) | Free to Solid (in) | Solid Capacity (lbs) | Coil Diameter (in) | d - Wire Diameter (in) |
|---|---|---|---|---|---|---|---|
| | Side Spring Parameters | | | | | | |
| 49427-2 Inner | 10.8125 | 805.0 | 6.5625 | 4.2500 | 3421 | | |
| B358 Outer | 10.7500 | 1546.0 | 6.5625 | 4.1875 | 6474 | 5.0000 | 0.8438 |
| B359 Inner | 11.3750 | 537.5 | 6.5625 | 4.8125 | 2587 | 3.1875 | 0.5313 |
| 52310-1 Outer | 11.3125 | 855.0 | 6.5625 | 4.7500 | 4061 | | |
| 52310-2 Inner | 8.7500 | 2444.0 | 6.5625 | 2.1875 | 5346 | | |
| 11-1-0562 Outer | 12.5625 | 997.0 | 6.5625 | 6.0000 | 5982 | | |
| 11-1-0563 Outer | 12.6875 | 480.0 | 6.5625 | 6.1250 | 2940 | | |
| NSC-1 Outer | 11.1875 | 952.0 | 6.5625 | 4.6250 | 4403 | 4.8750 | 0.7650 |
| NSC-2 Inner | 11.5000 | 300.0 | 6.5625 | 4.9375 | 1481 | 3.0350 | 0.4580 |

Table 3 provides a listing of truck parameters for a number of known trucks, and for trucks proposed by the present inventors. In the first instance, the truck embodiment identified as No. 1 may be taken to employ damper wedges in a four-cornered arrangement in which the primary wedge angle is 45 degrees and the damper wedges have steel bearing surfaces. In the second instance, the truck embodiment identified as No. 2, may be taken to employ damper wedges in a four-cornered arrangement in which the primary wedge angle is 40 degrees, and the damper wedges have non-metallic bearing surfaces.

TABLE 3

| | NACO Swing Motion | Barber S-2-E | Barber S-2-HD | ASF Super Service RideMaster | ASF Motion Control | No. 1 | No. 2 | No. 3 2:3:2 |
|---|---|---|---|---|---|---|---|---|
| | Truck Parameters | | | | | | | |
| Main Springs | 6 * D7-O<br>7 * D7-I<br>4 * D6A | 7 * D5-O<br>7 * D5-I | 6 * D5-O<br>7 * D6-I<br>4 * D6A | 7 * D5-O<br>7 * D5-I<br>2 * D6A | 7 * D5-O<br>5 * D5-I | 5 * D5-O<br>5 * D8-I<br>5 * D8A | 5 * D5-O<br>5 * D6-I<br>5 * D6A | 3 * D51-O<br>3 * D61-I<br>3 * D61-A |
| Side Springs | 2 * 49427-1<br>2 * 49427-2 | 2 * B353<br>2 * B354 | 2 * B353<br>2 * B354 | 2 * 5062<br>2 * 5063 | 2 * 5062<br>2 * 5063 | 2 * NSC-1<br>2 * B354 | 4 * B353<br>4 * B354 | 4 * B353<br>4 * B354 |
| $k_{empty}$ | 22414 | 27414 | 27088 | 26496 | 24253 | 17326 | 18952 | 22194 |
| $k_{loaded}$ | 25197 | 27414 | 28943 | 27423 | 24253 | 27177 | 28247 | 24664 |
| Solid | 103,034 | 105,572 | 105,347 | 107,408 | 96,735 | 98,773 | 107,063 | 97,970 |
| $H_{Empty}$ | 10.3504 | 9.9898 | 9.8558 | 10.0925 | 10.0721 | 9.9523 | 10.0583 | 10.0707 |
| $H_{Loaded}$ | 7.9886 | 7.9562 | 7.8748 | 8.0226 | 7.7734 | 7.7181 | 7.9679 | 7.8033 |
| $k_w$ | 4328 | 3872 | 3872 | 2954 | 2954 | 6118 | 7744 | 7744 |
| $k_w/k_{loaded}$ | 17.18 | 14.12 | 13.38 | 10.77 | 12.18 | 22.51 | 27.42 | 31.40 |
| Wedge α | 45 | 32 | 32 | 37.5 | 37.5 | 45 | 40 | 45 |
| $F_D$ (down) | 1549 | 3291 | 3291 | 1711 | 1711 | 2392 | 2455 | 2522 |
| $F_D$ (up) | 1515 | 1742 | 1742 | 1202 | 1202 | 2080 | 2741 | 2079 |
| Total $F_D$ | 3064 | 5033 | 5033 | 2913 | 2913 | 4472 | 5196 | 4601 |

In Table 3, the Main Spring entry has the format of the quantity of springs, followed by the type of spring. For example, the ASF Super Service Ride Master, in one embodiment, has 7 springs of the D5 Outer type, 7 springs of the D5 Inner type, nested inside the D5 Outers, and 2 springs of the D6A Inner-Inner type, nested within the D5 Inners of the middle row (i.e., the row along the bolster centerline). It also has 2 side springs of the 5052 Outer type, and 2 springs of the 5063 Inner type nested inside the 5062 Outers. The side springs would be the middle elements of the side rows underneath centrally mounted damper wedges.

$k_{empty}$ refers to the overall spring rate of the group in lbs/in for a light (i.e., empty) car.

$k_{loaded}$ refers to the spring rate of the group in lbs/in., in the fully laded condition.

"Solid" refers to the limit, in lbs, when the springs are compressed to the solid condition $H_{Empty}$ refers to the height of the springs in the light car condition $H_{Loaded}$ refers to the height of the springs in the at rest fully loaded condition $k_W$ refers to the overall spring rate of the springs under the dampers.

$k_W/k_{loaded}$ gives the ratio of the spring rate of the springs under the dampers. to the total spring rate of the group, in the loaded condition, as a percentage.

The wedge angle is the primary angle of the wedge, expressed in degrees.

$F_D$ is the friction force on the sideframe column. It is given in the upward and downward directions, with the last row giving the total when the upward and downward amounts are added together.

In various embodiments of trucks, such as truck 22, the resilient interface between each sideframe and the end of the truck bolster associated therewith may include a four cornered damper arrangement and a 3×3 spring group having one of the spring groupings set forth in Table 1. Those groupings may have wedges having primary angles lying in the range of 30 to 60 degrees, or more narrowly in the range of 35 to 55 degrees, more narrowly still in the range 40 to 50 degrees, or may be chosen from the set of angles of 32, 36, 40 or 45 degrees. The wedges may have steel surfaces, or may have friction modified surfaces, such as non-metallic surfaces.

The combination of wedges and side springs may be such as to give a spring rate under the side springs that is 20% or more of the total spring rate of the spring groups. It may be in the range of 20 to 30% of the total spring rate. In some embodiments the combination of wedges and side springs may be such as to give a total friction force for the dampers in the group, for a fully laden car, when the bolster is moving downward, that is less than 3000 lbs. In other embodiments the arithmetic sum of the upward and downward friction forces of the dampers in the group is less than 5500 lbs.

In some embodiments in which steel faced dampers are used, the sum of the magnitudes of the upward and downward friction forces may be in the range of 4000 to 5000 lbs. In some embodiments, the magnitude of the friction force when the bolster is moving upward may be in the range of ⅔ to ⅗ of the magnitude of the friction force when the bolster is moving downward. In some embodiments, the ratio of Fd(Up)/Fd(Down) may lie in the range of ¾ to ⅝. In some embodiments the ratio of Fd(Up)/Fd(Down) may lie in the range of ⅘ to ⅚, and in some embodiments the magnitudes may be substantially equal.

In some embodiments in which non-metallic friction surfaces are used, the sum of the magnitudes of the upward and downward friction force may be in the range of 4000 to 5500 lbs. In some embodiments, the magnitude of the friction force when the bolster is moving up, Fd(Up), to the magnitude of the friction force when the bolster is moving down, Fd(Down) may be in the range of ¾ to ⅝, may be in the range of 0.85 to 1.15. Further, those wedges may employ a secondary angle, and the secondary angle may be in the range of about 5 to 15 degrees.

Nos. 1 and 2

The inventors consider the combinations of parameters listed in Table 3 under the columns No. 1 and No. 2, to be advantageous. No. 1 may employ with steel on steel damper wedges and sideframe columns. No. 2 may employ non-metallic friction surfaces, that may tend not to exhibit stick-slip behaviour, for which the resultant static and dynamic friction coefficients are substantially equal. The friction coefficients of the friction face on the sideframe column may be about 0.3. The slope surfaces of the wedges may also work on a non-metallic bearing surface and may also tend not to exhibit stick slip behaviour. The coefficients of static and dynamic friction on the slope face may also be substantially equal, and may be about 0.2. Those wedges may have a secondary angle, and that secondary angle may be about 10 degrees.

No. 3

In some embodiments there may be a 2:3:2 spring group layout. In this layout the damper springs may be located in a four cornered arrangement in which each pair of damper springs is not separated by an intermediate main spring coil, and may sit side-by-side, whether the dampers are cheek-to-cheek or separated by a partition or intervening block. There may be three main spring coils, arranged on the longitudinal centreline of the bolster. The springs may be non-standard springs, and may include outer, inner, and inner-inner springs identified respectively as D51-O, D61-I, and D61-A in Tables 1, 2 and 3 above. The No. 3 layout may include wedges that have a steel-on-steel friction interface in which the kinematic friction co-efficient on the vertical face may be in the range of 0.30 to 0.40, and may be about 0.38, and the kinematic friction co-efficient on the slope face may be in the range of 0.12 to 0.20, and may be about 0.15. The wedge angle may be in the range of 45 to 60 degrees, and may be about 50 to 55 degrees. In the event that 50 (+/−) degree wedges are chosen, the upward and downward friction forces may be about equal (i.e., within about 10% of the mean), and may have a sum in the range of about 4600 to about 4800 lbs, which sum may be about 4700 lbs (+/−50). In the event that 55 degree (+/−) wedges are chosen, the upward and downward friction forces may again be substantially equal (within 10% of the mean), and may have a sum on the range of 3700 to 4100 Lbs, which sum may be about 3850–3900 lbs.

Alternatively, in other embodiments employing a 2:3:2 spring layout, non-metallic wedges may be employed. Those wedges may have a vertical face to sideframe column co-efficient of kinematic friction in the range of 0.25 to 0.35, and which may be about 0.30. The slope face co-efficient of kinematic friction may be in the range of 0.08 to 0.15, and may be about 0.10. A wedge angle of between about 35 and about 50 degrees may be employed. It may be that the wedge angles lie in the range of about 40 to about 45 degrees. In one embodiment in which the wedge angle is about 40 degrees, the upward and downward kinematic friction forces may have magnitudes that are each within about 20% of their average value, and whose sum may lie in the range of about 5400 to about 5800 lbs, and which may be about 5600 lbs (+/−100). In another embodiment in which the wedge angle is about 45 degrees, the magnitudes of each of the upward and downward forces of kinematic friction may be within 20% of their averaged value, and whose sum may lie in the range of about 440 to about 4800 lbs, and may be about 4600 lbs (+/−100).

Combinations and Permutations

The present description recites many examples of dampers and bearing adapter arrangements. Not all of the features need be present at one time, and various optional combinations can be made. As such, the features of the embodiments of several of the various figures may be mixed and matched, without departing from the spirit or scope of the invention. For the purpose of avoiding redundant description, it will be understood that the various damper configurations can be used with spring groups of a 2×4, 3×3, 3:2:3, 2:3:2, 3×5 or other arrangement. Similarly, several variations of bearing to pedestal seat adapter interface arrangements have been described and illustrated. There are a large number of possible combinations and permutations of damper arrangements and bearing adapter arrangements. In that light, it may be understood that the various features can be combined, without further multiplication of drawings and description.

The various embodiments described herein may employ self-steering apparatus in combination with dampers that may tend to exhibit little or no stick-slip. They may employ a "Pennsy" pad, or other elastomeric pad arrangement, for providing self-steering. Alternatively, they may employ a bi-directional rocking apparatus, which may include a rocker having a bearing surface formed on a compound curve of which several examples have been illustrated and described herein. Further still, the various embodiments described herein may employ a four cornered damper wedge arrangement, which may include bearing surfaces of a non-stick-slip nature, in combination with a self steering apparatus, and in particular a bi-directional rocking self-steering apparatus, such as a compound curved rocker.

In the various embodiments of trucks herein, the gibs may be shown mounted to the bolster inboard and outboard of the wear plates on the side frame columns. In the embodiments shown herein, the clearance between the gibs and the side plates is desirably sufficient to permit a motion allowance of at least ¾" of lateral travel of the truck bolster relative to the wheels to either side of neutral, advantageously permits greater than 1 inch of travel to either side of neutral, and may permit travel in the range of about 1 or 1⅛" to about 1⅝" or 1 9/16" inches to either side of neutral.

The inventors presently favour embodiments having a combination of a bi-directional compound curvature rocker surface, a four cornered damper arrangement in which the dampers are provided with friction linings that may tend to exhibit little or no stick-slip behaviour, and may have a slope face with a relatively low friction bearing surface. However, there are many possible combinations and permutations of the features of the examples shown herein. In general it is thought that a self draining geometry may be preferable over one in which a hollow is formed and for which a drain hole may be required.

In each of the trucks shown and described herein, the overall ride quality may depend on the inter-relation of the spring group layout and physical properties, or the damper layout and properties, or both, in combination with the dynamic properties of the bearing adapter to pedestal seat interface assembly. It may be advantageous for the lateral stiffness of the sideframe acting as a pendulum to be less than the lateral stiffness of the spring group in shear. In rail road cars having 110 ton trucks, one embodiment may employ trucks having vertical spring group stiffnesses in the range of 16,000 lbs/inch to 36,000 lbs/inch in combination with an embodiment of bidirectional bearing adapter to pedestal seat interface assemblies as shown and described herein. In another embodiment, the vertical stiffness of the spring group may be less than 12,000 lbs./in per spring group, with a horizontal shear stiffness of less than 6000 lbs./in.

The double damper arrangements shown above can also be varied to include any of the four types of damper installation indicated at page 715 in the 1997 *Car and Locomotive Cyclopedia*, whose information is incorporated herein by reference, with appropriate structural changes for doubled dampers, with each damper being sprung on an individual spring. That is, while inclined surface bolster pockets and inclined wedges seated on the main springs have been shown and described, the friction blocks could be in a horizontal, spring biased installation in a pocket in the bolster itself, and seated on independent springs rather than the main springs. Alternatively, it is possible to mount friction wedges in the sideframes, in either an upward orientation or a downward orientation.

The embodiments of trucks shown and described herein may vary in their suitability for different types of service. Truck performance can vary significantly based on the loading expected, the wheelbase, spring stiffnesses, spring layout, pendulum geometry, damper layout and damper geometry.

Various embodiments of the invention have been described in detail. Since changes in and or additions to the above-described best mode may be made without departing from the nature, spirit or scope of the invention, the invention is not to be limited to those details but only by the appended claims.

We claim:

1. A wheelset-to-sideframe interface assembly for a railroad car truck, said interface assembly comprising:

a bearing adapter and a mating pedestal seat;

said bearing adapter having first and second ends formed for interlocking insertion between a pair of pedestal jaws of a railroad car truck sideframe;

said bearing adapter having a first rocking member;

said pedestal seat having a second rocking member;

said first and second rocking members being matingly engageable to permit rocking therebetween;

a resilient member mounted between said bearing adapter and said pedestal seat;

said resilient member having a portion formed to engage said first end of said bearing adapter;

said resilient member having an accommodation formed therein to permit mating engagement of said first and second rocking members; and, when assembled, said bearing adapter receives vertical loads from said pedestal seat through said first rocking member uninterrupted by said resilient member.

2. The wheelset-to-sideframe interface assembly of claim 1 wherein said resilient member has first and second ends formed for interposition between said bearing adapter and pedestal jaws of the sideframe.

3. The wheelset-to-sideframe interface assembly of claim 1 wherein said resilient member has a relief formed therein to define said accommodation.

4. The wheelset-to-sideframe interface assembly of claim 1 wherein said resilient member is an elastomeric member.

5. The wheelset-to-sideframe interface assembly of claim 4 wherein said elastomeric member is made of a rubber material.

6. The wheelset-to-sideframe interface assembly of claim 4 wherein said elastomeric member is made of a polyurethane material.

7. The wheelset-to-sideframe interface assembly of claim 4 wherein said accommodation is formed through said elastomeric material and said assembly is chosen from the set of assemblies consisting of assemblies in which (a) said first rocking member protrudes at least part way through said accommodation to meet said second rocking member, and (b) said second rocking member protrudes at least part way through said accommodation to meet said first rocking member.

8. The wheelset-to-sideframe interface assembly of claim 1 wherein said bearing adapter is a bearing adapter assembly, said bearing adapter assembly including a bearing adapter body surmounted by said first rocking member.

9. The wheelset-to-sideframe interface assembly of claim 8 wherein said first rocking member is formed of a different material from said bearing adapter body.

10. The wheelset-to-sideframe interface assembly of claim 8 wherein said first rocking member is an insert.

11. The wheelset-to-sideframe interface assembly of claim 8 wherein said first rocking member has a footprint having a profile conforming to said accommodation.

12. The wheelset-to-sideframe interface assembly of claim 11 wherein said profile and said accommodation are mutually indexed to discourage mis-orientation of said first rocking member relative to said bearing adapter.

13. The wheelset-to-sideframe interface assembly of claim 8 wherein said body and said first rocking member are keyed to discourage mis-orientation therebetween.

14. The wheelset-to-sideframe interface assembly of claim 1 wherein said accommodation is formed through said resilient member and said assembly is chosen from the set of assemblies consisting of assemblies in which (a) said first rocking member protrudes at least part way through said accommodation to meet said second rocking member, and (b) said second rocking member protrudes at least part way through said accommodation to meet said first rocking member.

15. The wheelset-to-sideframe interface assembly of claim 1 wherein said pedestal seat includes an insert having said second rocking member formed therein.

16. The wheelset-to-sideframe interface assembly of claim 15 wherein said second rocking member has a footprint having a profile conforming to said accommodation.

17. The wheelset-to-sideframe interface assembly of claim 1 wherein said portion of said resilient member formed to engage said first end of said bearing adapter, when installed, includes elements interposed between said first end of said bearing adapter and a pedestal jaw to inhibit lateral and longitudinal movement of said bearing adapter relative to the jaw.

18. The wheelset-to-sideframe interface assembly of claim 1 wherein:

each of said ends of said bearing adapter includes an end wall bracketed by a pair of corner abutments, said end wall and corner abutments defining a channel to permit sliding insertion of said bearing adapter between the pedestal jaws of the sideframe;

said portion of said resilient member formed to engage said first end of said bearing adapter being a first end portion;

said resilient member having a second end portion formed to engage said second end of said bearing adapter;

said resilient member having a middle portion extending between said first and second end portions; and said accommodation being formed in said middle portion of said resilient member.

19. The wheelset-to-sideframe interface assembly of claim 18 wherein said resilient member has a central opening formed therein to define said accommodation.

20. A wheelset-to-sideframe interface assembly for a rail road car truck, said interface assembly comprising:

a bearing adapter, a pedestal seat, and a resilient member;

said bearing adapter having a first end and a second end, each of said first and second ends having an end wall bracketted by a pair of corner abutments, said end wall and corner abutments co-operating to define a channel permitting insertion of said bearing adapter between a pair of thrust lugs of a sideframe pedestal;

said bearing adapter having a first rocking member;

said pedestal seat having a second rocking member for mating engagement with said first rocking member;

said first and second rocking members, when engaged, being operable to rock longitudinally relative to a sideframe to permit the rail road car truck to steer;

said resilient member having a first end portion engageable with said first end of said bearing adapter for interposition between said first end of said bearing adapter and a first pedestal jaw thrust lug;

said resilient member having a second end portion engageable with said second end of said bearing adapter for interposition between said second end of said bearing adapter and a second pedestal jaw trust lug;

said resilient member having a medial portion lying between said first and second end portions; and said medial portion being formed to accommodate mating rocking engagement of said first and second rocking members.

21. A wheelset-to-sideframe interface assembly kit, said kit comprising:

a pedestal seat for mounting in the roof of a rail road car truck sideframe pedestal;

a bearing adapter for mounting to a bearing of a wheelset of a rail road car truck and a resilient member for mounting to said bearing adapter;

said bearing adapter having a first rocker element for engaging said seat in rocking relationship, and when so engaged, said first rocker element receives vertical loads from said seat and carry said loads into said bearing adapter uninterrupted by said resilient member;

said bearing adapter having a first end and a second end, each of said ends having an end wall and a pair of abutments bracketing said end wall to define a channel, permitting sliding insertion of said bearing adapter between a pair of sideframe pedestal jaw thrust lugs;

said resilient member having a first portion conforming to said first end of said bearing adapter for inter-positioning between said bearing adapter and a thrust lug;

said resilient member having a second portion connected to said first portion; and, when installed, said second portion at least partially overlying said bearing adapter.

22. The kit of claim 21 wherein said second portion of said resilient member has a margin having a profile facing toward said first rocker element, and said first racker element is shaped to nest adjacent said profile.

23. The kit of claim 21 wherein said bearing adapter includes a body, and said first rocker element is separable from said body.

24. The kit of claim 23 wherein said second portion of said resilient member has a margin having a profile facing toward said first rocker element, and said first rocker element is shaped to nest adjacent said profile.

25. The kit of claim 24 wherein said profile and said first rocker element are shaped to discourage mis-orientation of said first rocker element on installation.

26. The kit of claim 23 wherein said first rocker element and said body are mutually keyed to facilitate location of said first rocker element on said body on installation.

27. The kit of claim 23 wherein said first rocker element and said body are mutually keyed to discourage mis-orientation of said rocker element on installation.

28. The kit of claim 24 wherein said first rocker element and said body have mutual engagement features, said features being mutually keyed to discourage mis-orientation of said rocker element on installation.

29. The kit of claim 28 wherein, on assembly of said kit, said profile provides a coarse locating bias to urge said first rocker member to within a first tolerance of location, and, within said first tolerance of location said mutual engagement features mate to urge said first rocker to within a second tolerance of location.

30. The kit of claim 23 wherein said kit includes a second resilient member, said second resilient member conforming to said second end of said bearing adapter.

31. The kit of claim 23 wherein said resilient member includes a pedestal seat engagement fitting for locating said resilient member relative to said pedestal seat on assembly.

32. The kit of claim 23 wherein said resilient member includes a second end portion conforming to said second end of said bearing adapter.

33. A wheelset-to-sideframe interface assembly for a railroad car truck, said interface assembly comprising:

a bearing adapter and a mating pedestal seat;

said bearing adapter having first and second ends formed for interlocking insertion between a pair of pedestal jaws of a railroad car truck sideframe;

said bearing adapter having a first rocking member;

said pedestal seat having a second rocking member;

said first and second rocking members being matingly engageable to permit rocking therebetween;

a resilient member mounted between said bearing adapter and said pedestal seat;

said resilient member having a portion formed to engage said first end of said bearing adapter;

said resilient member having an accommodation formed therein to permit mating engagement of said first and second rocking members;

said accommodation is formed through said resilient member; and said assembly is chosen from the set of assemblies consisting of assemblies in which (a) said first rocking member protrudes at least part way through said accommodation to meet said second rocking member; and (b) said second rocking member protrudes at least part way through said accommodation to meet said first rocking member.

34. The wheelset-to-sideframe interface assembly of claim 33 wherein said resilient member has first and second ends formed for interposition between said bearing adapter and pedestal jaws of the sideframe.

35. The wheelset-to-sideframe interface assembly of claim 33 wherein said resilient member is an elastomeric member.

36. The wheelset-to-sideframe interface assembly of claim 33 wherein said bearing adapter is a bearing adapter assembly, said bearing adapter assembly including a bearing adapter body surmounted by said first rocking member.

37. The wheelset-to-sideframe interface assembly of claim 36 wherein said first rocking member is formed of a different material from said bearing adapter body.

38. The wheelset-to-sideframe interface assembly of claim 36 wherein said first rocking member is an insert.

39. The wheelset-to-sideframe interface assembly of claim 36 wherein said first rocking member has a footprint having a profile conforming to said accommodation.

40. The wheelset-to-sideframe interface assembly of claim 39 wherein said profile and said accommodation are mutually indexed to discourage mis-orientation of said first rocking member relative to said bearings adapter.

41. The wheelset-to-sideframe interface assembly of claim 36 wherein said body and said first rocking member are keyed to discourage mis-orientation therebetween.

42. The wheelset-to-sideframe interface assembly of claim 33 wherein said pedestal seat includes an insert having said second rocking member formed therein.

43. The wheelset-to-sideframe interface assembly of claim 33 wherein said portion of said resilient member formed to engage said first end of said bearing adapter, when installed, includes elements interposed between said first end of said bearing adapter and a pedestal jaw to inhibit lateral and longitudinal movement of said bearing adapter relative to the jaw.

44. The wheelset-to-sideframe interface assembly at claim 33 wherein:

each of said ends of said bearing adapter includes an end wall bracketed by a pair of corner abutments, said end wall and corner abutments defining a channel to permit sliding insertion of said bearing adapter between the pedestal jaws of the sideframe;

said portion of said resilient member formed to engage said first end of said bearing adapter being a first end portion;

said resilient member having a second end portion formed to engage said second end of said bearing adapter;

said resilient member having a middle portion extending between said first and second end portions; and said accommodation being formed in said middle portion of said resilient member.

45. The assembly of claim 33 wherein said resilient member includes a second portion, said second portion at least partially overlying said bearing adapter, said accommodation being formed in said second portion; said second portion of said resilient member has a margin having a profile facing toward said first rocker element; and said first rocker element is shaped to nest adjacent said profile.

46. The assembly of claim 45 wherein said profile and said first rocker element are shaped to discourage mis-orientation of said first rocker element on installation.

47. The assembly of claim 33 wherein said bearing adapter includes a body, and said first rocking member is separable from said body.

48. The assembly of claim 47 wherein said first rocking member and said body are mutually keyed to discourage mis-orientation of said rocker element on installation.

49. The assembly of claim 47 wherein said kit includes a second resilient member, said second resilient member conforming to said second end of said beating adapter.

50. The assembly of claim 47 wherein said resilient member includes a pedestal seat engagement fitting for locating said resilient member relative to said pedestal seat on assembly.

* * * * *